US011808536B2

(12) United States Patent
Song et al.

(10) Patent No.: US 11,808,536 B2
(45) Date of Patent: Nov. 7, 2023

(54) SAFETY LOCK MECHANISMS FOR PORTABLE WEAPONS, INCLUDING CROSSBOWS AND FIREARMS, SUCH AS GUNS, RIFLES AND ALIKE

(71) Applicant: Jiuhong Song, Vancouver (CA)

(72) Inventors: Jiuhong Song, Vancouver (CA); Xinting Liu, HuBei (CN)

( * ) Notice: Subject to any disclaimer, the term of this patent is extended or adjusted under 35 U.S.C. 154(b) by 118 days.

(21) Appl. No.: 17/442,833

(22) PCT Filed: Mar. 29, 2019

(86) PCT No.: PCT/IB2019/000326
§ 371 (c)(1),
(2) Date: Sep. 24, 2021

(87) PCT Pub. No.: WO2020/201788
PCT Pub. Date: Oct. 8, 2020

(65) Prior Publication Data
US 2022/0178639 A1 Jun. 9, 2022

(51) Int. Cl.
*F41A 17/06* (2006.01)

(52) U.S. Cl.
CPC ..... *F41A 17/06* (2013.01)

(58) Field of Classification Search
CPC ..... F41A 17/06
USPC ..... 42/70.06
See application file for complete search history.

(56) References Cited

U.S. PATENT DOCUMENTS 4,141,166 A * 2/1979 Schultz ..... F41A 17/20 42/70.08
4,488,370 A * 12/1984 Lemelson ..... G07C 9/00309 42/70.11
5,123,193 A * 6/1992 Pugh ..... F41A 17/063 42/70.11
6,237,271 B1 * 5/2001 Kaminski ..... F41A 17/08 42/70.08
6,412,207 B1 * 7/2002 Crye ..... F41A 17/56 42/70.08
6,442,880 B1 * 9/2002 Allan ..... F41A 17/066 42/70.11

(Continued)

FOREIGN PATENT DOCUMENTS

CA 2166849 9/1996
CN 205482562 8/2016

(Continued)

OTHER PUBLICATIONS

Supplementary European Search Report issued in European Patent Application No. 19922797.6 dated Sep. 28, 2022.

(Continued)

*Primary Examiner* — Samir Abdosh
(74) *Attorney, Agent, or Firm* — Whiteford, Taylor & Preston, LLP; Gregory M. Stone

(57) ABSTRACT

Safety lock mechanisms (C1-C28) for a portable weapon is disclosed. Such a mechanism includes an actuator (M3), and locking means operable from an unlocked state to a locked state by the actuator (M3) for blocking a firing sequence of said portable weapon. The blocking of the firing sequence is carried out at a trigger, a trigger lever, a hammer, or a firing pin of the portable weapon. The actuator (M3) may be a push-pull solenoid or servo motor.

16 Claims, 79 Drawing Sheets

(56) References Cited

U.S. PATENT DOCUMENTS 6,550,175 B2 * 4/2003 Parker ..... F41A 17/54 42/70.07
6,563,940 B2 * 5/2003 Recce ..... F41A 17/066 42/70.01
7,339,456 B1 * 3/2008 Buckley ..... F41A 17/063 42/70.11
8,037,632 B2 * 10/2011 Pikielny ..... F41A 17/066 42/70.11
9,841,249 B1 * 12/2017 Nicks ..... H02J 7/0045
9,857,133 B1 * 1/2018 Kloepfer ..... G06F 21/32
2002/0174588 A1 * 11/2002 Danner ..... F41A 17/06 42/70.09
2011/0061280 A1 * 3/2011 Emde ..... F41A 17/063 42/70.01
2014/0144057 A1 * 5/2014 Brunner ..... F41A 17/06 42/70.08
2014/0366419 A1 * 12/2014 Allan ..... F41A 17/06 42/70.11
2015/0253093 A1 * 9/2015 Allan ..... F41A 17/06 42/70.06
2016/0327356 A1 * 11/2016 Milde, Jr. ..... F41A 17/066
2017/0350667 A1 * 12/2017 Fishbein ..... F41A 17/063
2018/0142977 A1 5/2018 Kloepfer et al.

FOREIGN PATENT DOCUMENTS

CN 107036486 8/2017
RU 2013157382 7/2015
RU 2667813 9/2015
WO WO-2020092580 A1 * 5/2020 ..... F41A 17/06
WO WO-2020201787 A1 * 10/2020 ..... F41A 17/06

OTHER PUBLICATIONS

International Search Report issued in co-pending International Application No. PCT/IB2019/000326 dated Dec. 27, 2019.
Office Action issued in co-pending Russian Application No. 2021117085/11(035988) dated May 25, 2022.

* cited by examiner

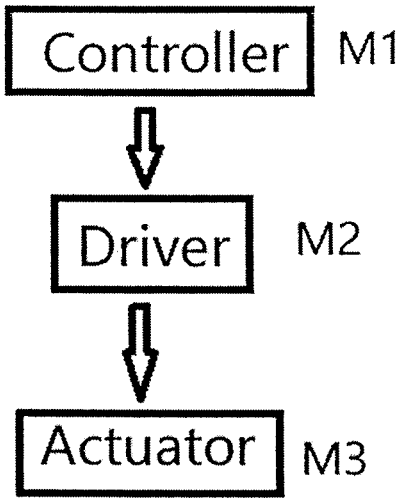
FIG 1.0
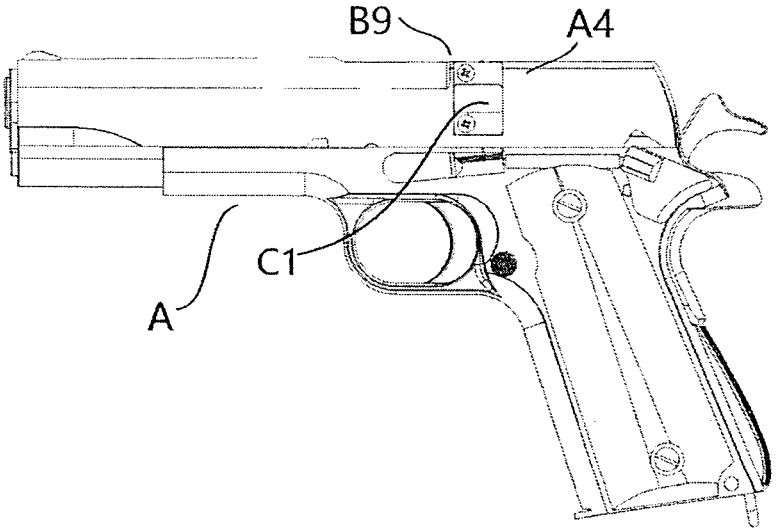
FIG 1.1

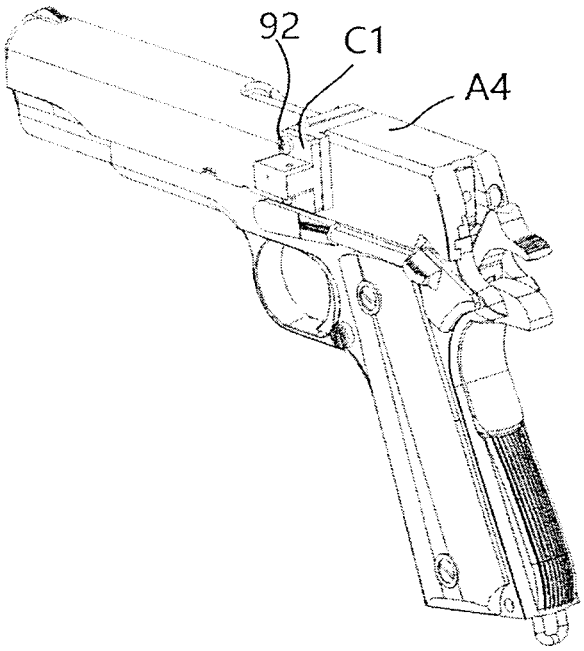
FIG 1.2
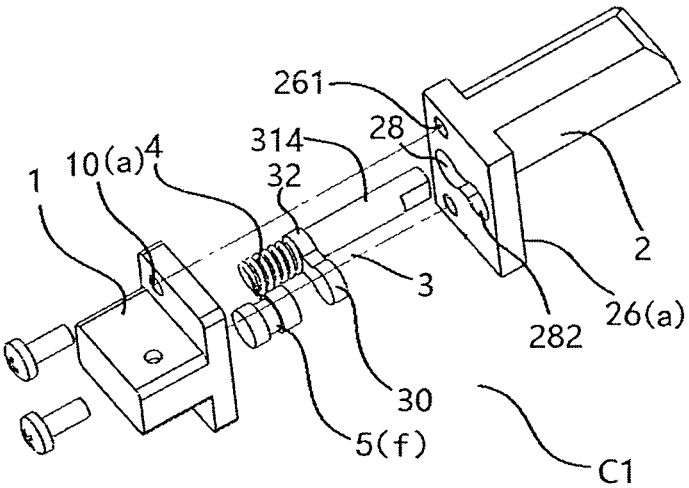
FIG 1.3
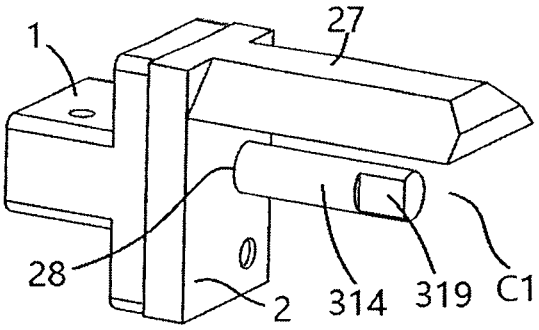
FIG 1.4

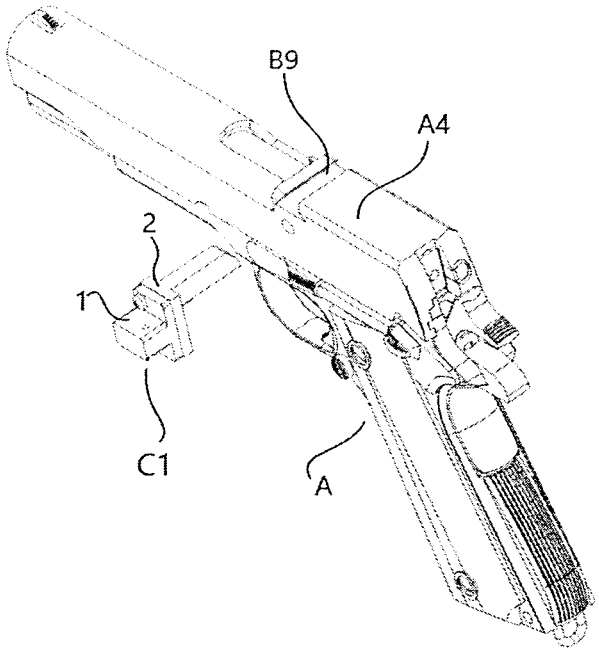
FIG 1.5
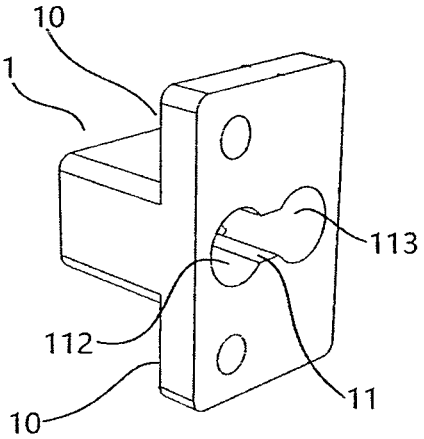
FIG 1.6

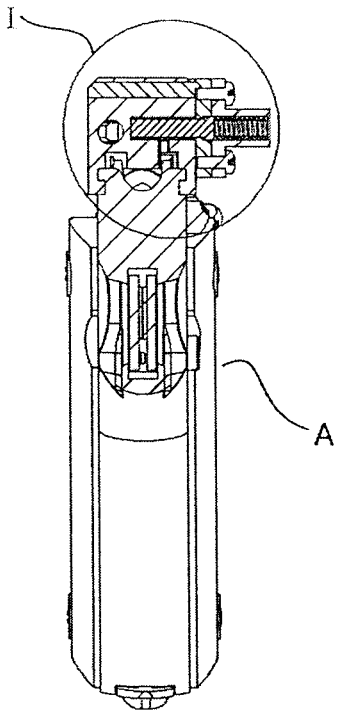
FIG 1.71
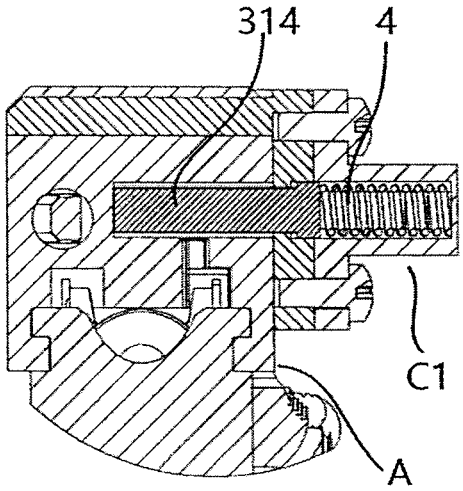
FIG 1.72

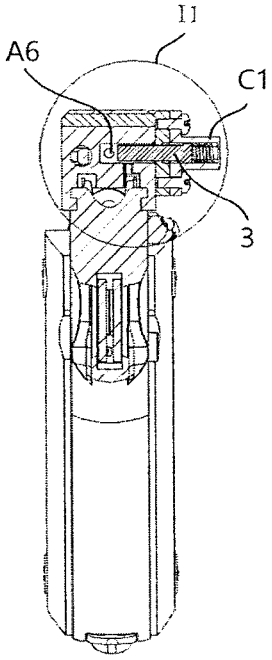
FIG 1.81
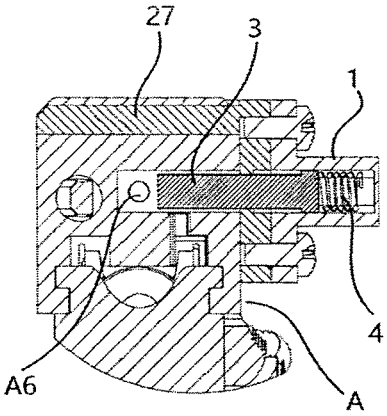
FIG 1.82
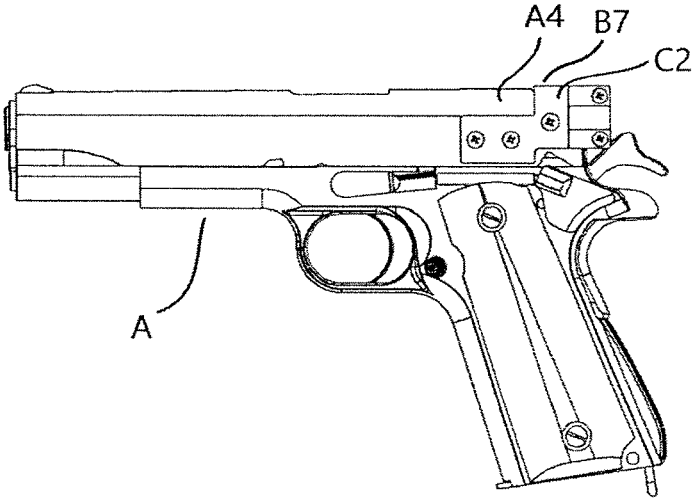
FIG 2.1

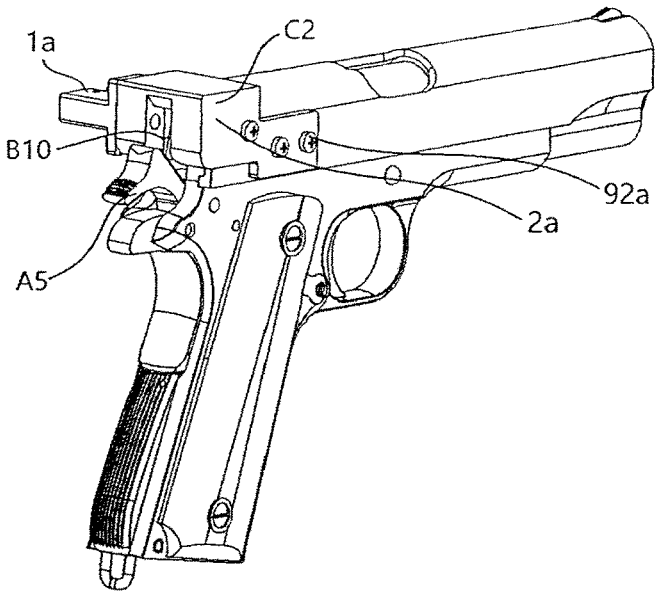
FIG 2.2
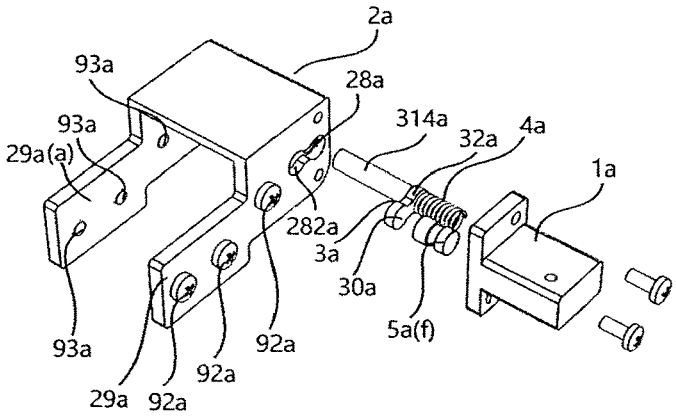
FIG 2.3
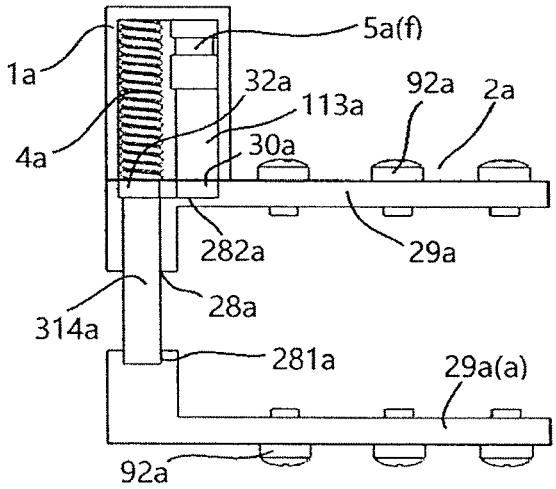
FIG 2.4

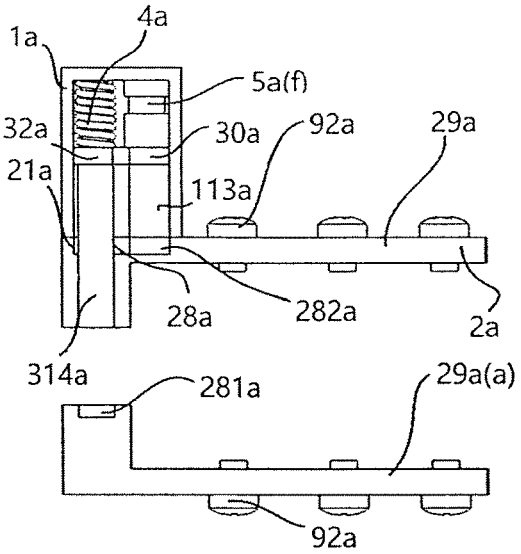
FIG 2.5
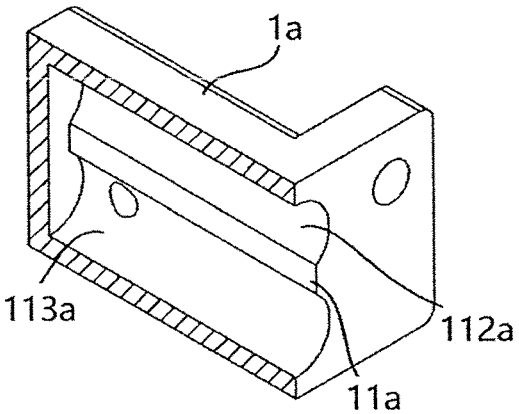
FIG 2.6
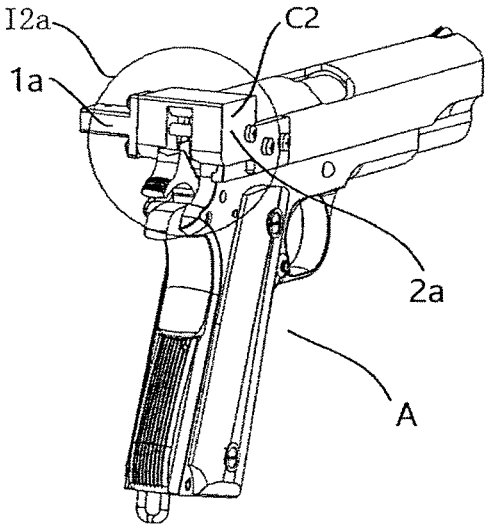
FIG 2.71

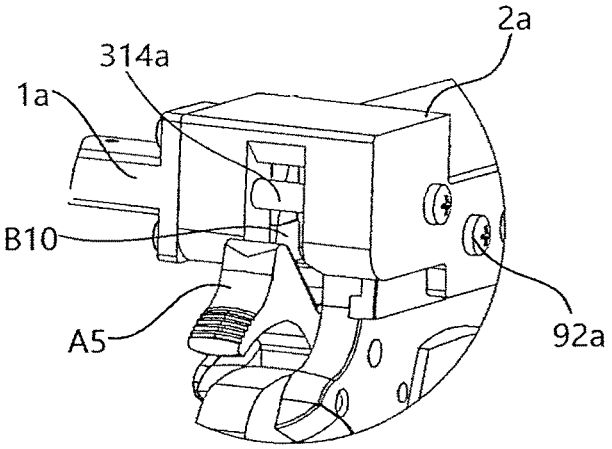
FIG 2.72
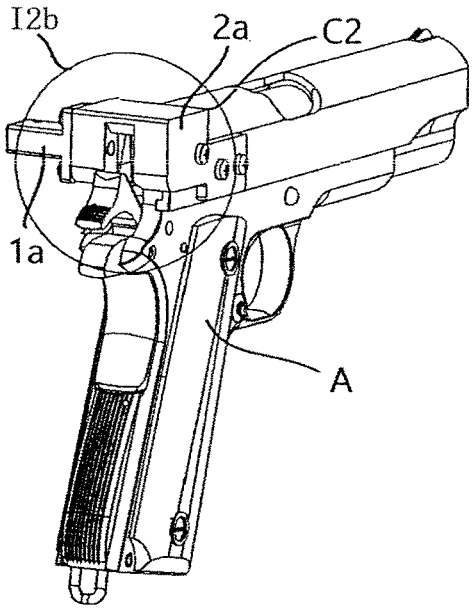
FIG 2.81
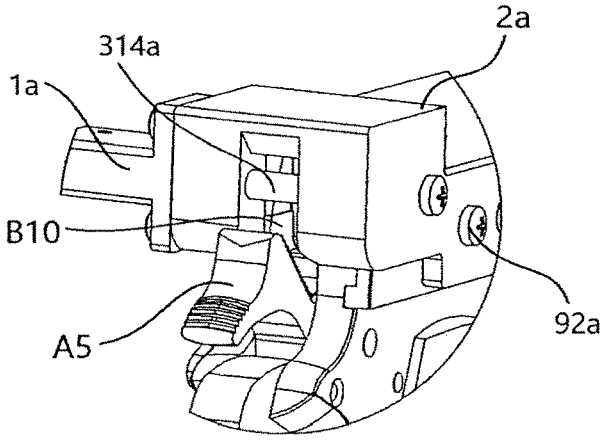
FIG 2.82

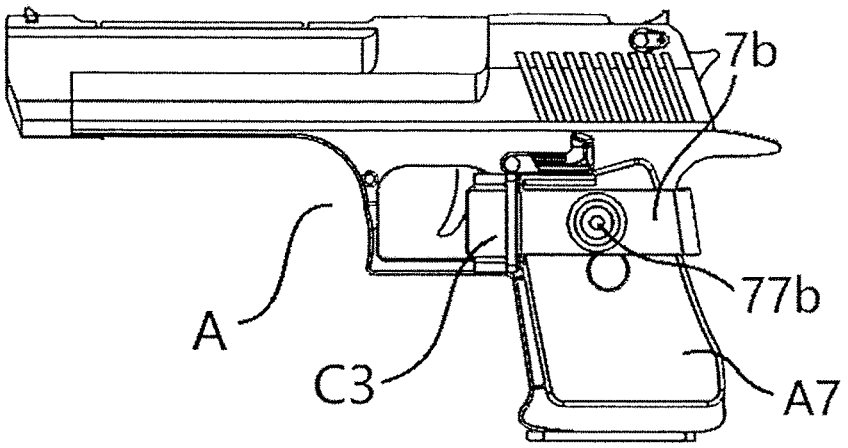
FIG 3.1
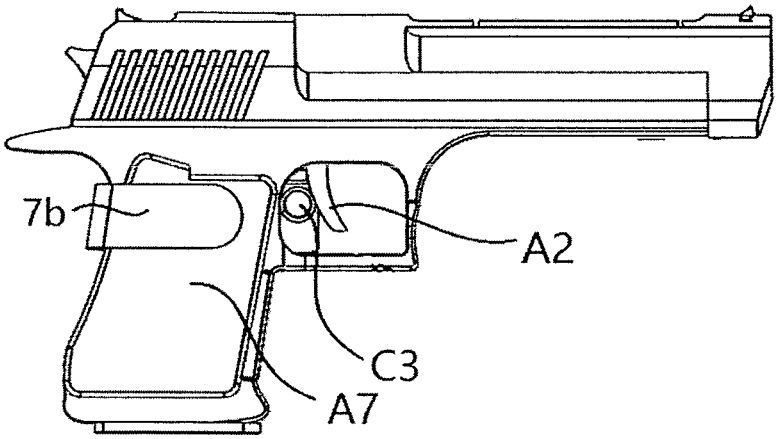
FIG 3.2
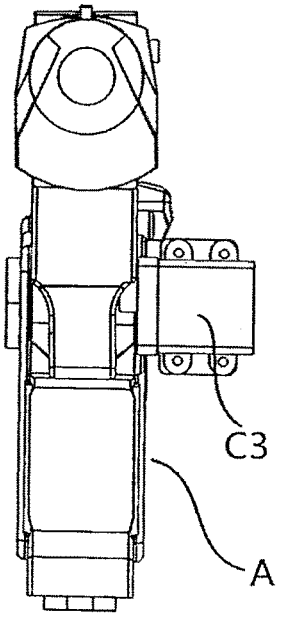
FIG 3.3

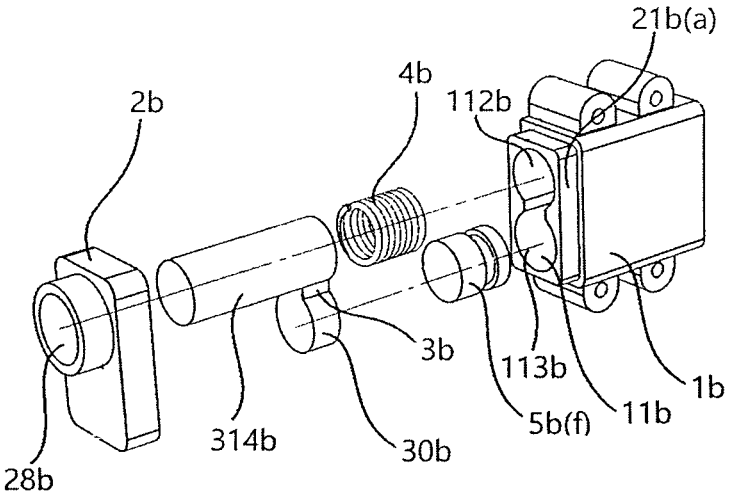
FIG 3.4
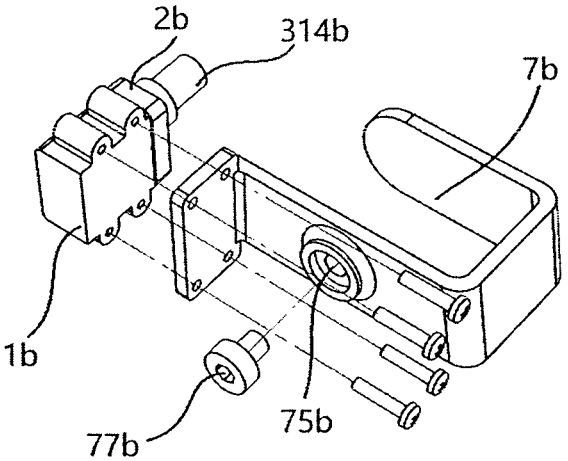
FIG 3.5
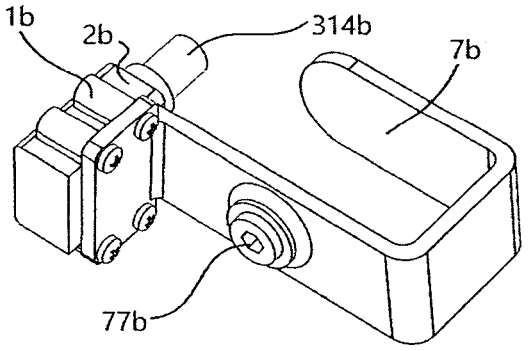
FIG 3.6

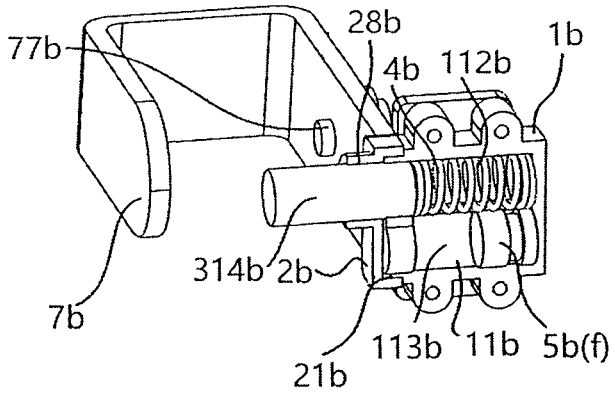
FIG 3.7
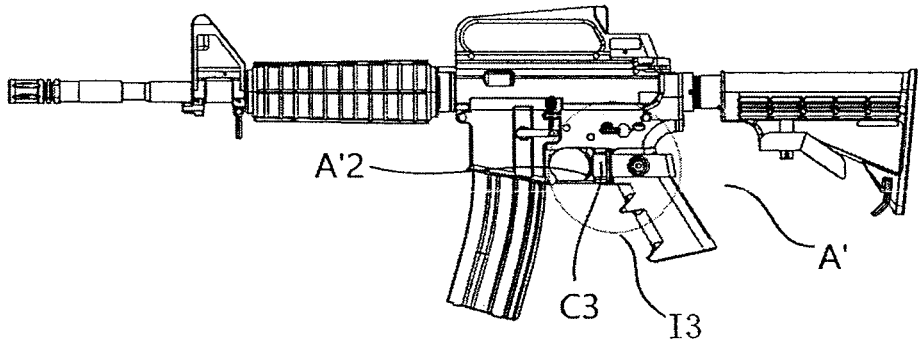
FIG 3.81
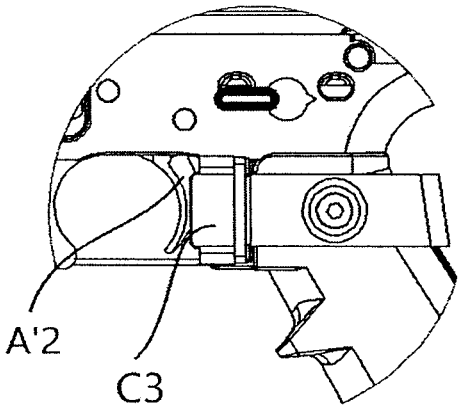
FIG 3.82

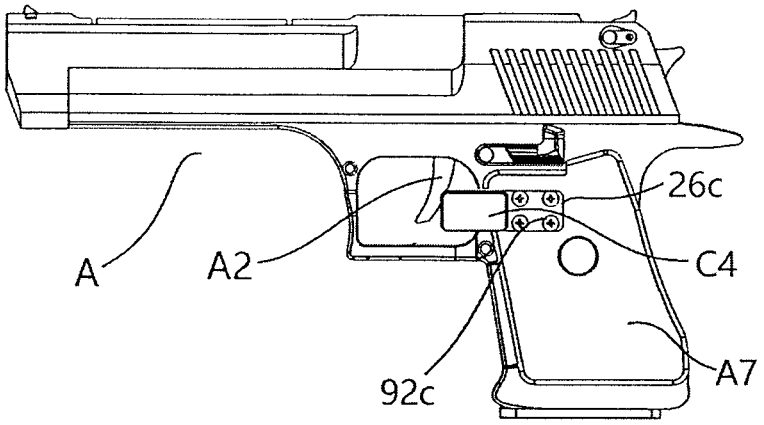
FIG 4.1
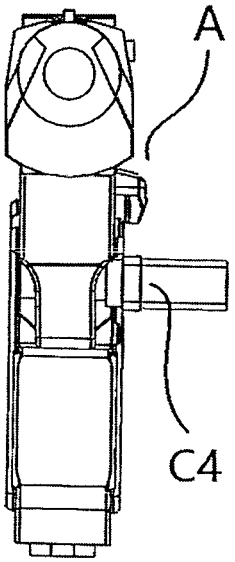
FIG 4.2
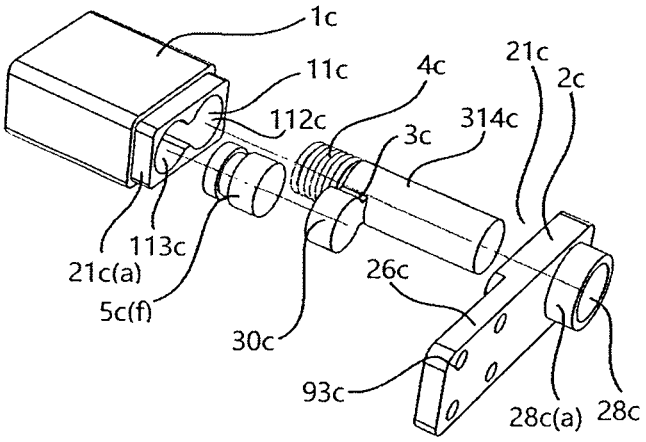
FIG 4.3

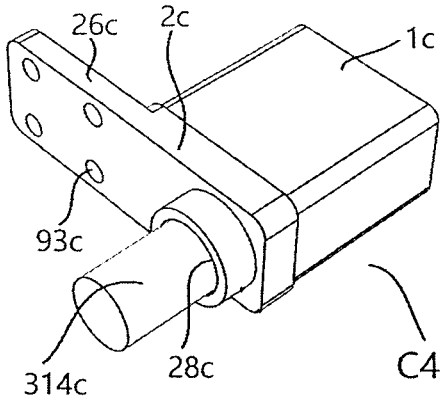
FIG 4.4
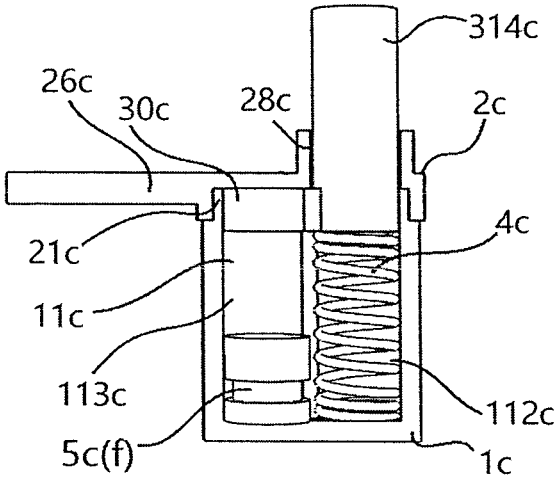
FIG 4.5
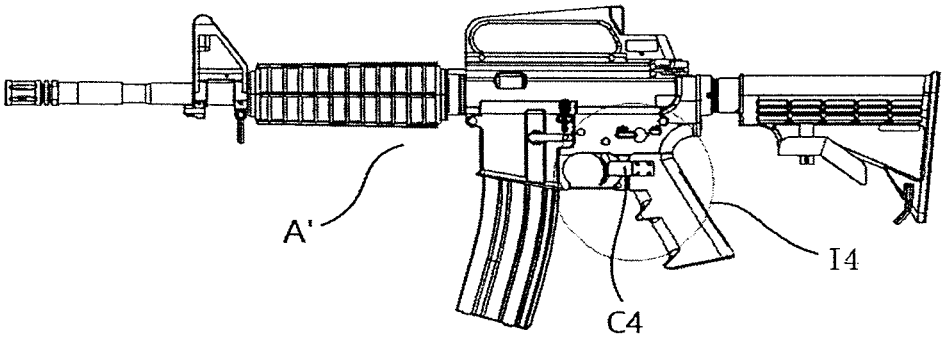
FIG 4.61

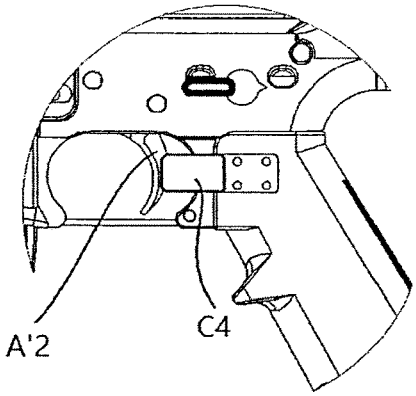
FIG 4.62
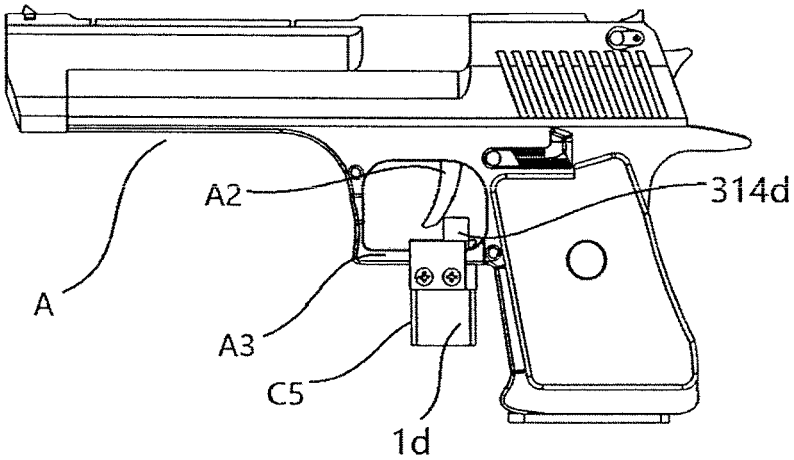
FIG 5.1
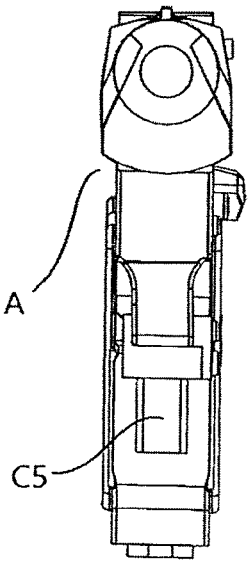
FIG 5.2

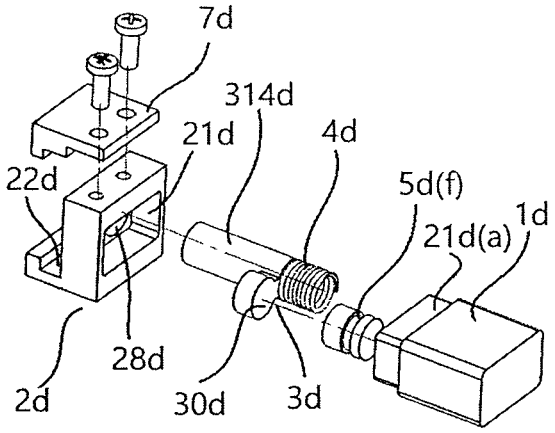
FIG 5.3
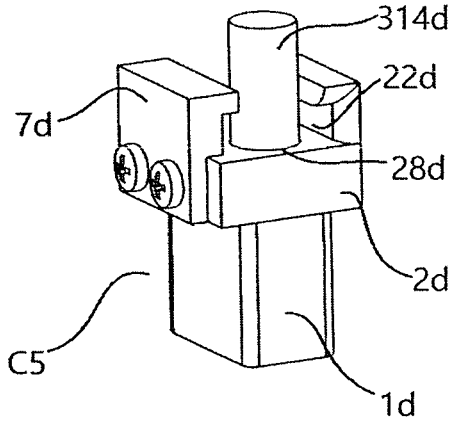
FIG 5.4
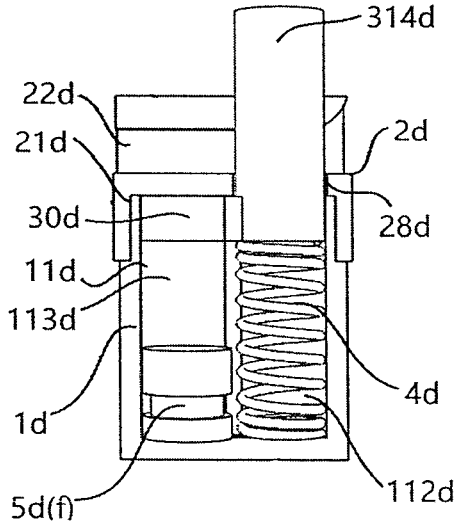
FIG 5.5

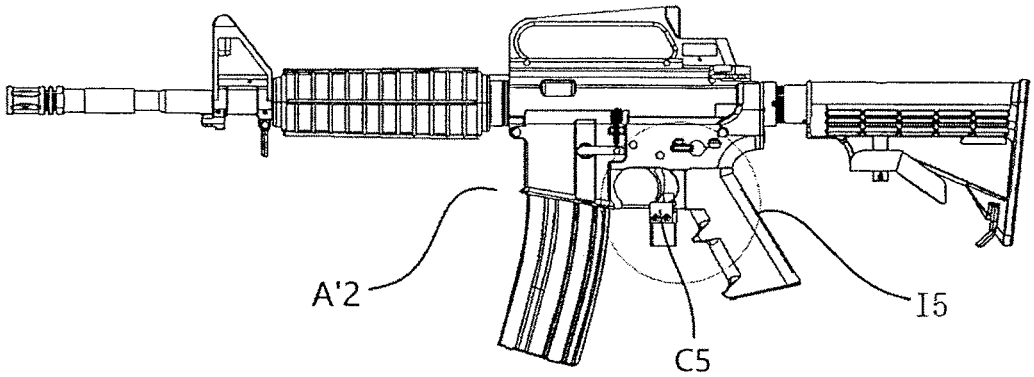
FIG 5.61
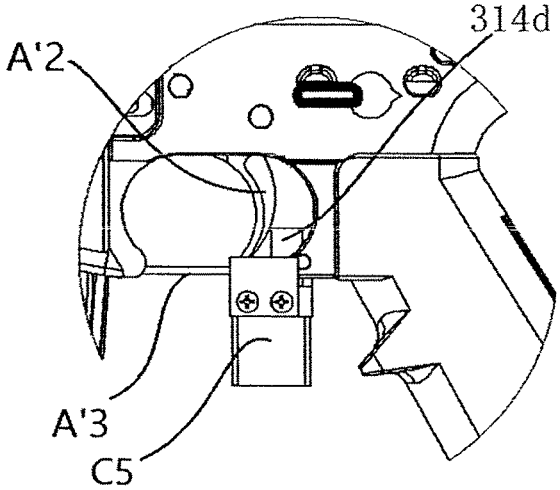
FIG 5.62
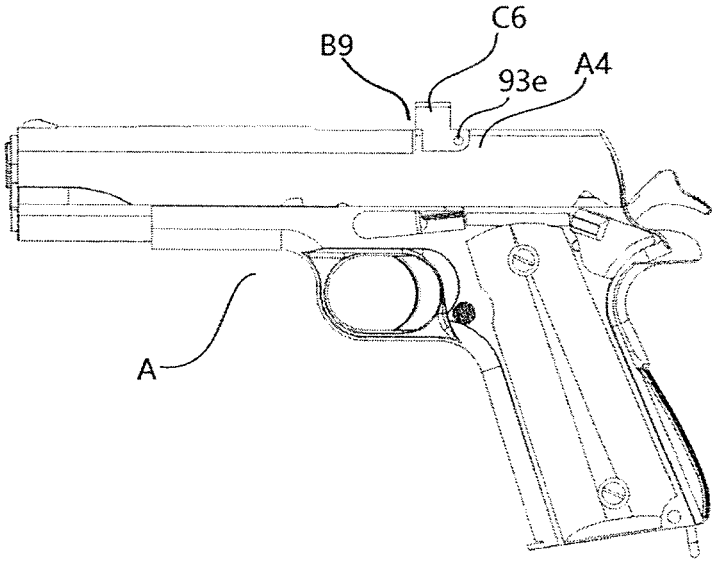
FIG 6.1

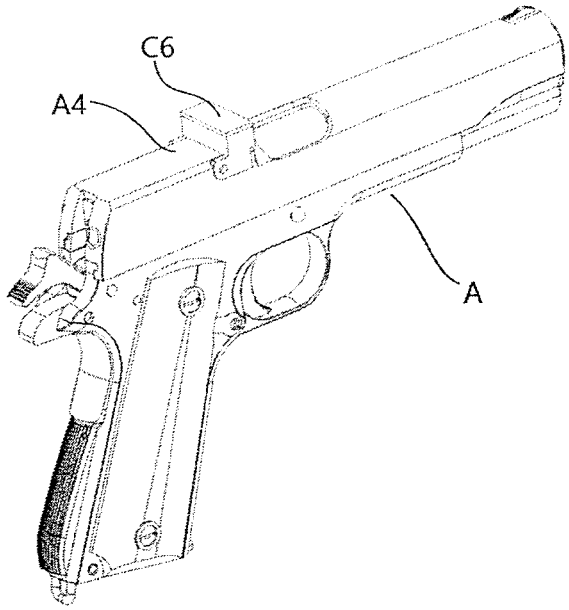
FIG 6.2
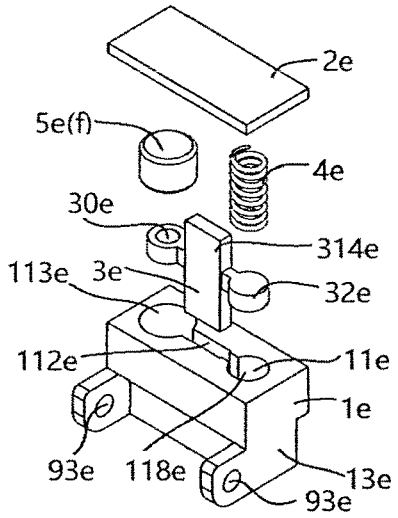
FIG 6.3
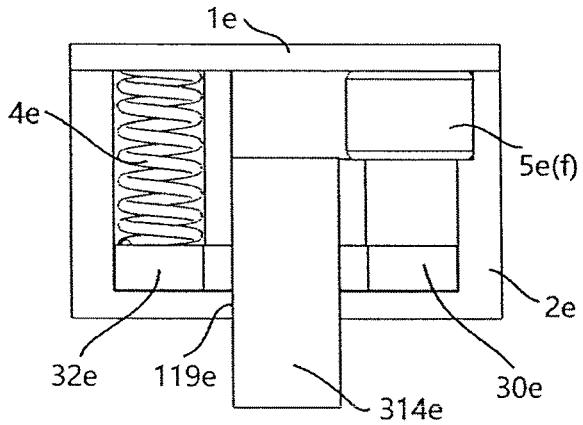
FIG 6.4

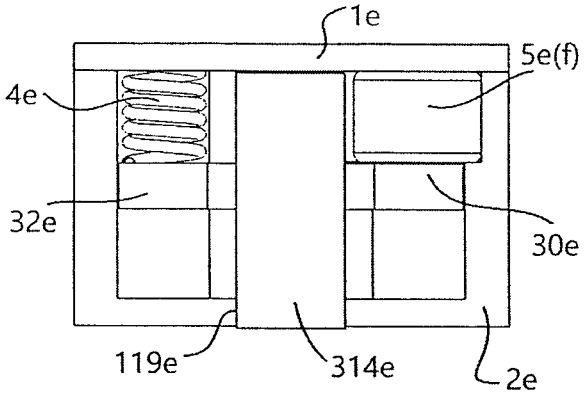
FIG 6.5
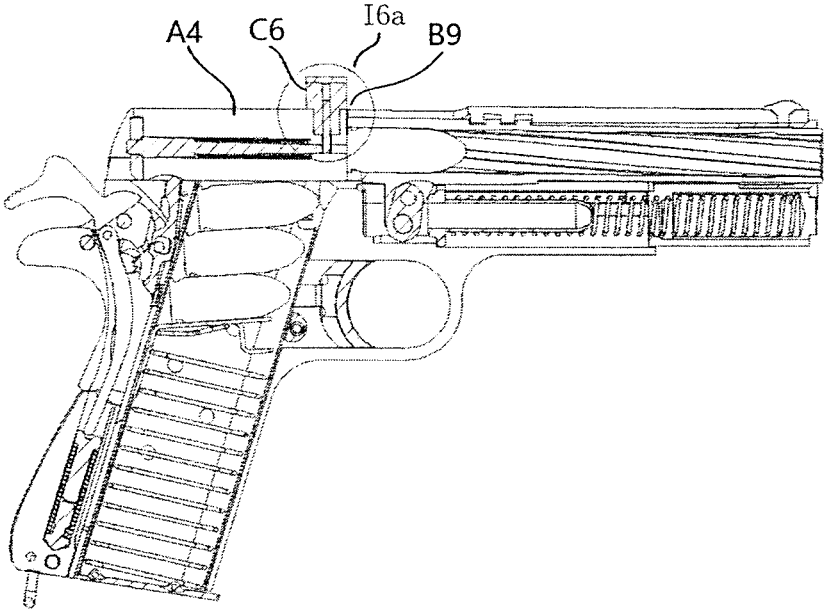
FIG 6.61
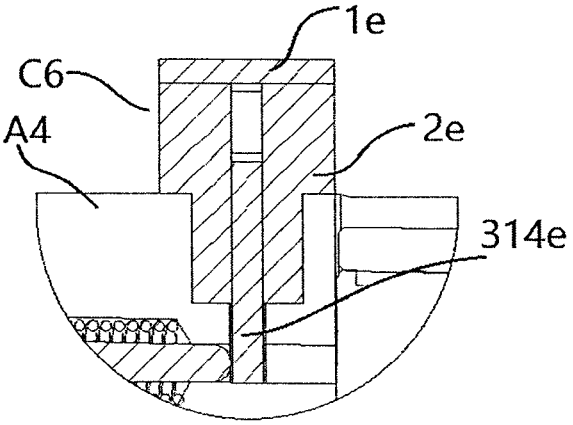
FIG 6.62

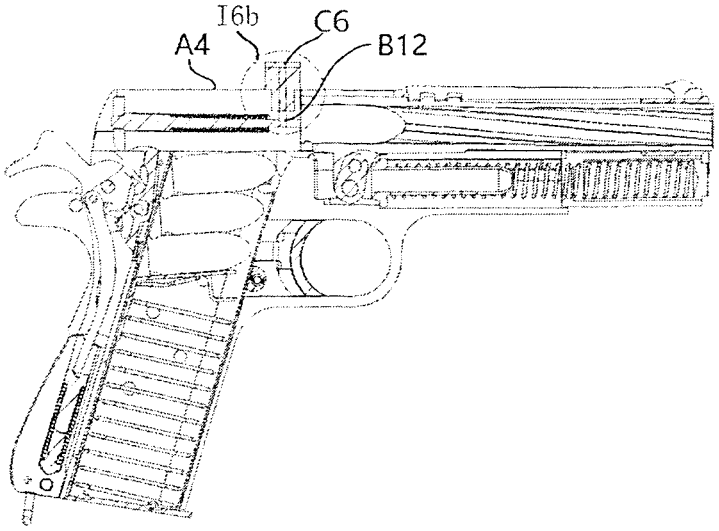
FIG 6.71
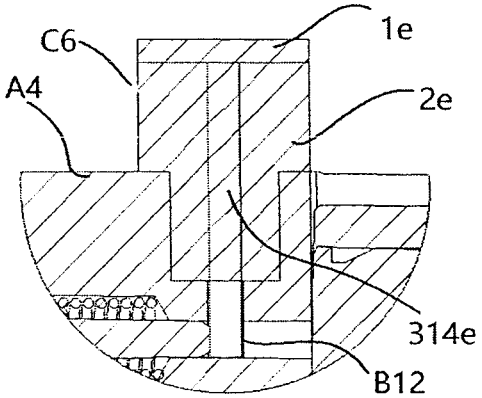
FIG 6.72
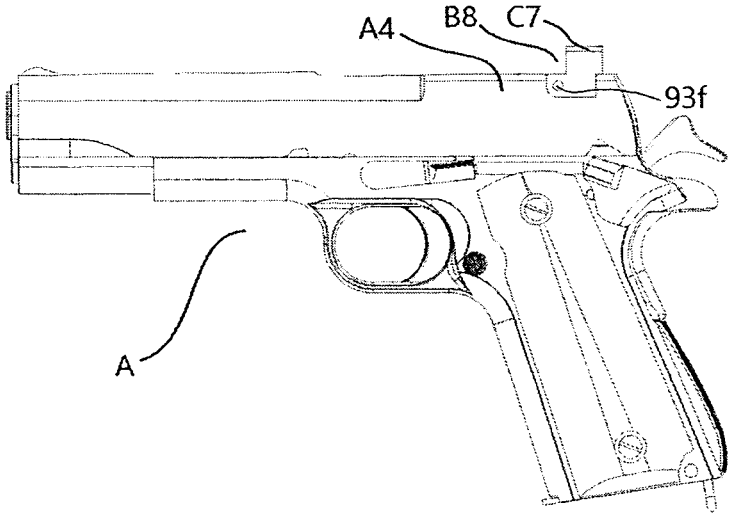
FIG 7.1

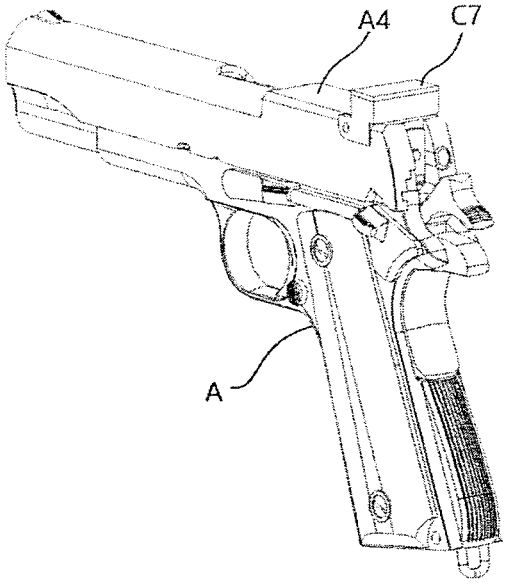
FIG 7.2
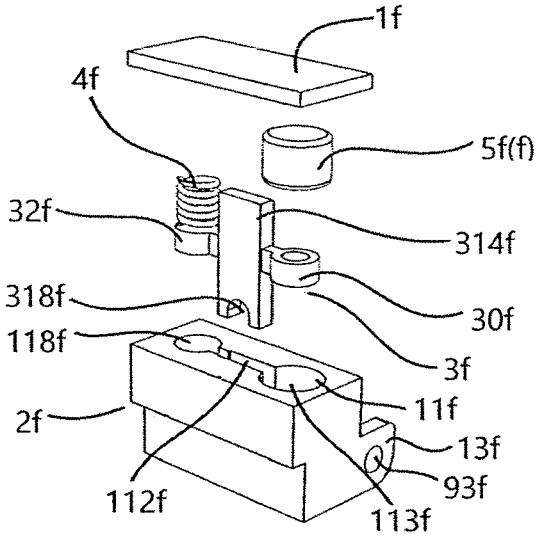
FIG 7.3
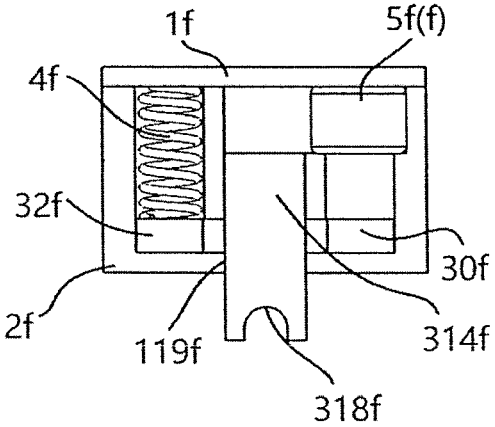
FIG 7.4

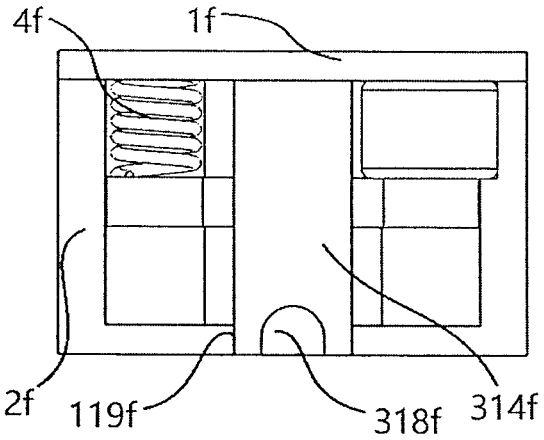
FIG 7.5
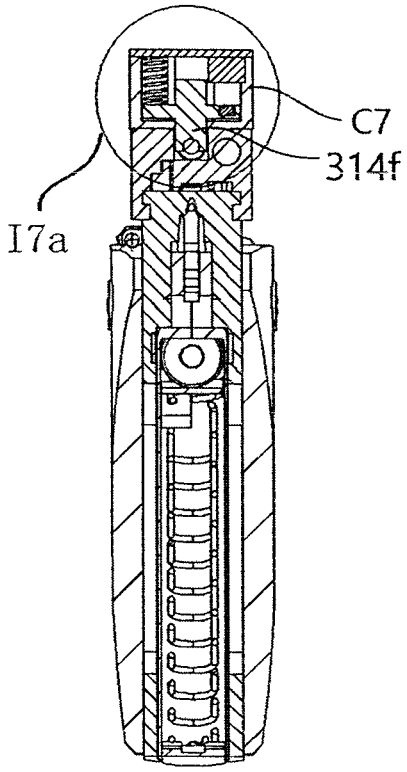
FIG 7.61

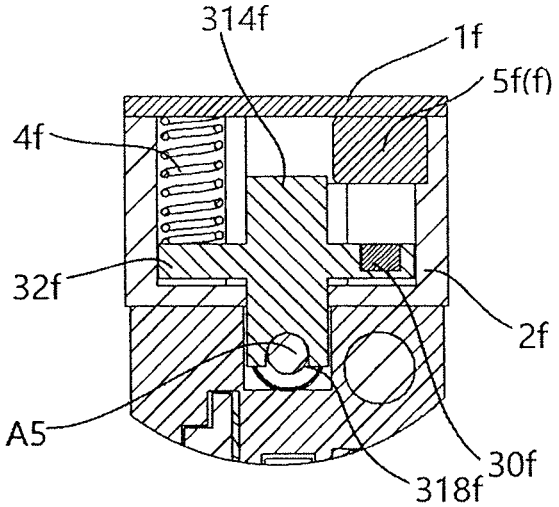
FIG 7.62
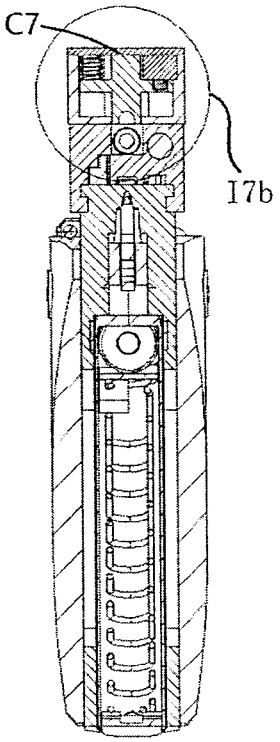
FIG 7.71

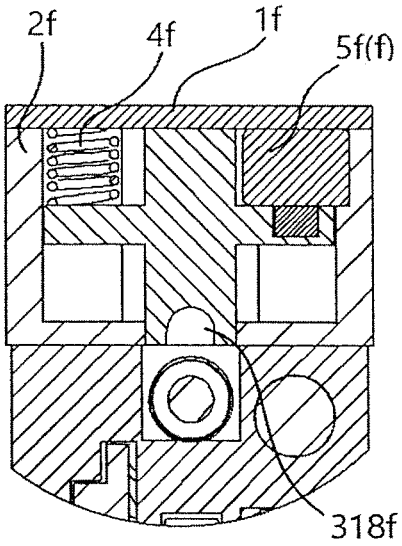
FIG 7.72
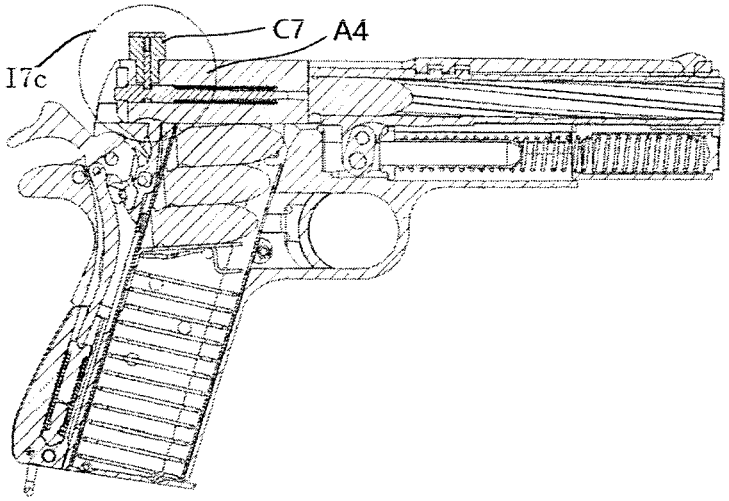
FIG 7.81
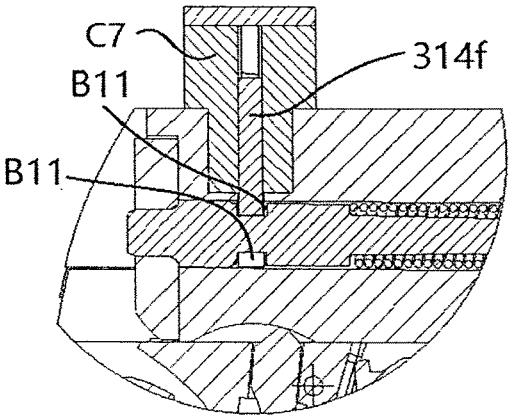
FIG 7.82

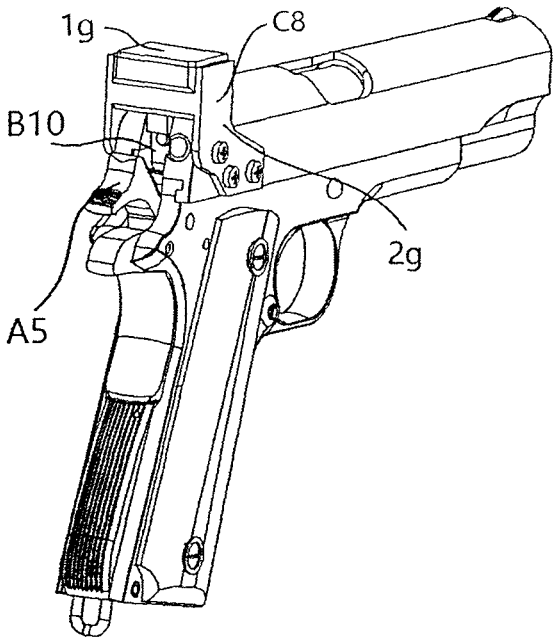
FIG 8.1
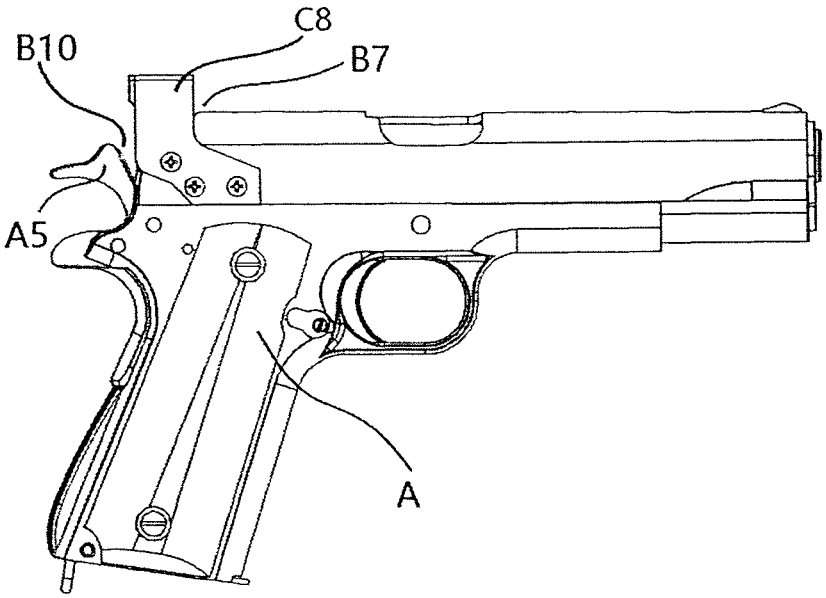
FIG 8.2

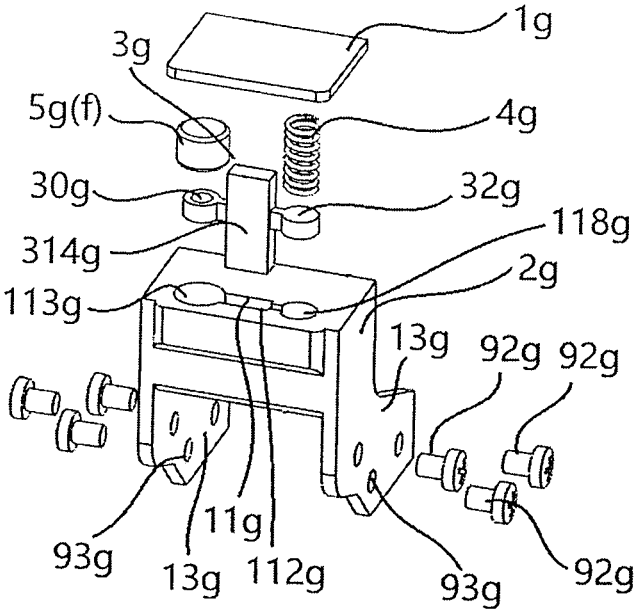
FIG 8.3
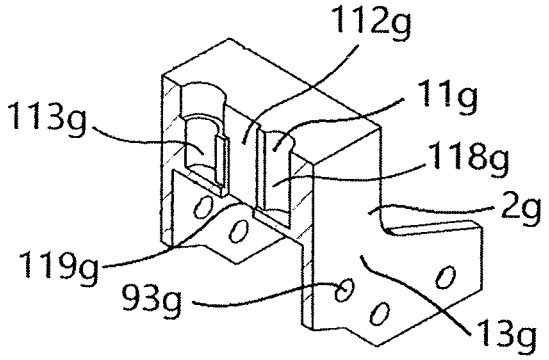
FIG 8.4
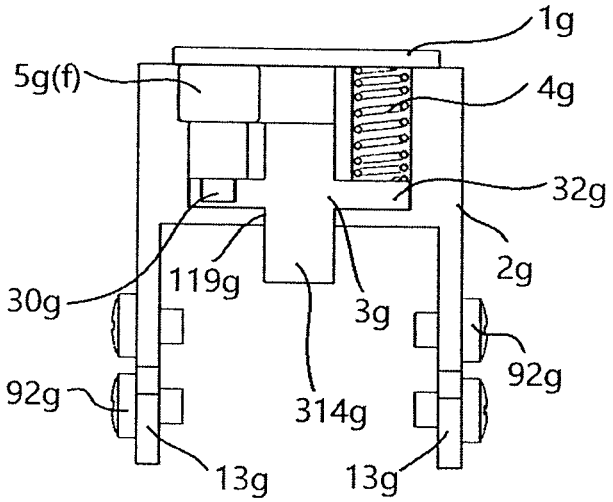
FIG 8.5

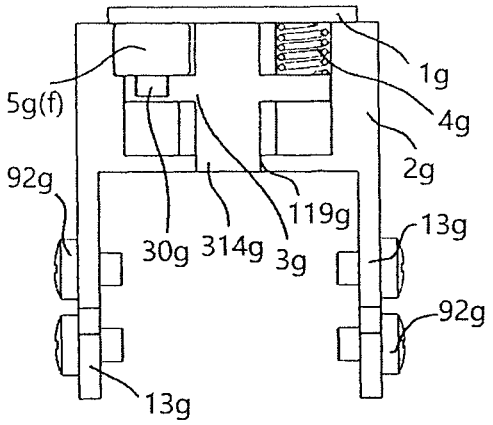
FIG 8.6
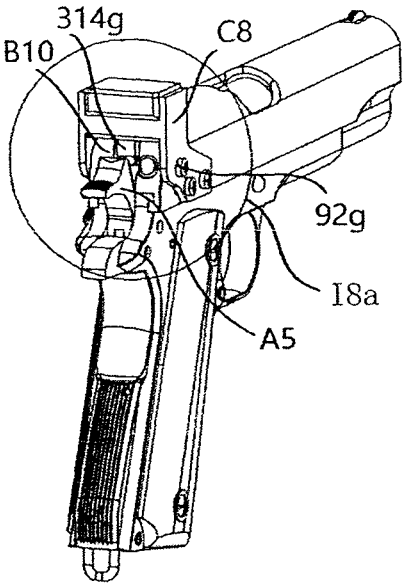
FIG 8.71
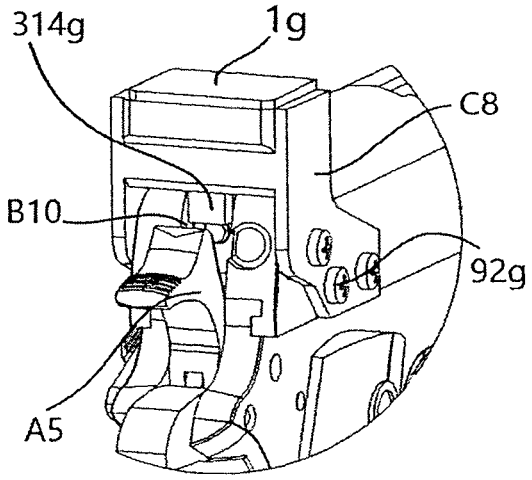
FIG 8.72

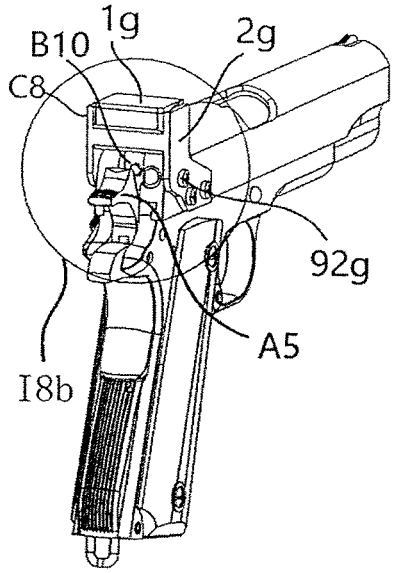
FIG 8.81
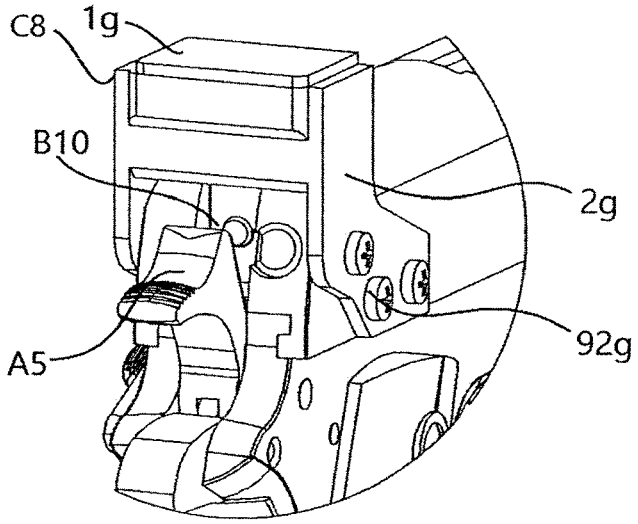
FIG 8.82
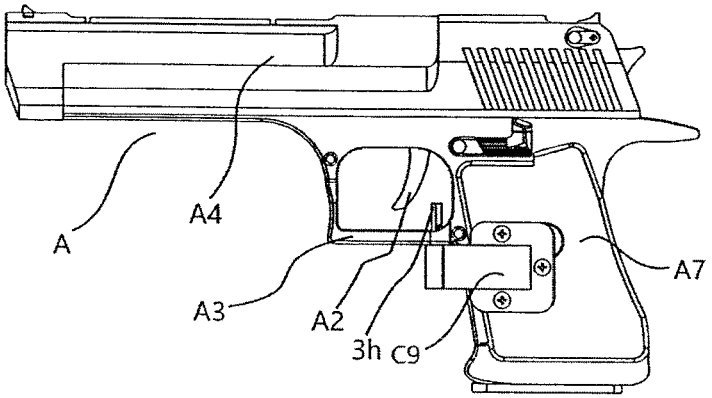
FIG 9.1

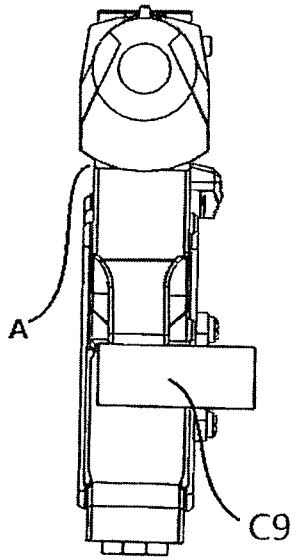
FIG 9.2
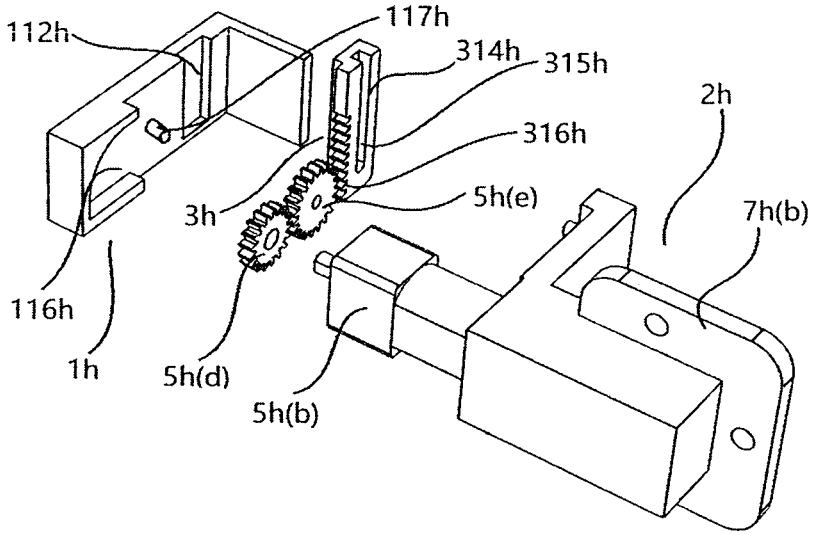
FIG 9.3

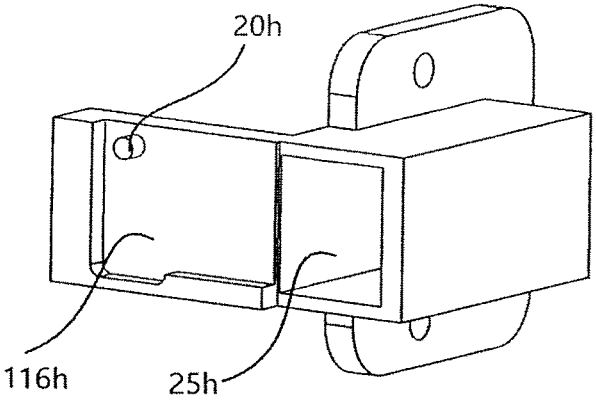
FIG 9.4
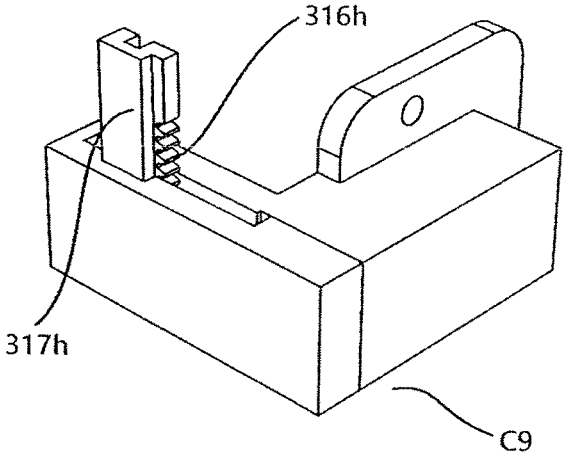
FIG 9.5
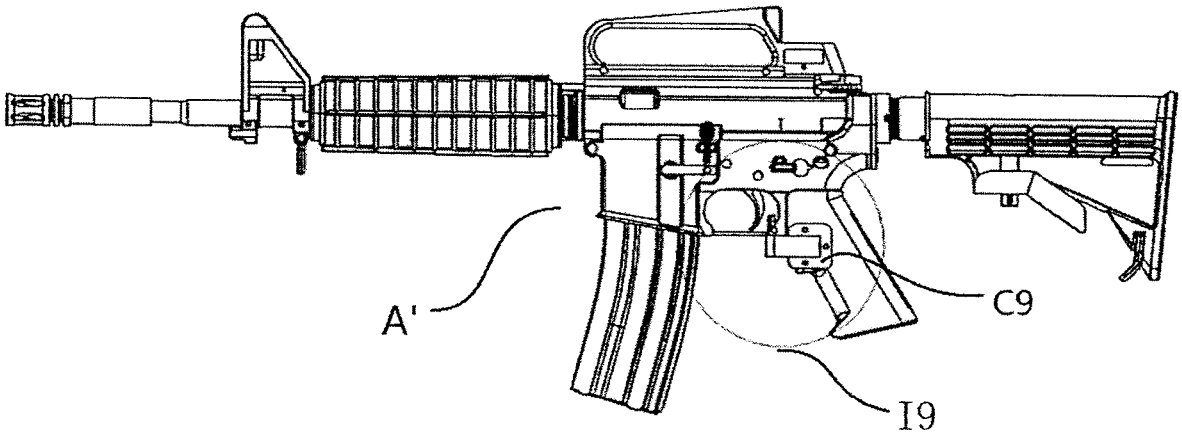
FIG 9.61

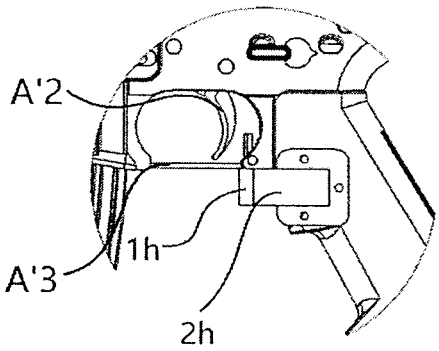
FIG 9.62
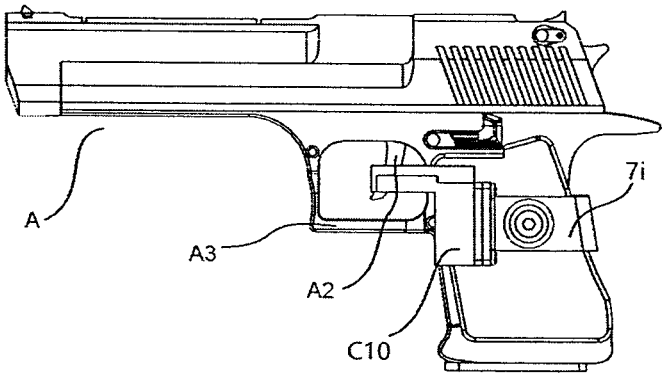
FIG 10.1
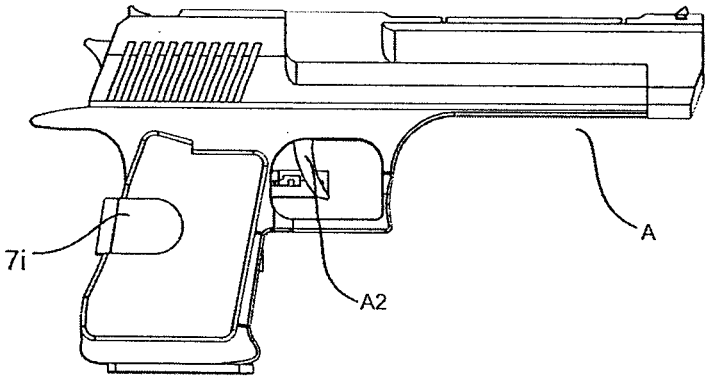
FIG 10.2

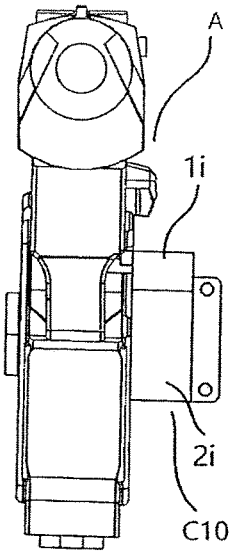
FIG 10.3
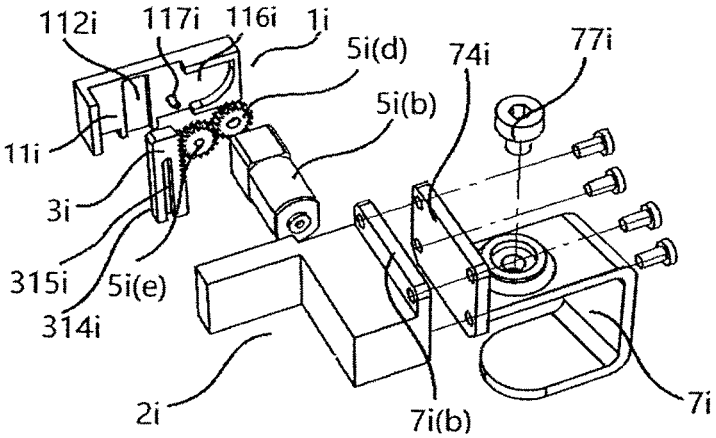
FIG 10.4
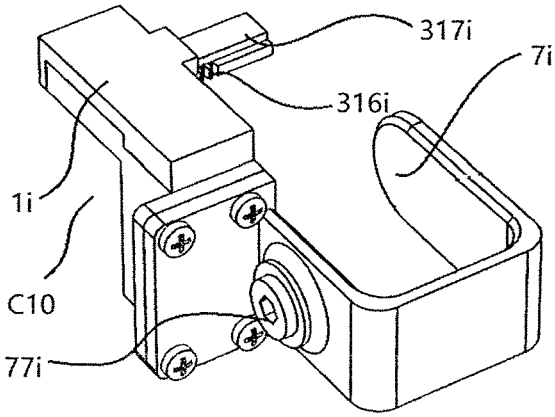
FIG 10.5

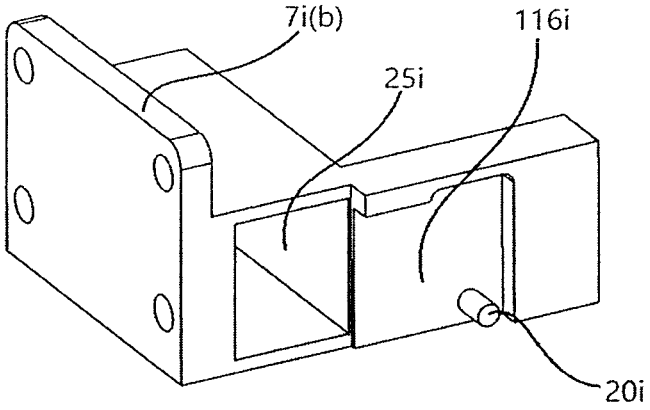
FIG 10.6
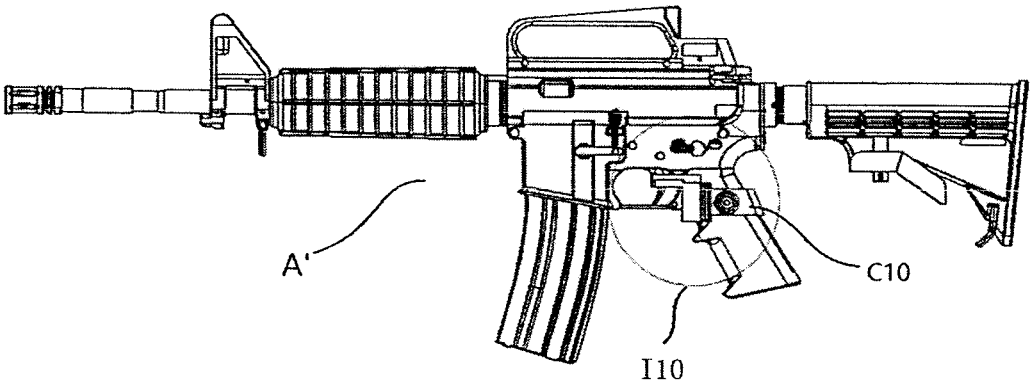
FIG 10.71
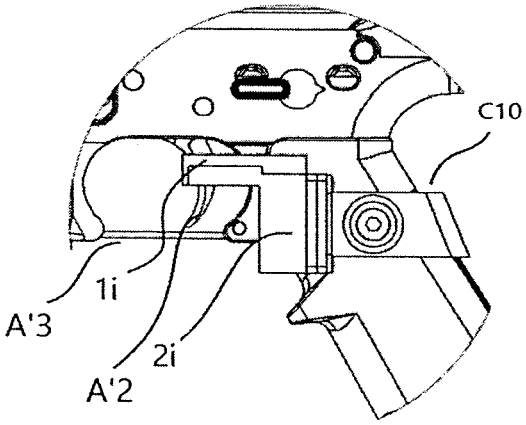
FIG 10.72

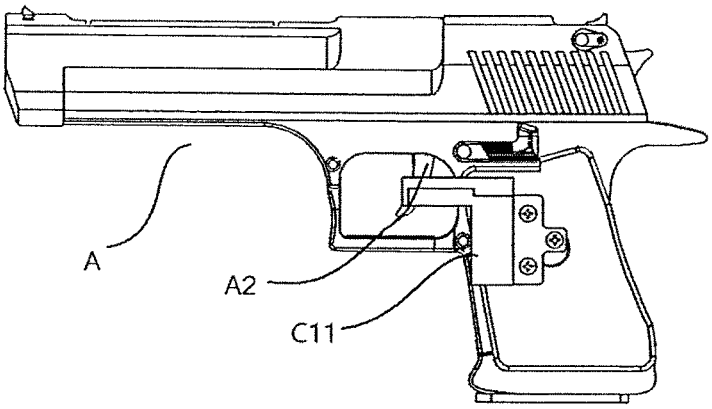
FIG 11.1
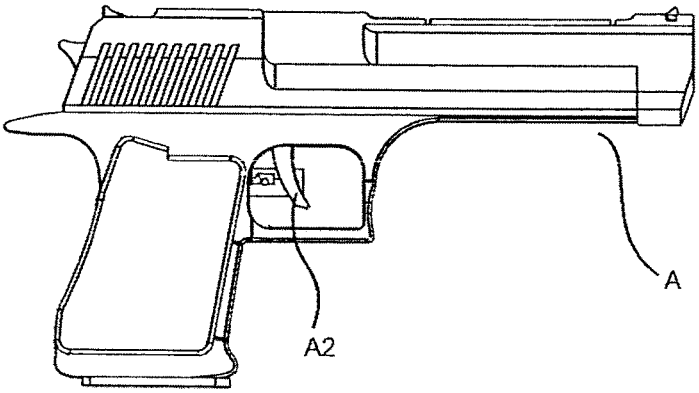
FIG 11.2
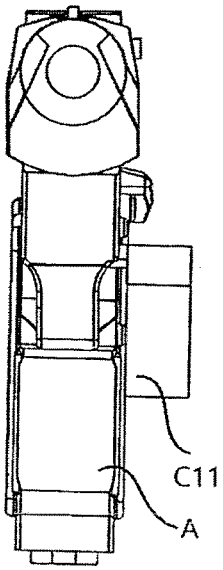
FIG 11.3

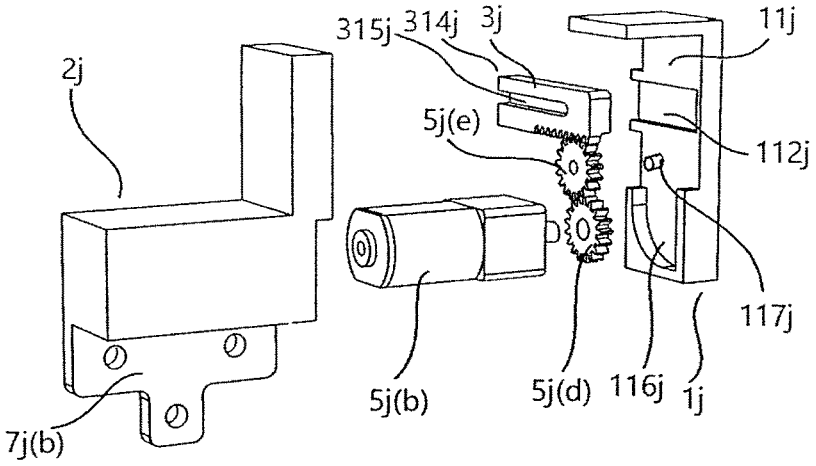
FIG 11.4
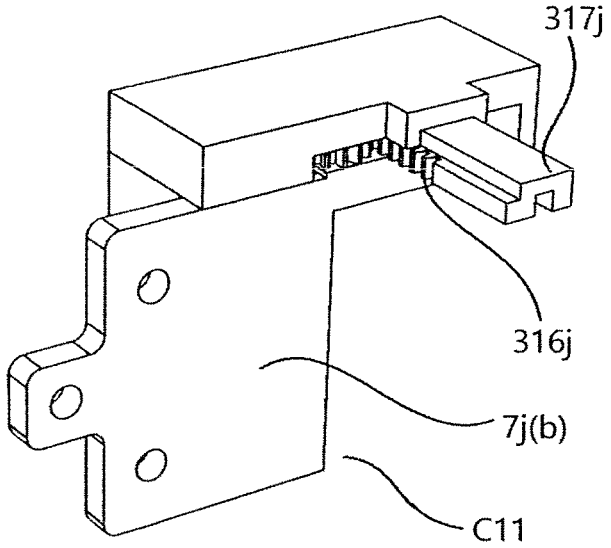
FIG 11.5
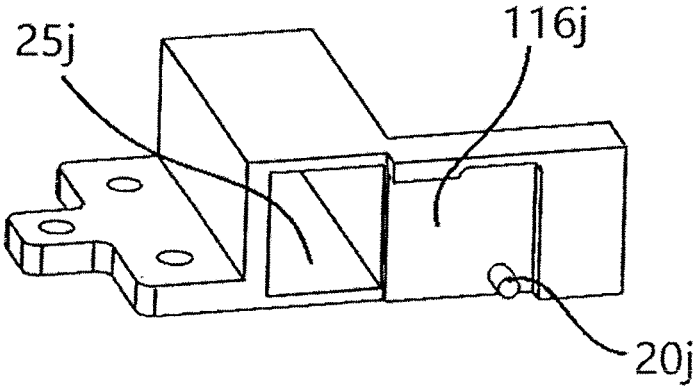
FIG 11.6

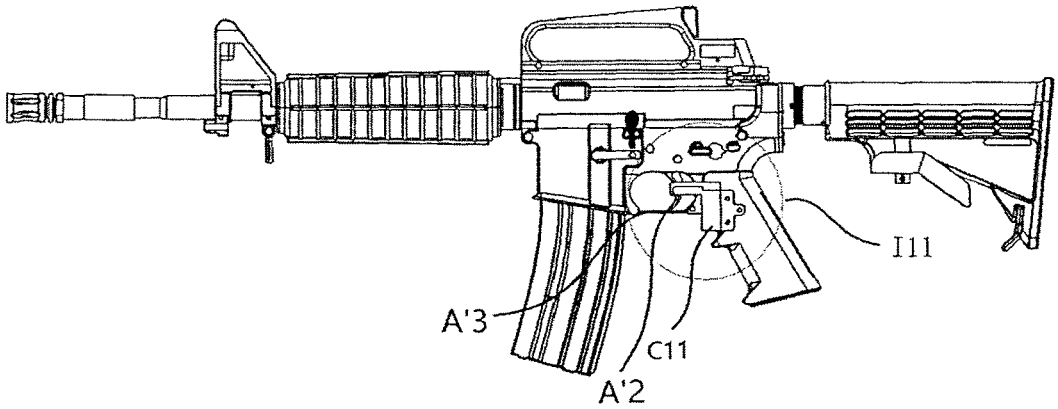
FIG 11.71
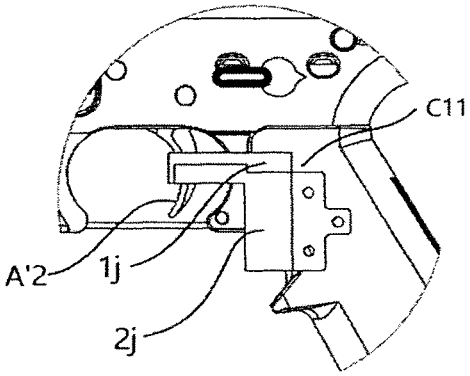
FIG 11.72
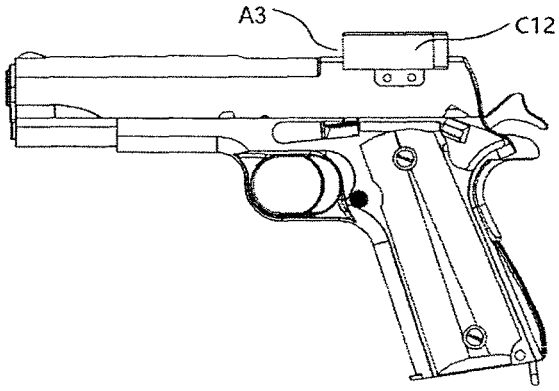
FIG 12.1

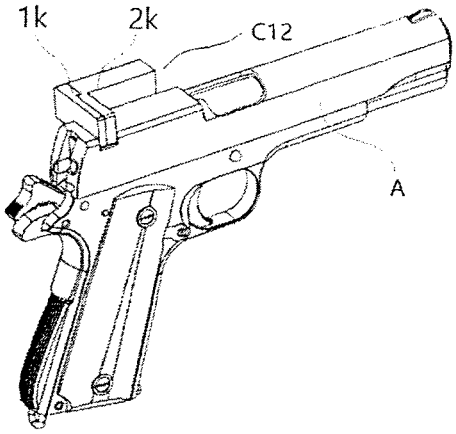
FIG 12.2
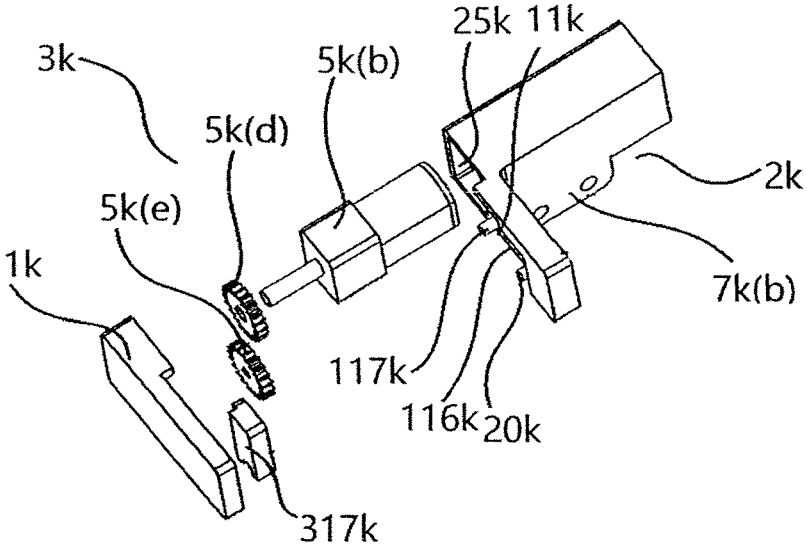
FIG 12.3
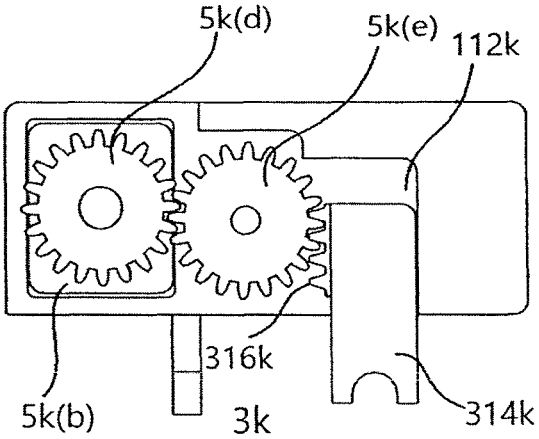
FIG 12.4

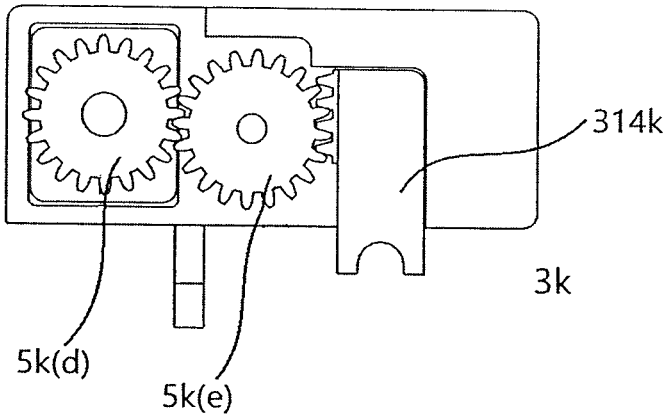
FIG 12.5
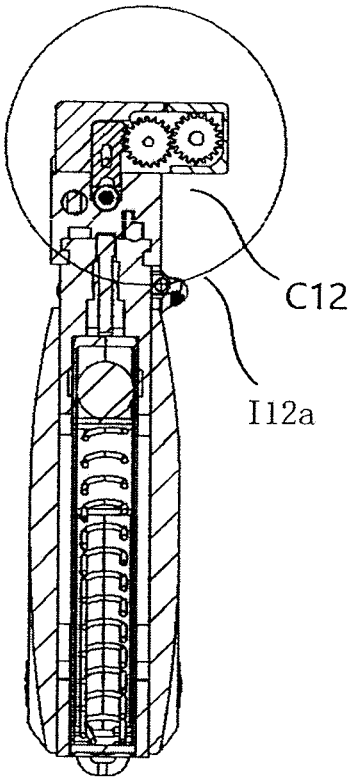
FIG 12.61
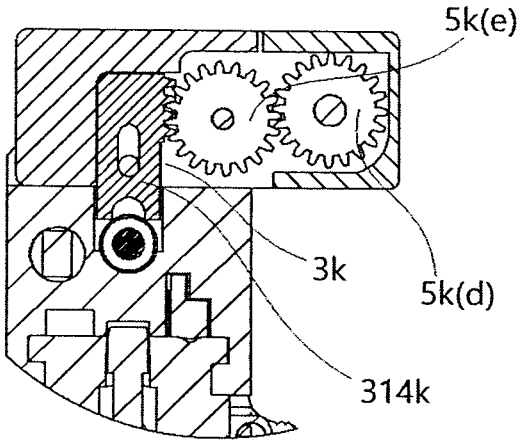
FIG 12.62

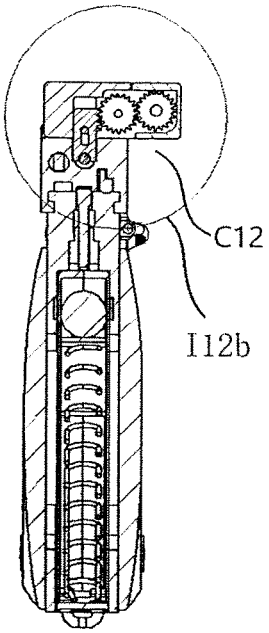
FIG 12.71
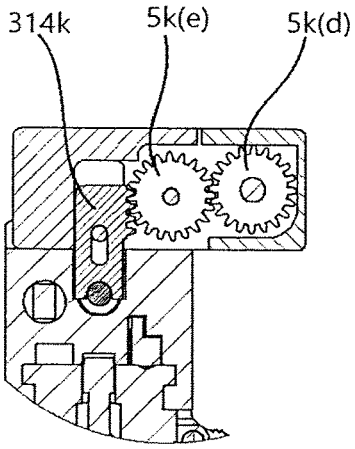
FIG 12.72
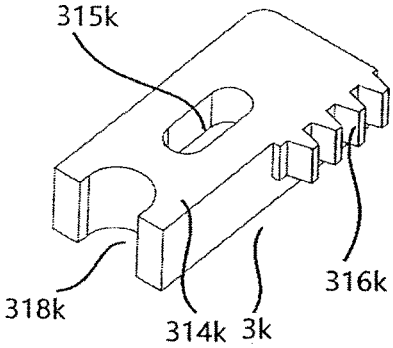
FIG 12.8
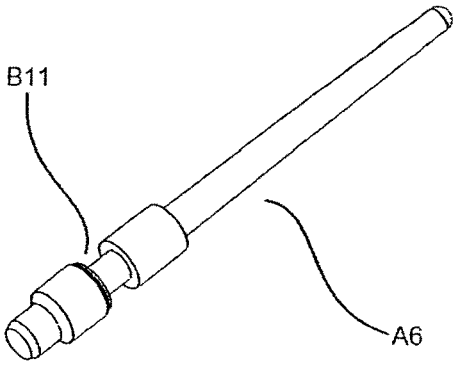
FIG 12.9

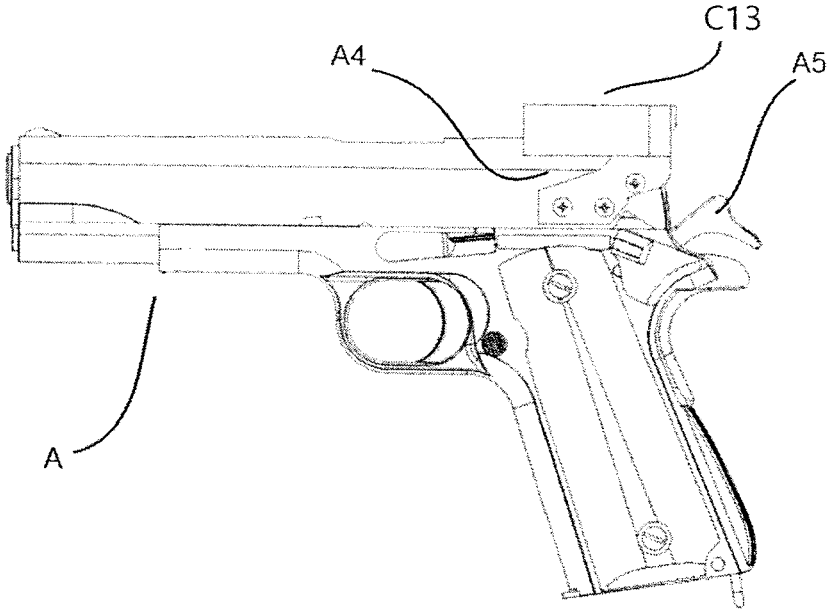
FIG 13.1
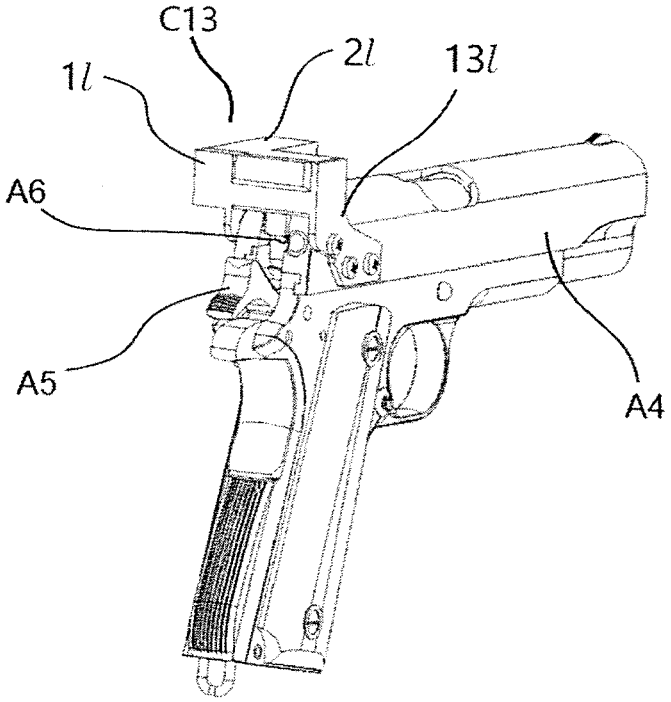
FIG 13.2

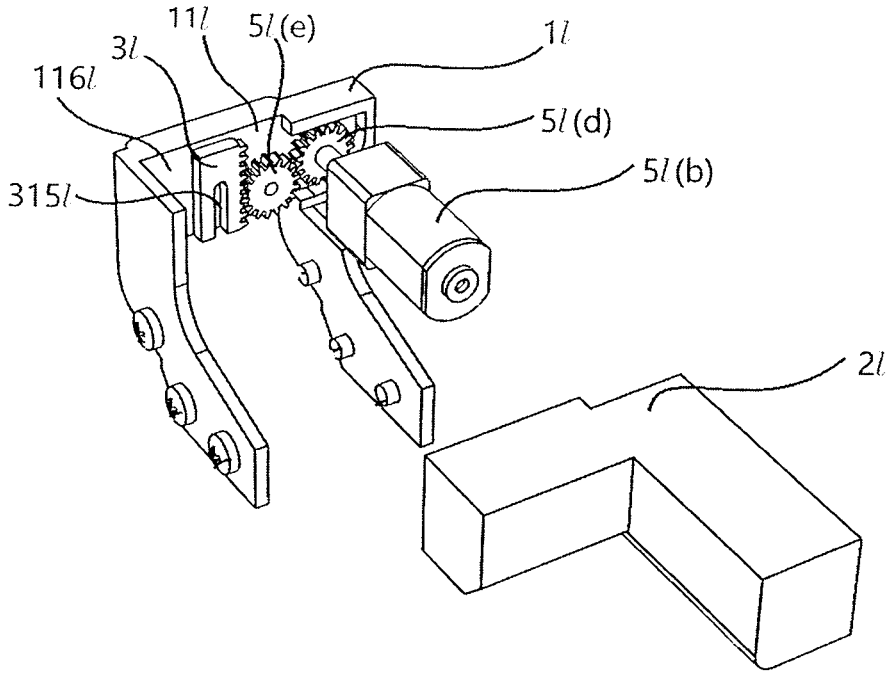
FIG 13.31
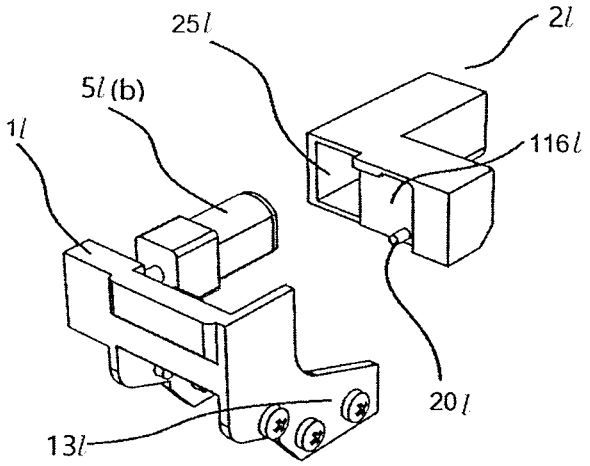
FIG 13.32

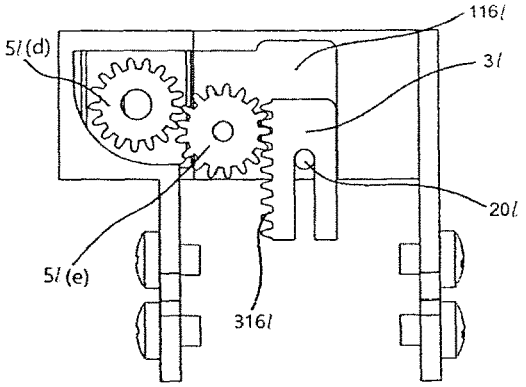
FIG 13.41
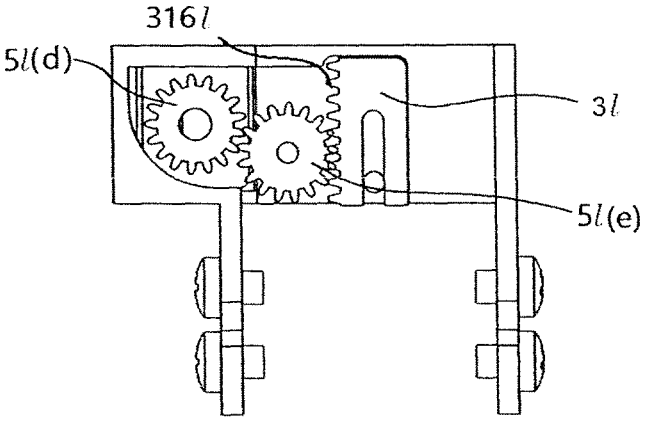
FIG 13.42
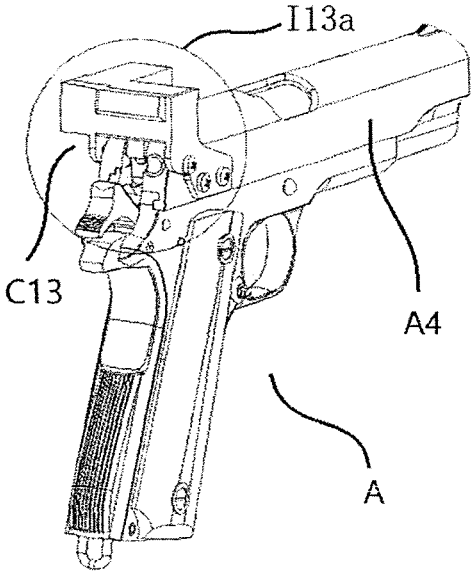
FIG 13.51

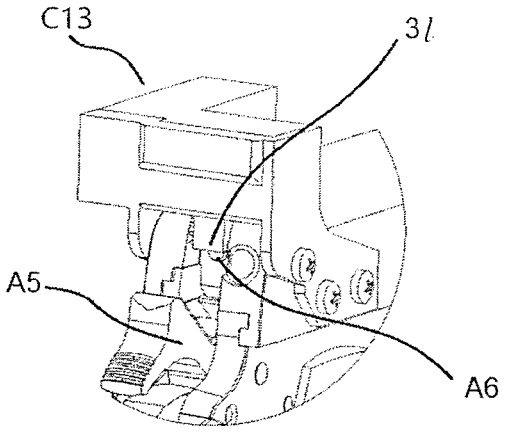
FIG 13.52
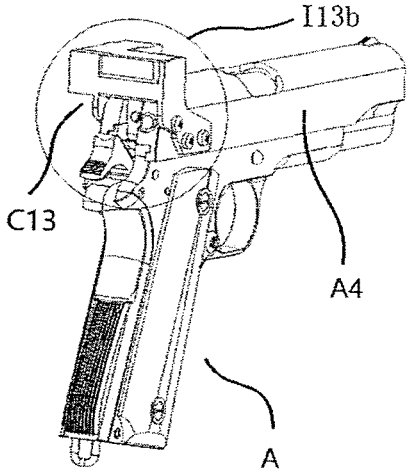
FIG 13.61
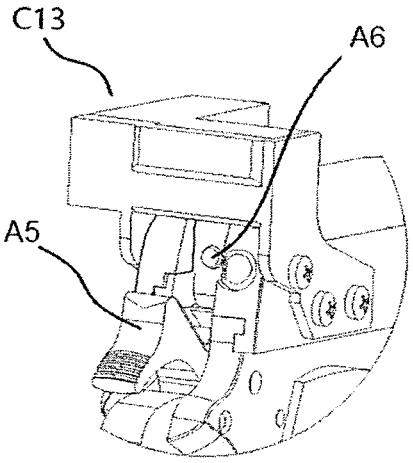
FIG 13.62

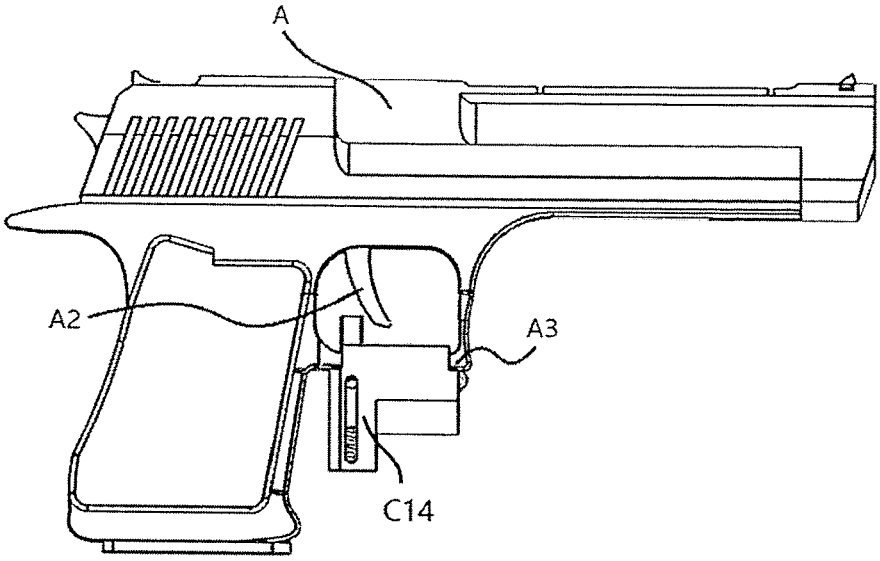
FIG 14.1
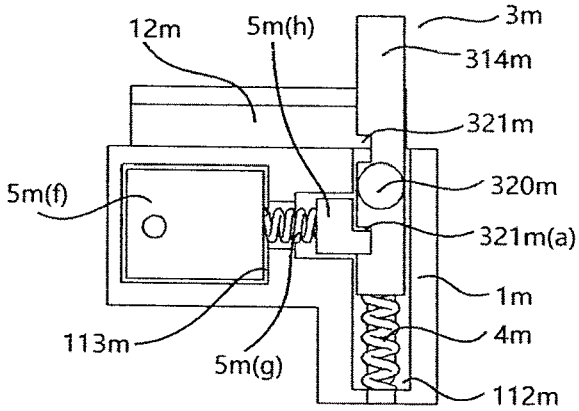
FIG 14.21
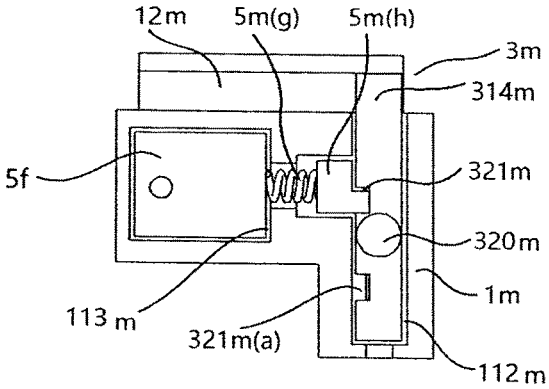
FIG 14.22

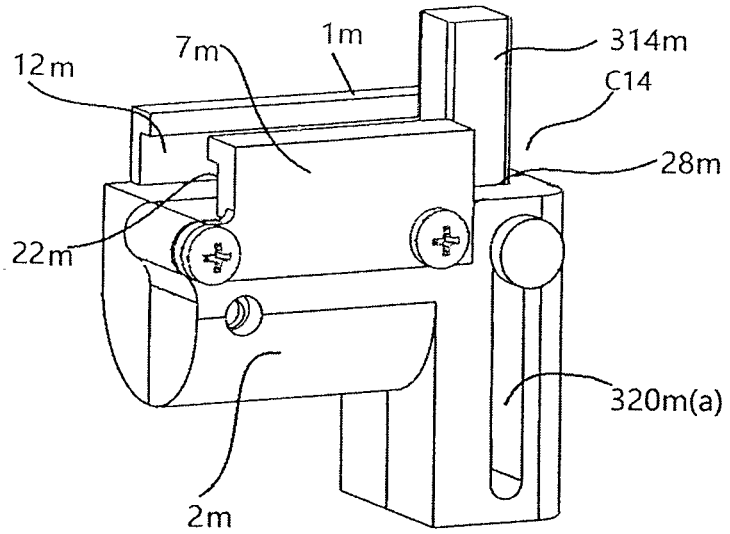
FIG 14.3
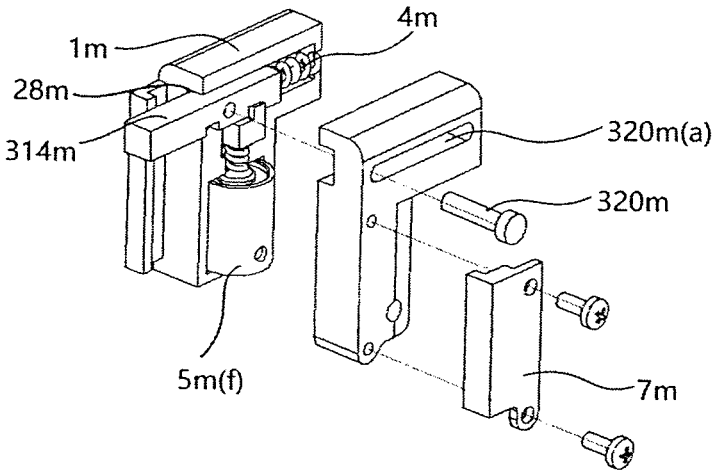
FIG 14.4
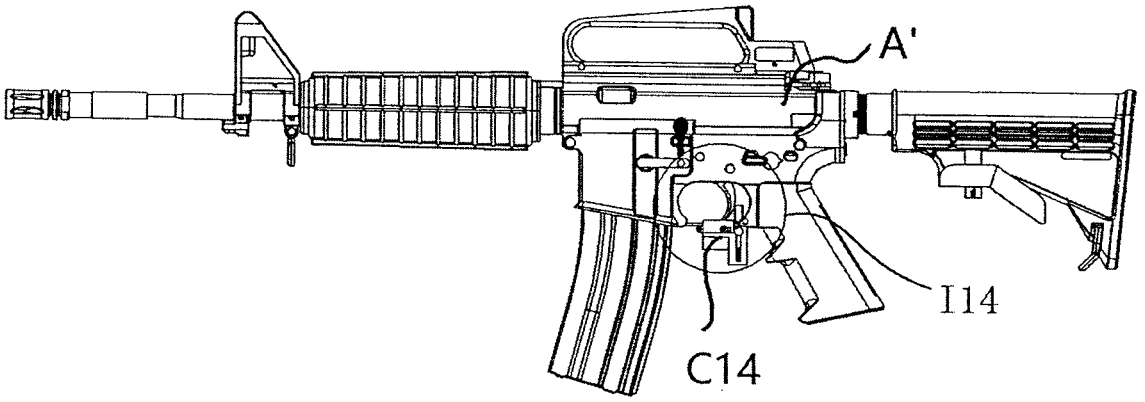
FIG 14.51

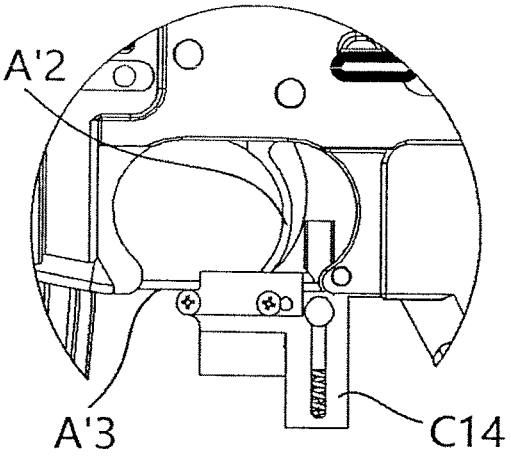
FIG 14.52
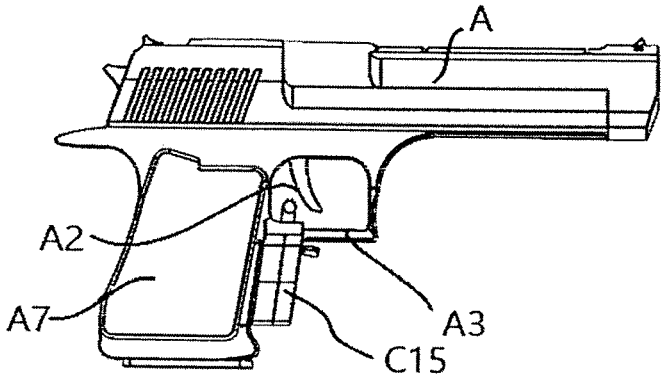
FIG 15.1
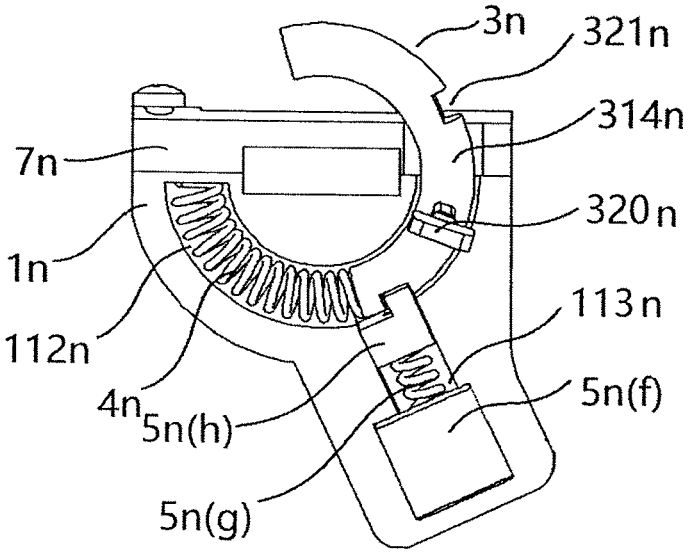
FIG 15.21

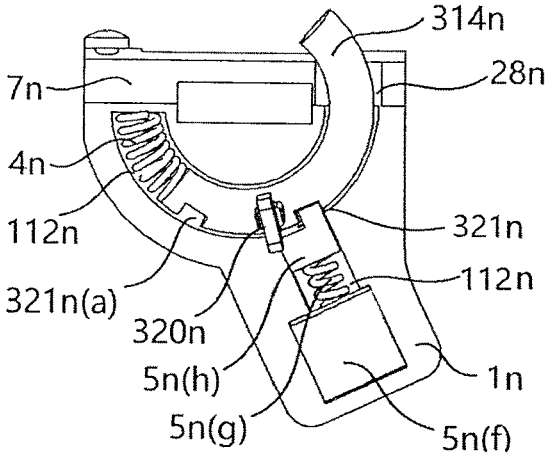
FIG 15.22
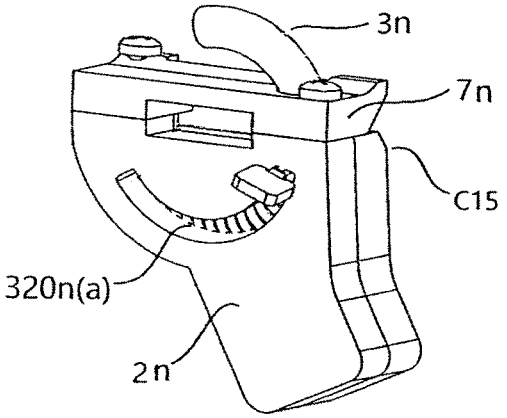
FIG 15.3
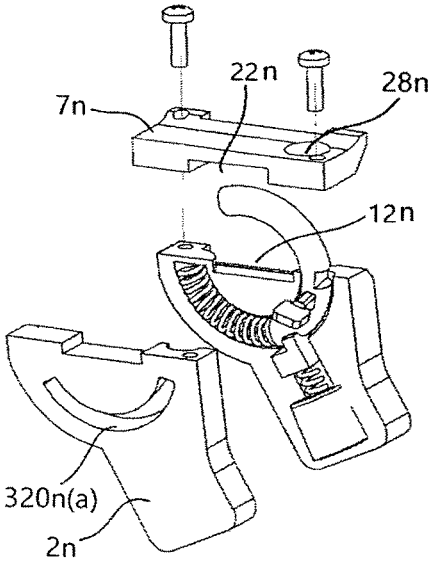
FIG 15.4

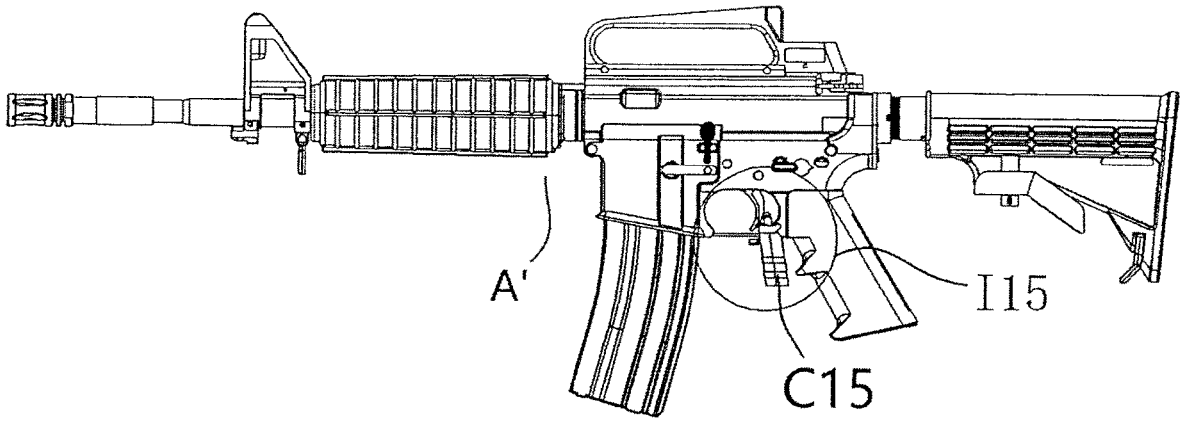
FIG 15.51
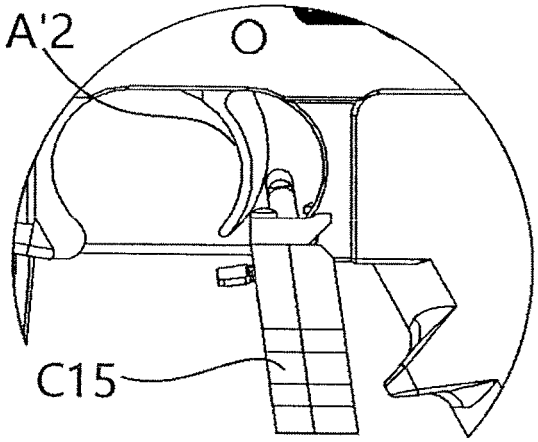
FIG 15.52
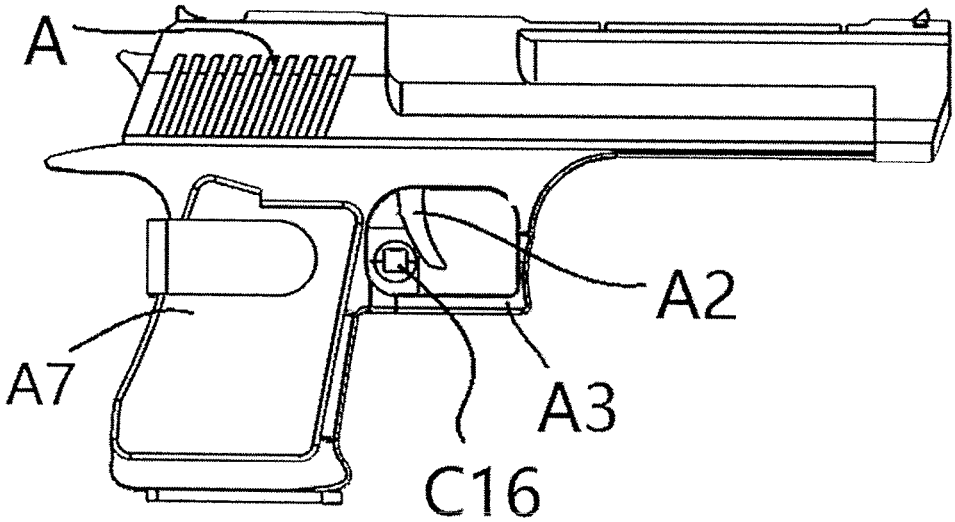
FIG 16.1

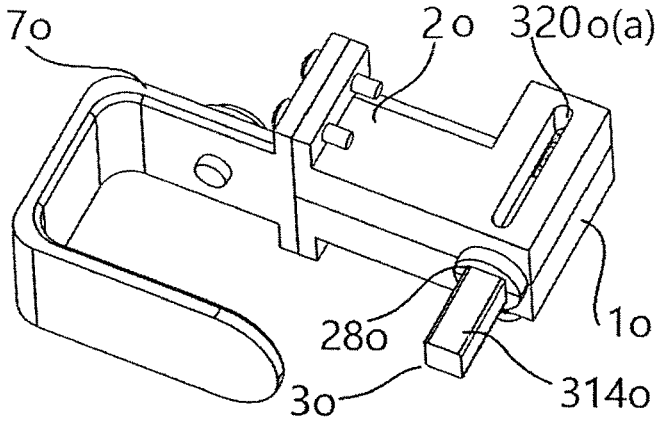
FIG 16.2
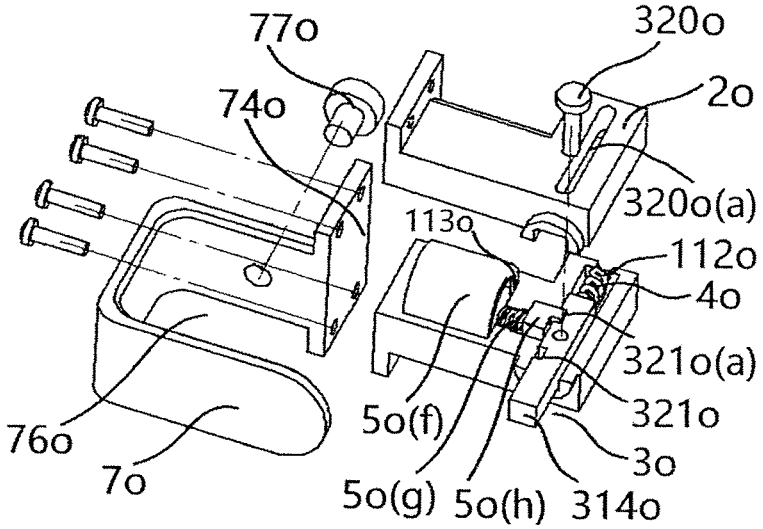
FIG 16.3
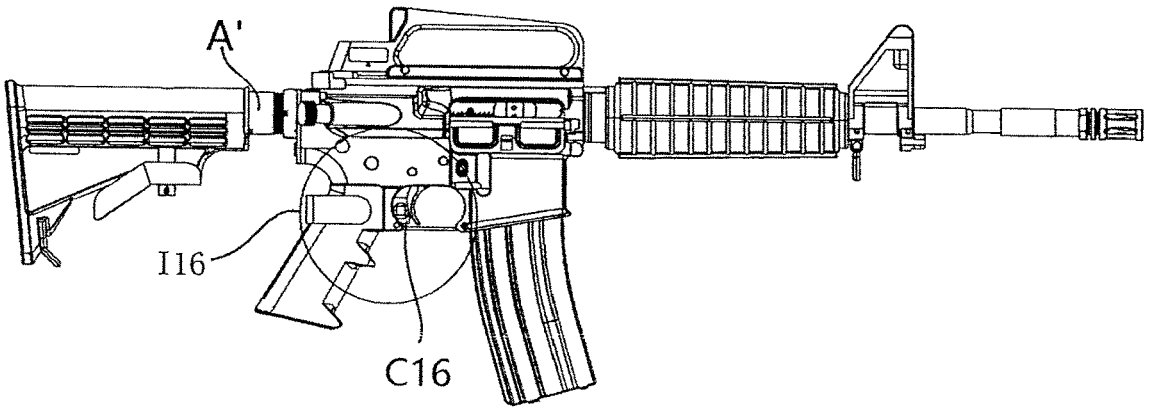
FIG 16.41

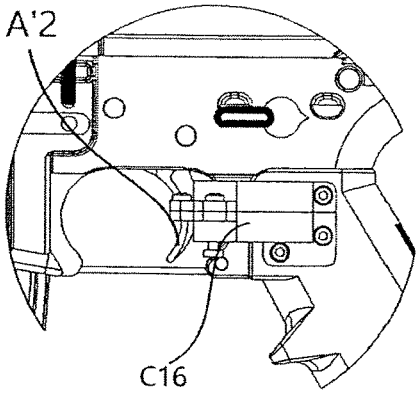
FIG 16.42
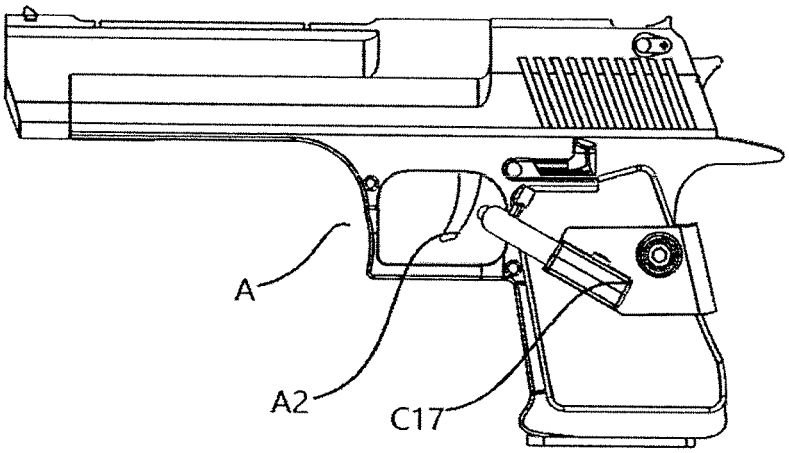
FIG 17.1
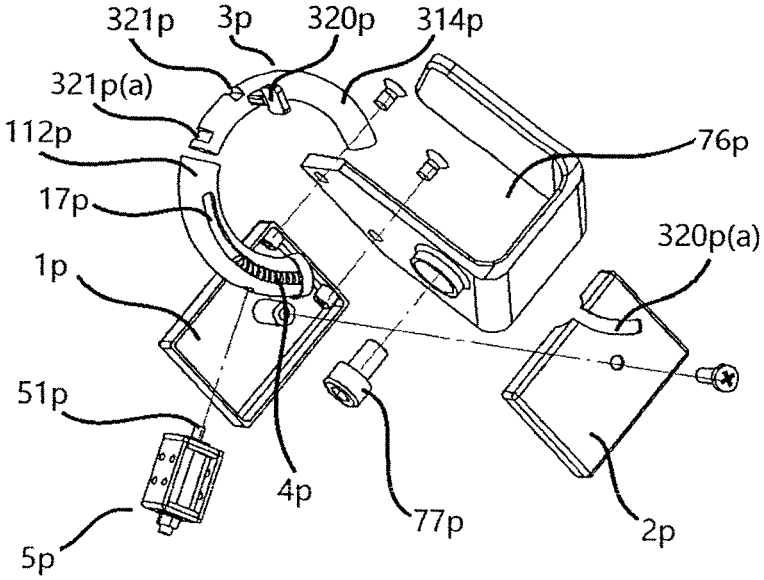
FIG 17.2

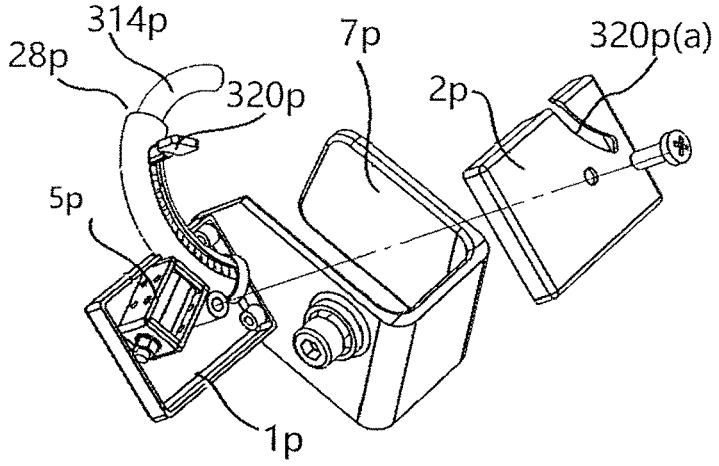
FIG 17.3
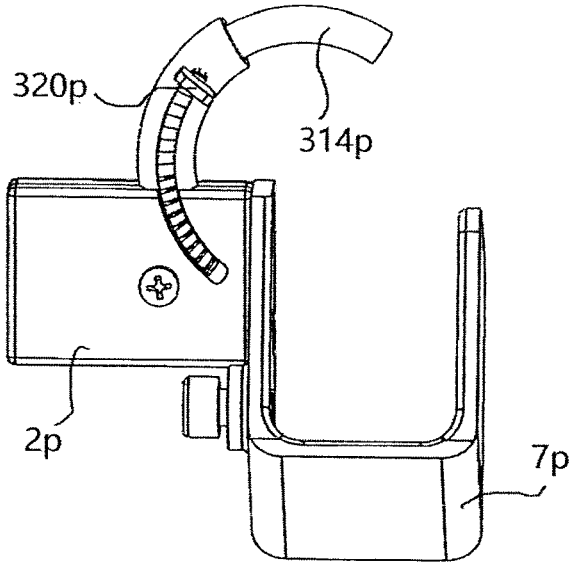
FIG 17.4
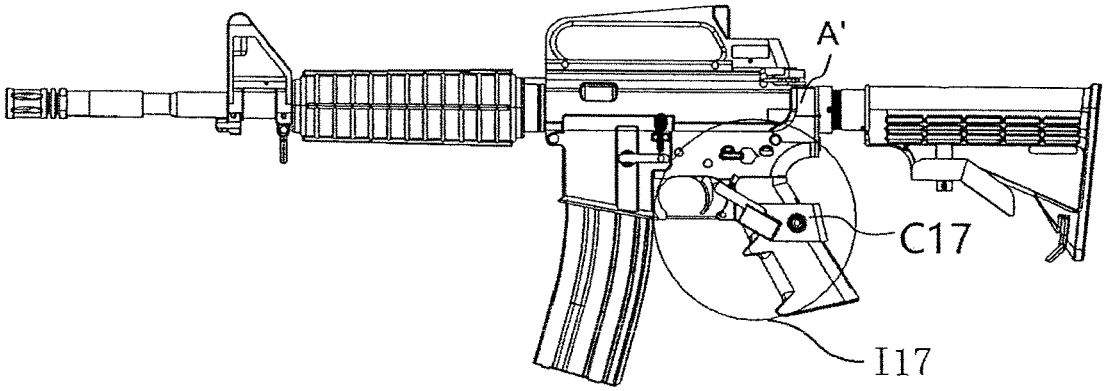
FIG 17.51

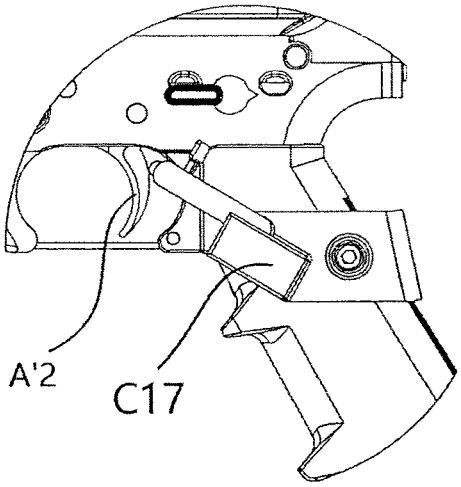
FIG 17.52
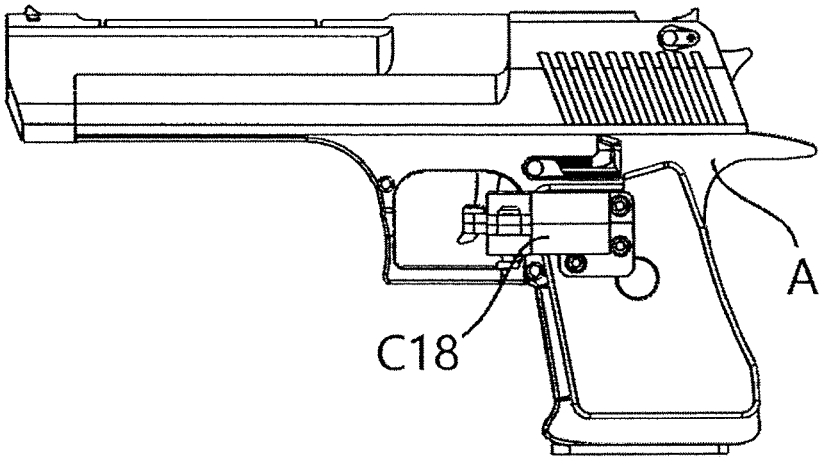
FIG 18.1
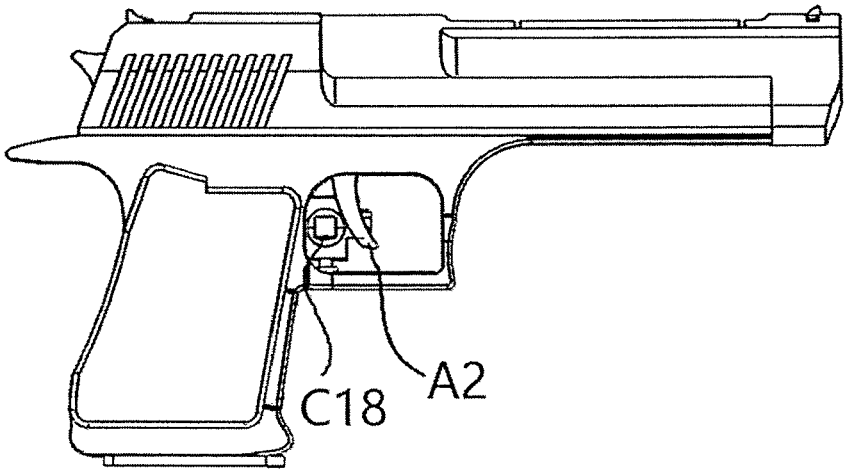
FIG 18.2

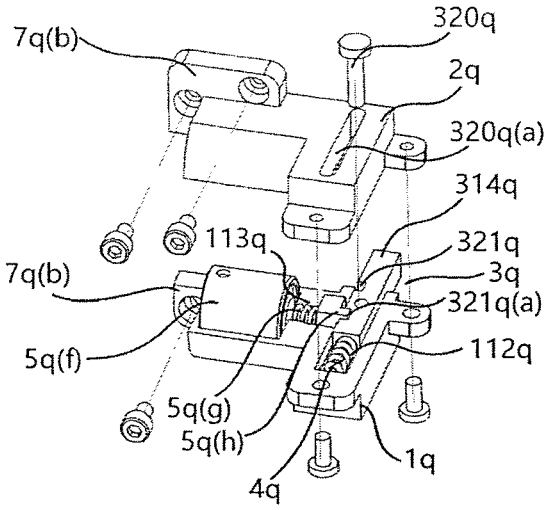
FIG 18.3
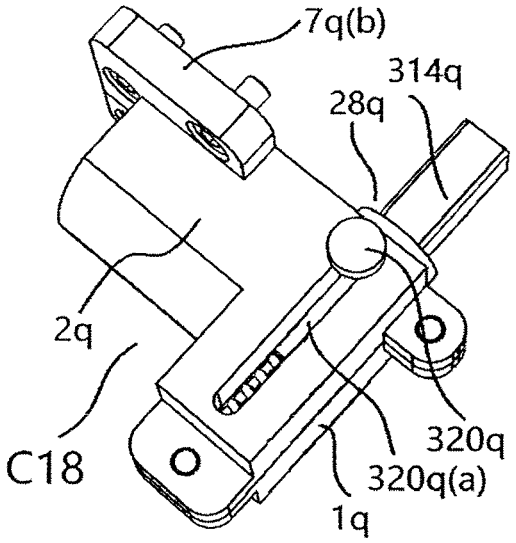
FIG 18.4
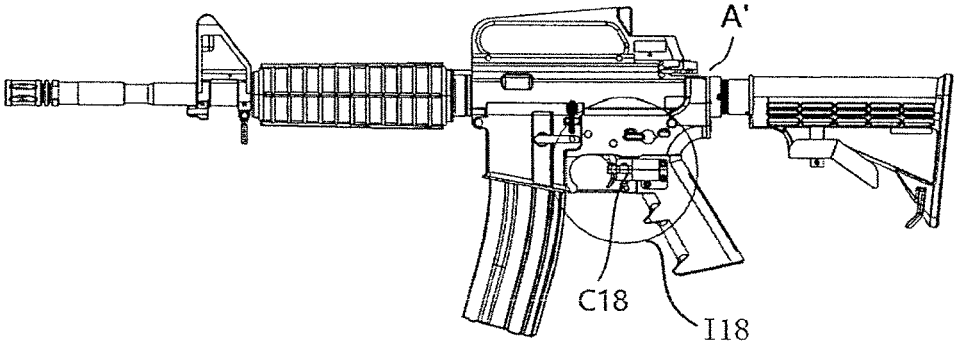
FIG 18.51

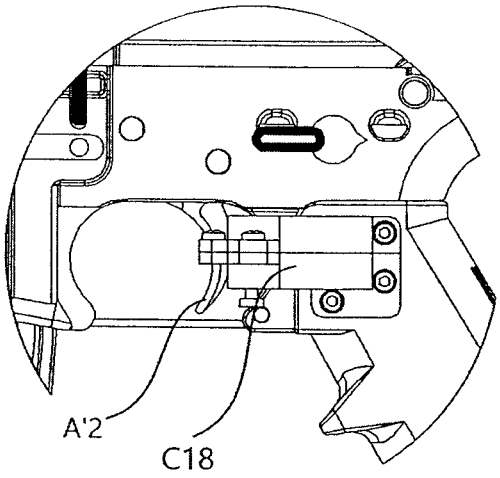
FIG 18.52
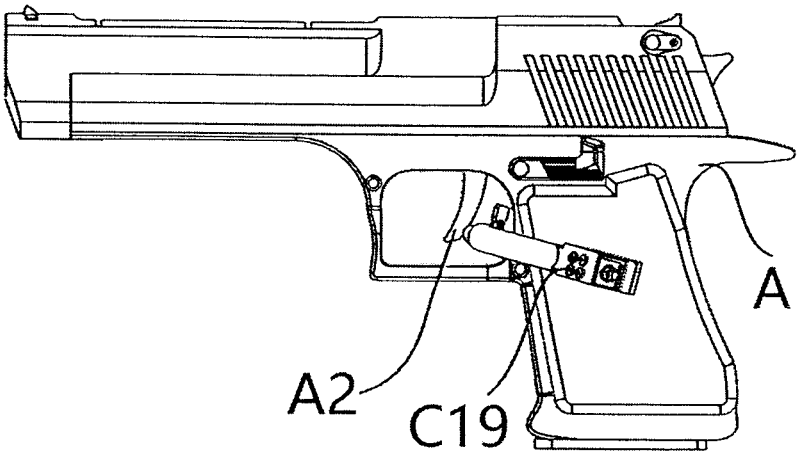
FIG 19.1
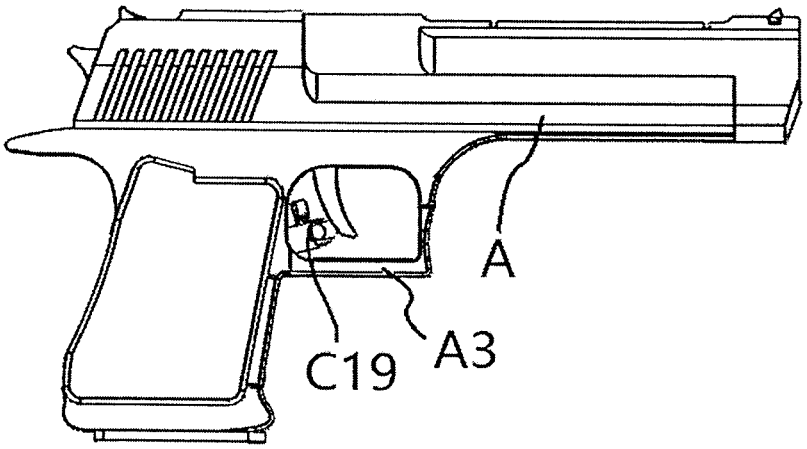
FIG 19.2

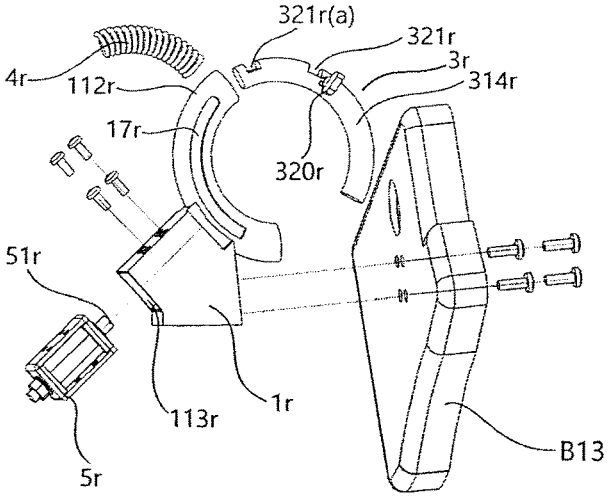
FIG 19.3
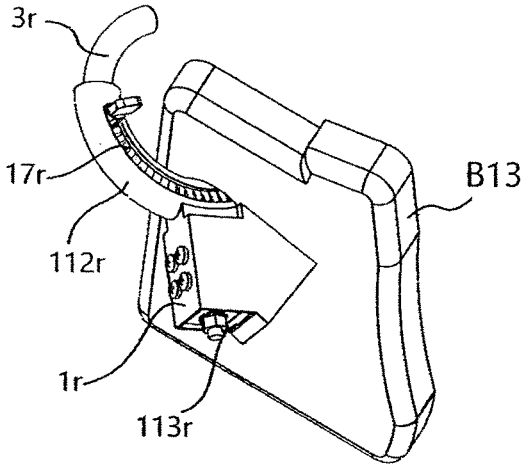
FIG 19.4
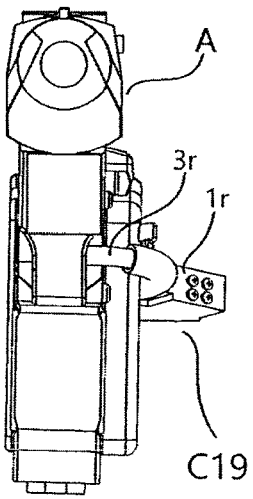
FIG 19.5

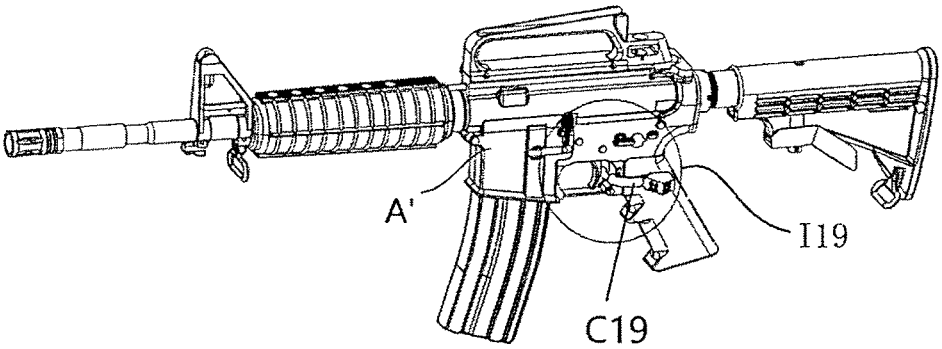
FIG 19.61
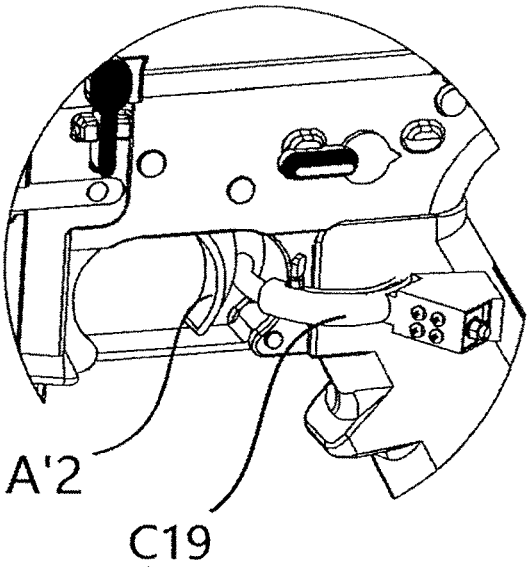
FIG 19.62
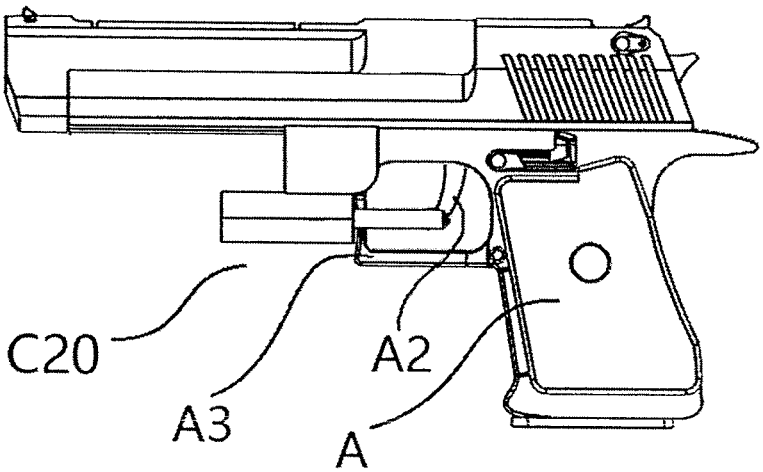
FIG 20.1

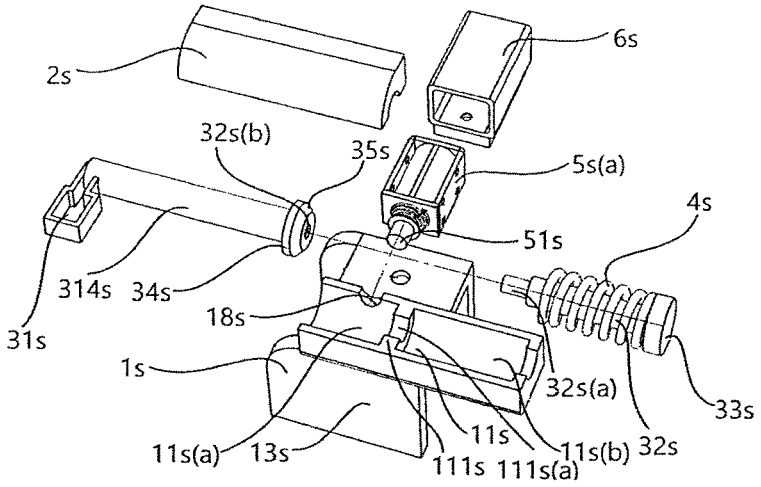
FIG 20.2
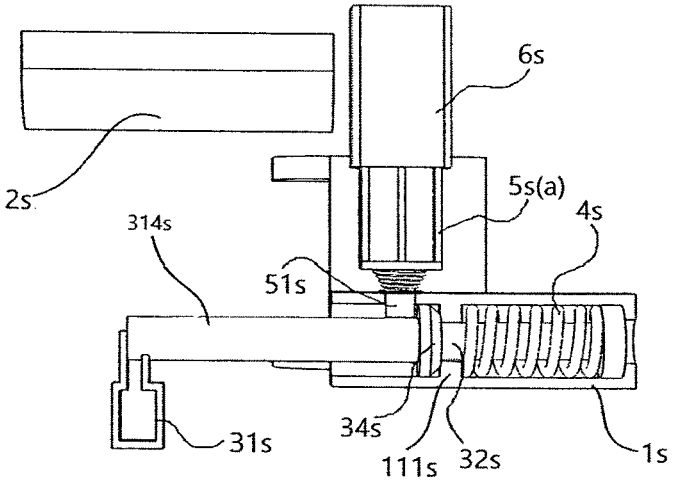
FIG 20.3
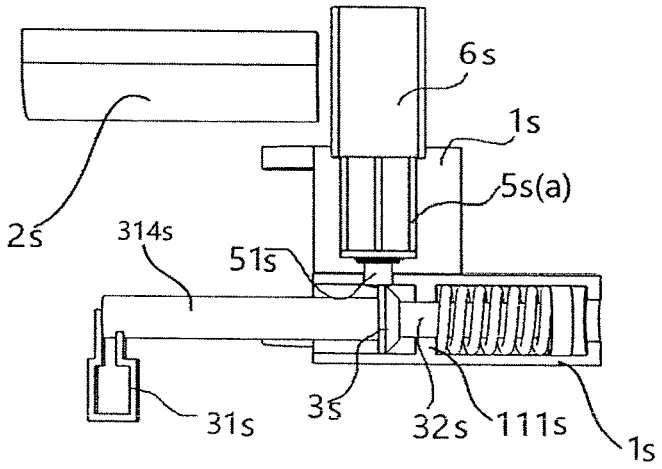
FIG 20.4

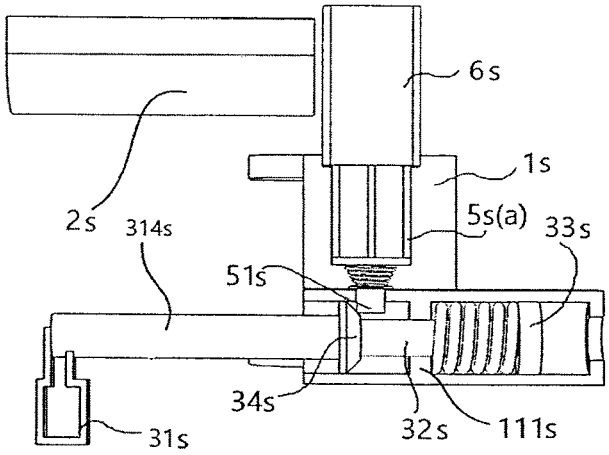
FIG 20.5
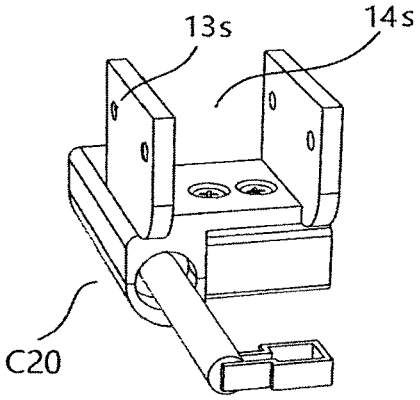
FIG 20.6
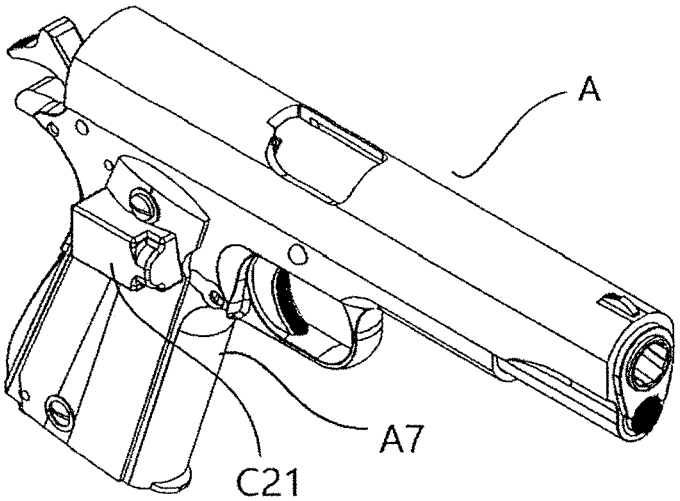
FIG 21.1

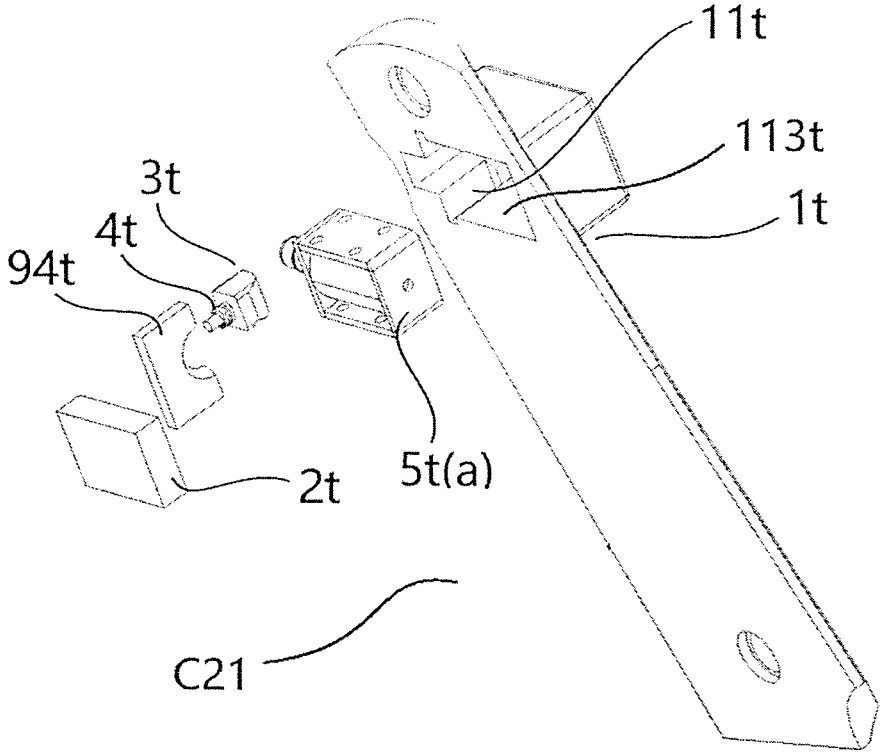
FIG 21.2
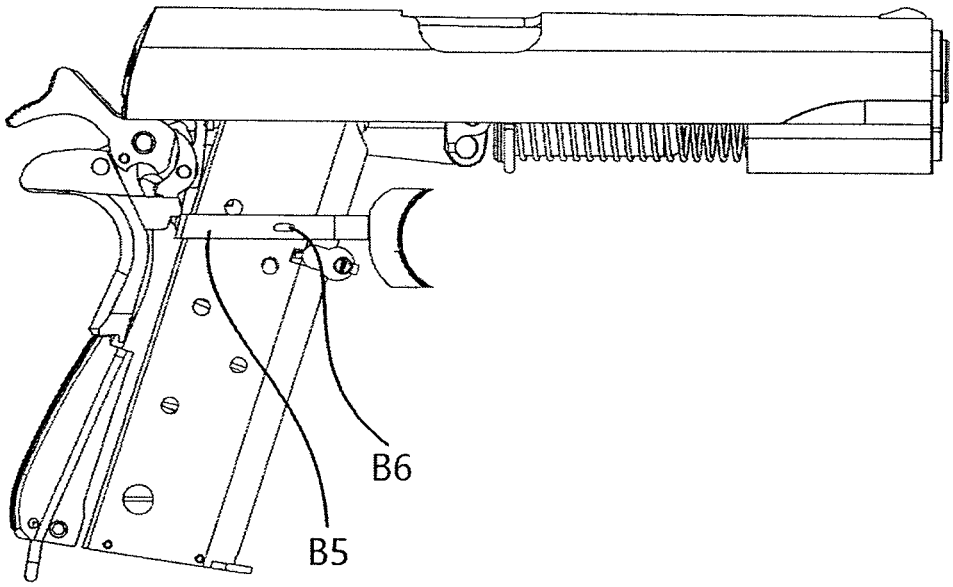
FIG 21.3

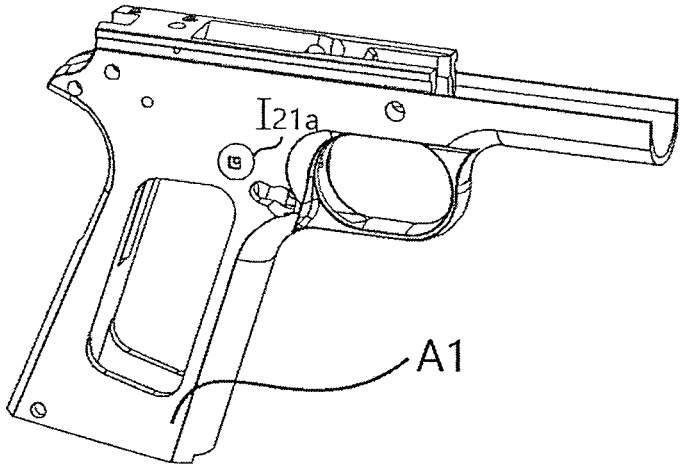
FIG 21.4
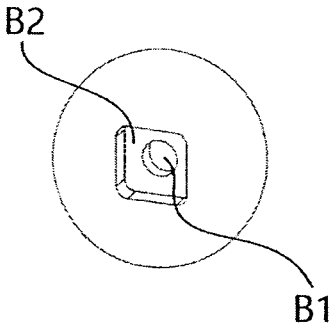
FIG 21.41
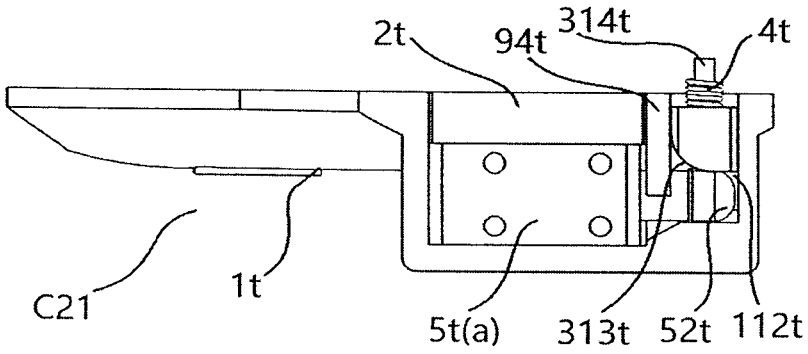
FIG 21.5

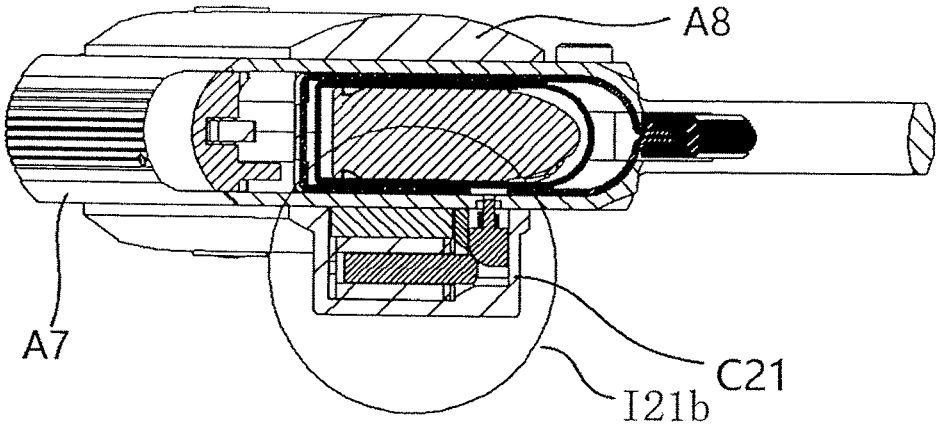
FIG 21.6
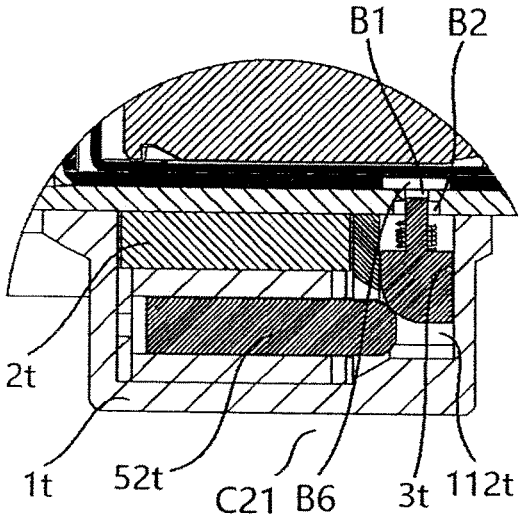
FIG 21.61
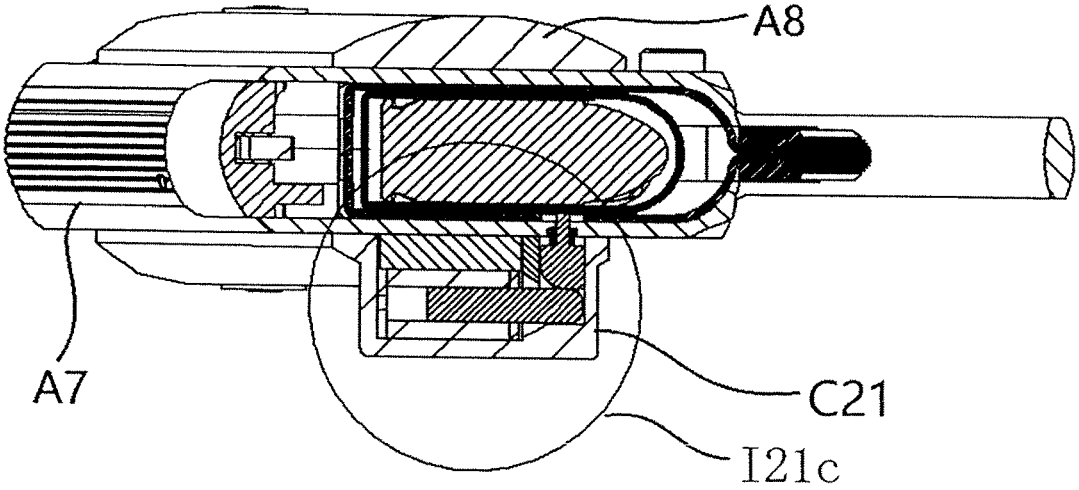
FIG 21.7

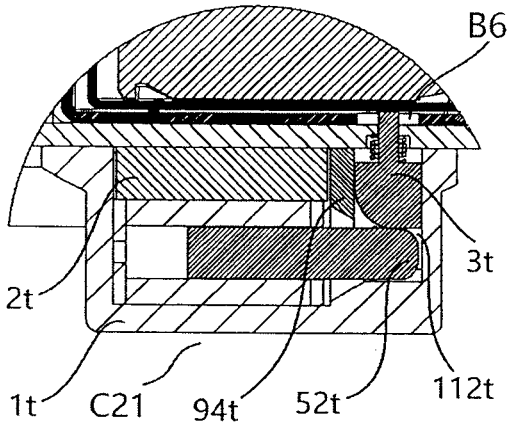
FIG 21.71
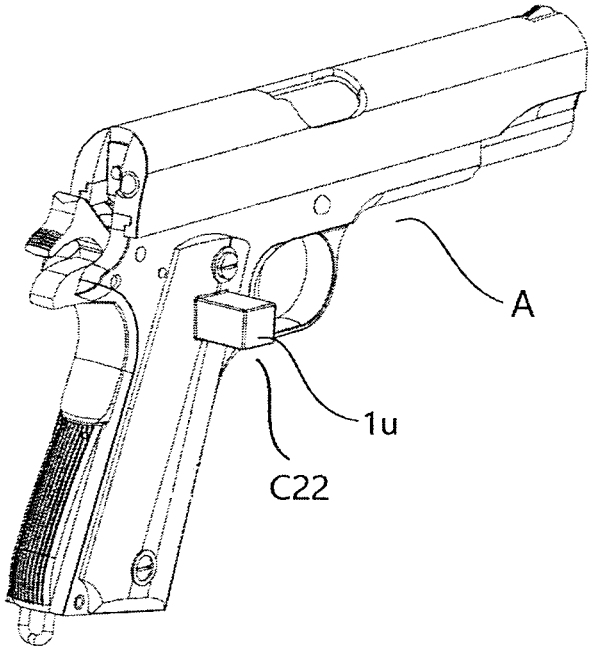
FIG 22.1

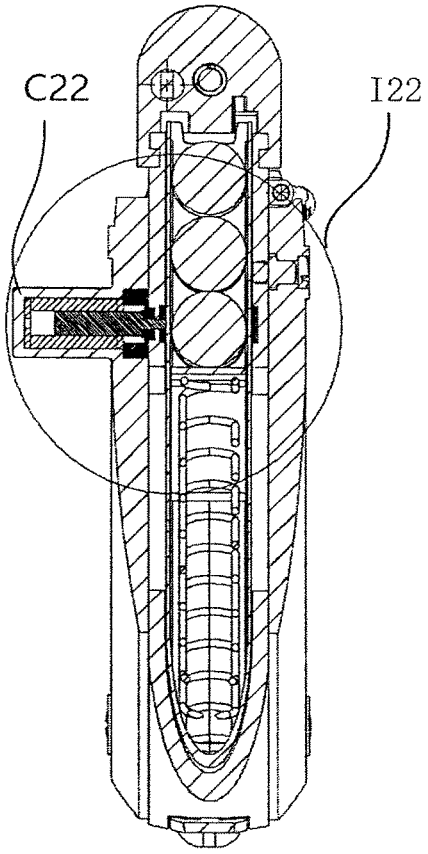
FIG 22.2
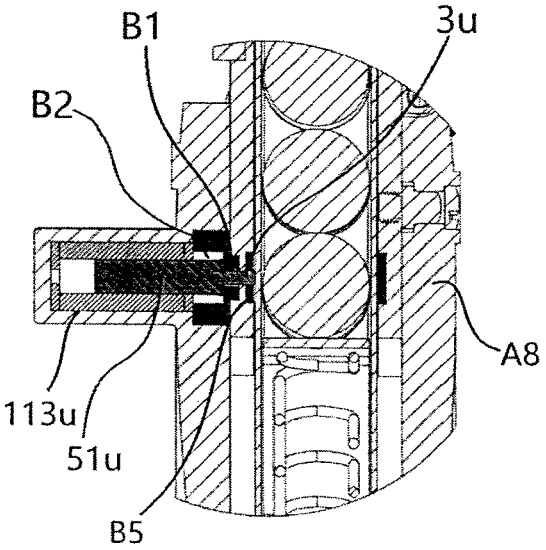
FIG 22.21

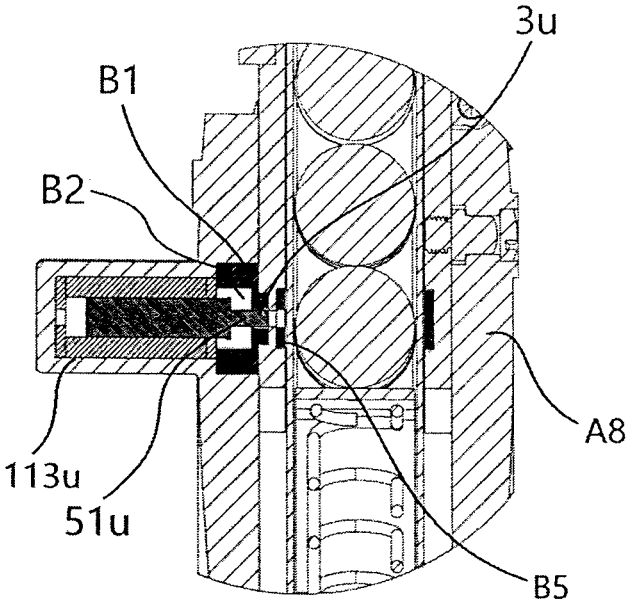
FIG 22.22
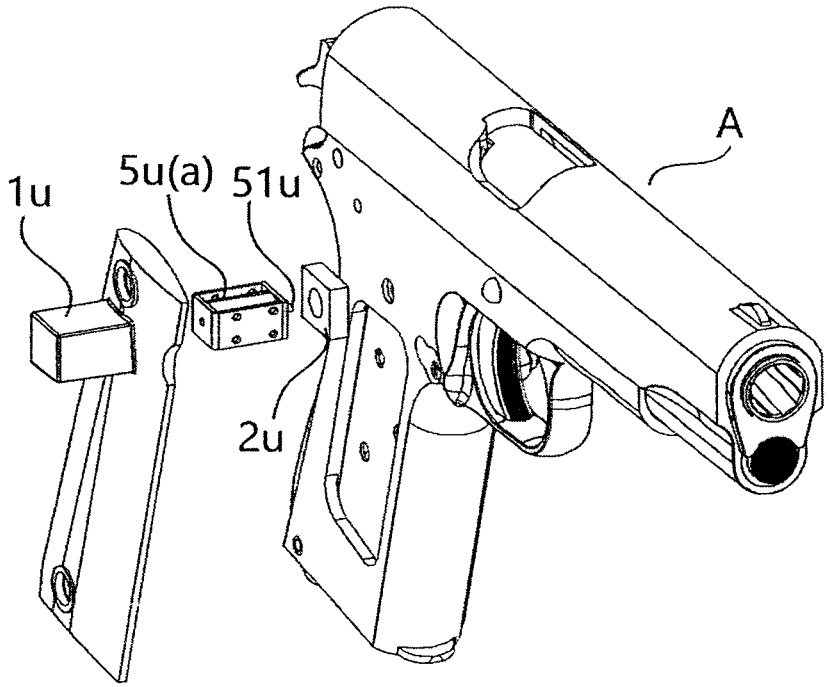
FIG 22.3

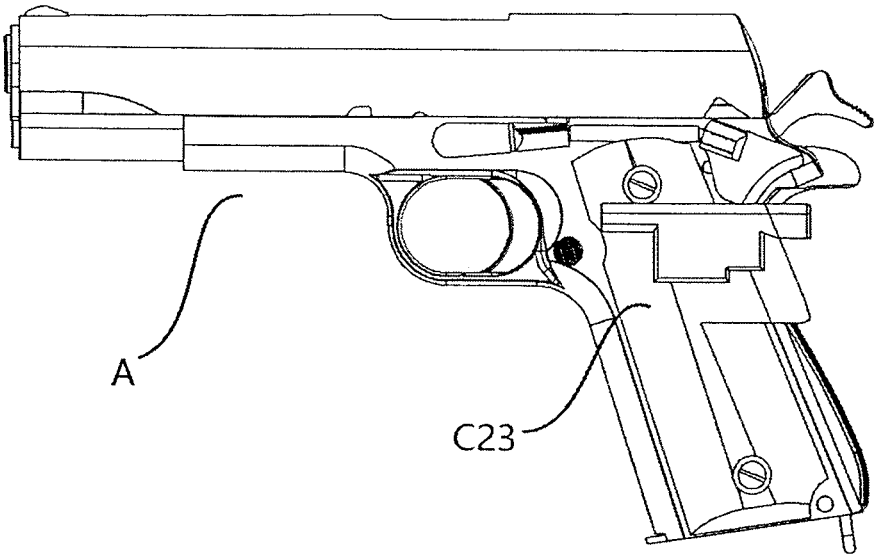
FIG 23.1
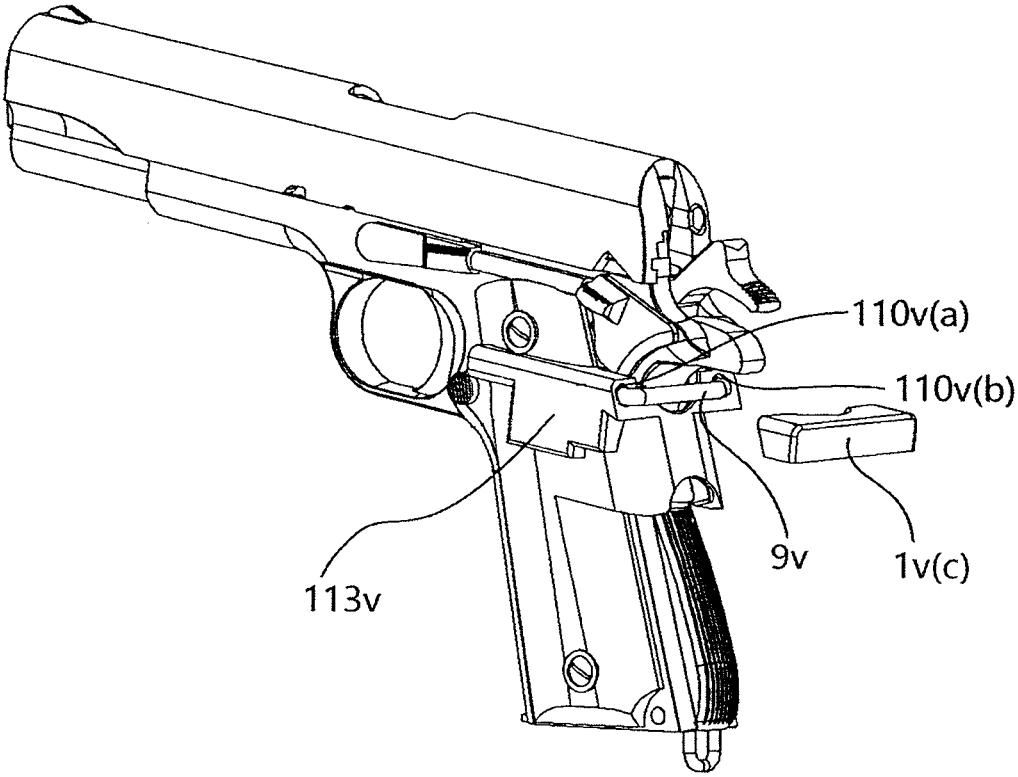
FIG 23.2

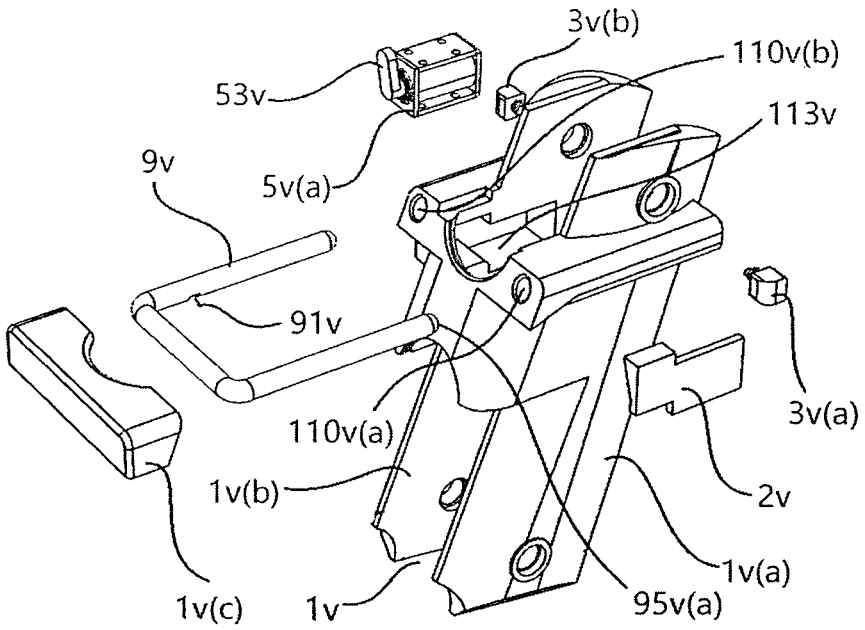
FIG 23.3
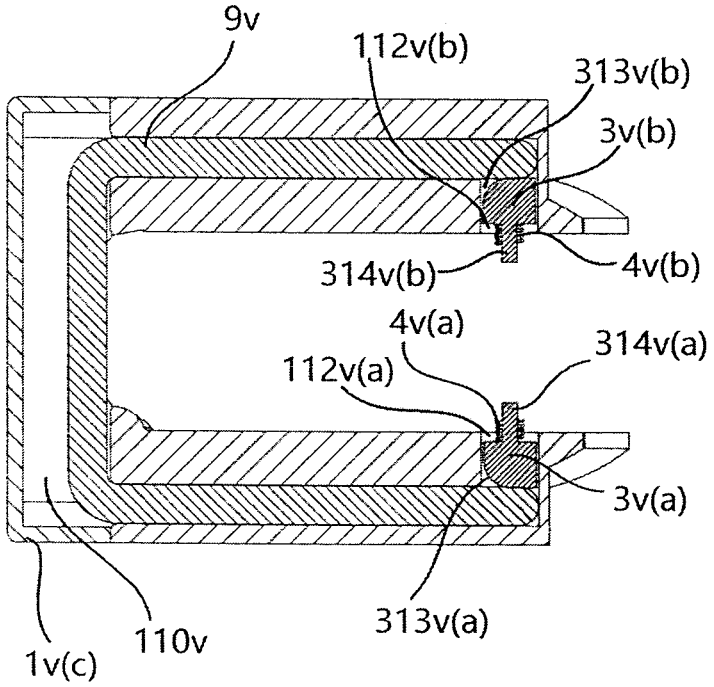
FIG 23.4

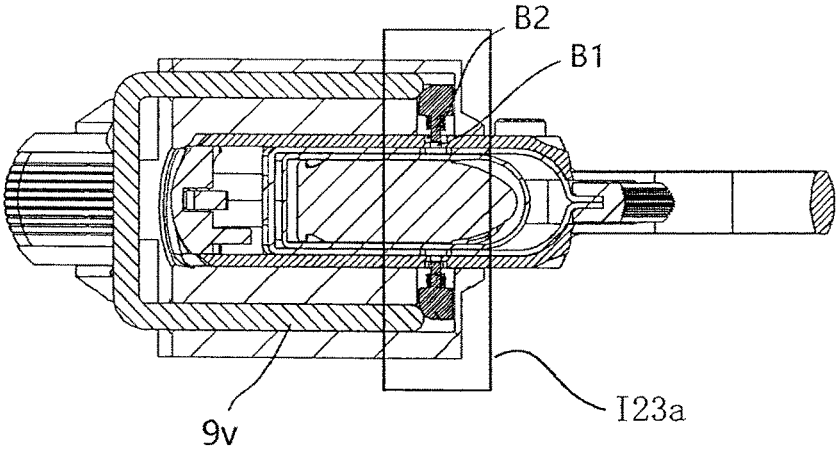
FIG 23.5
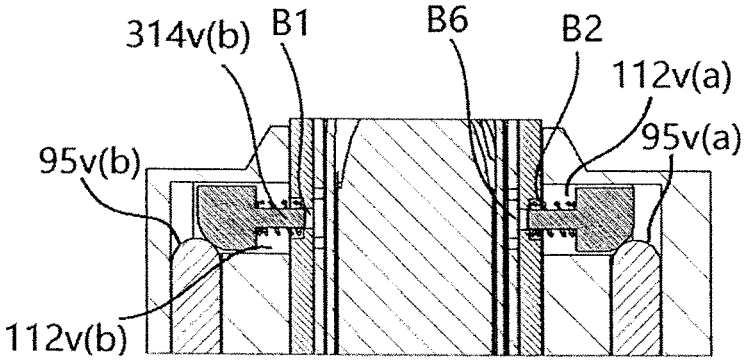
FIG 23.51
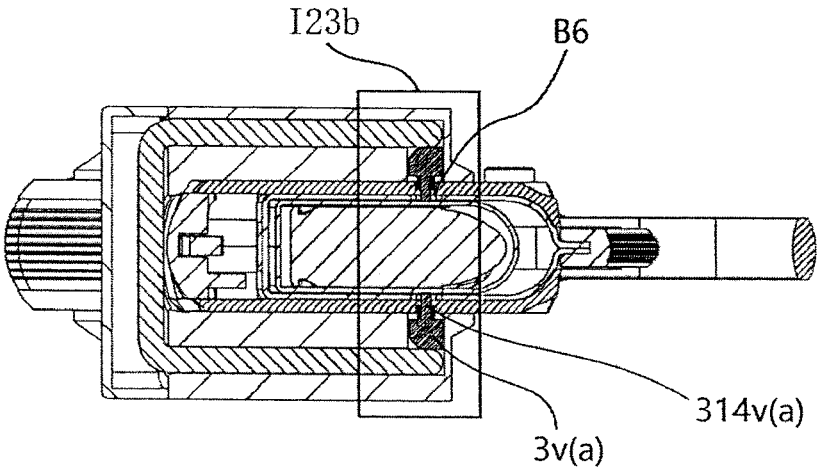
FIG 23.6

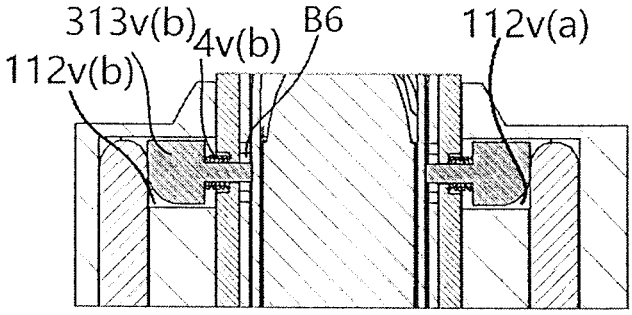
FIG 23.61
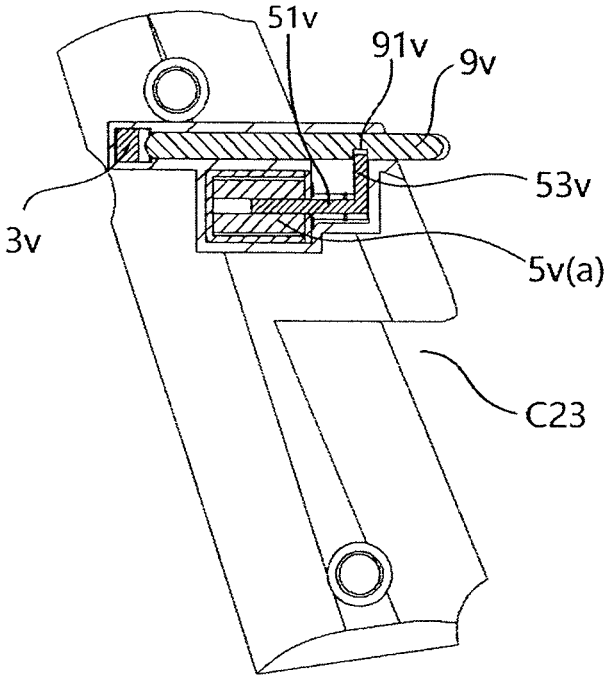
FIG 23.7

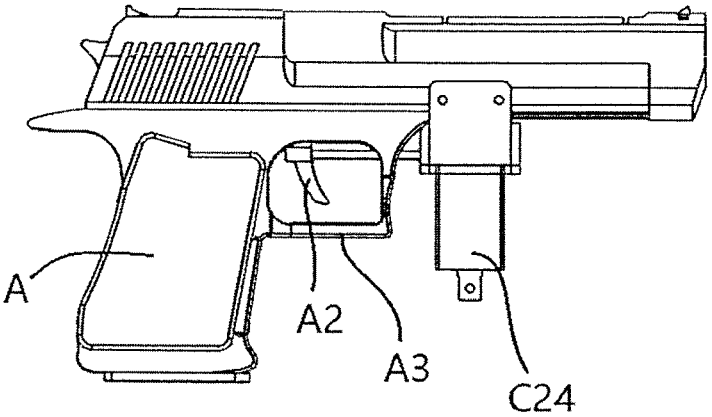
FIG 24.1
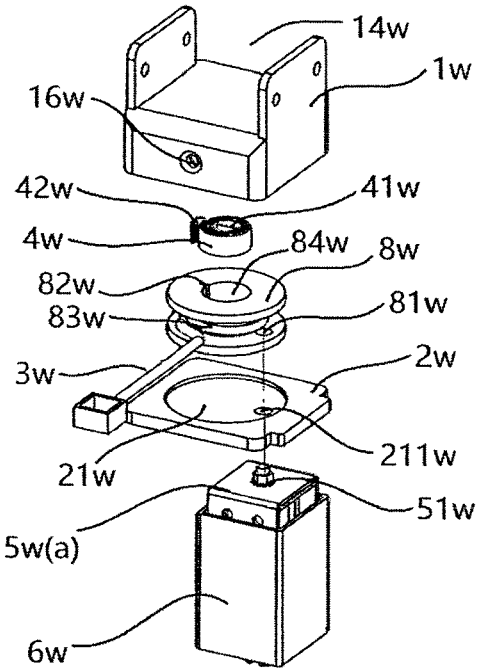
FIG 24.2
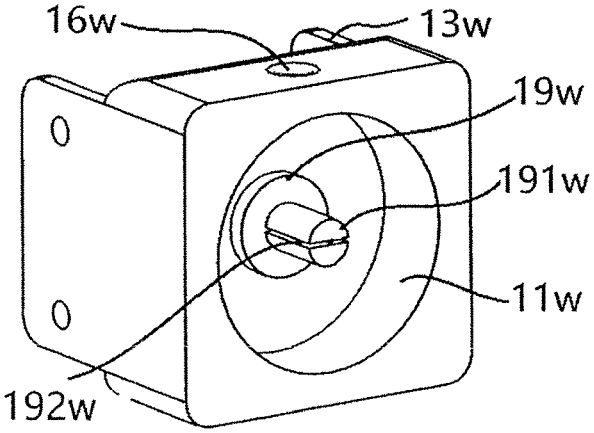
FIG 24.3

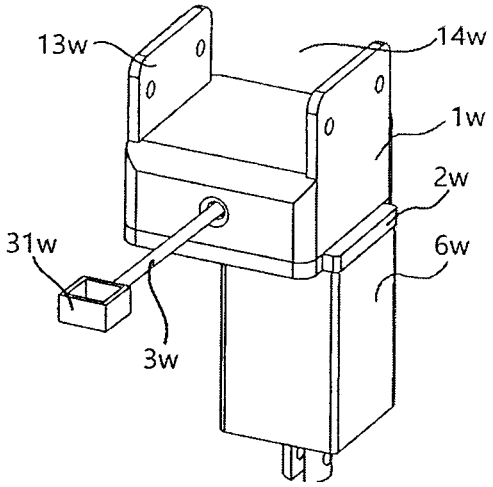
FIG 24.4
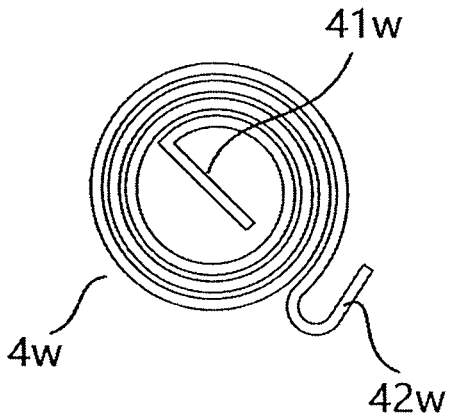
FIG 24.5
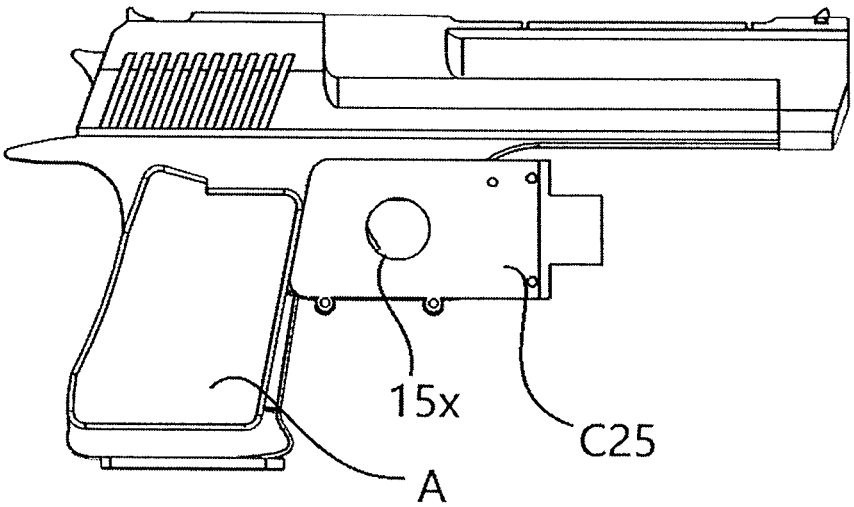
FIG 25.1

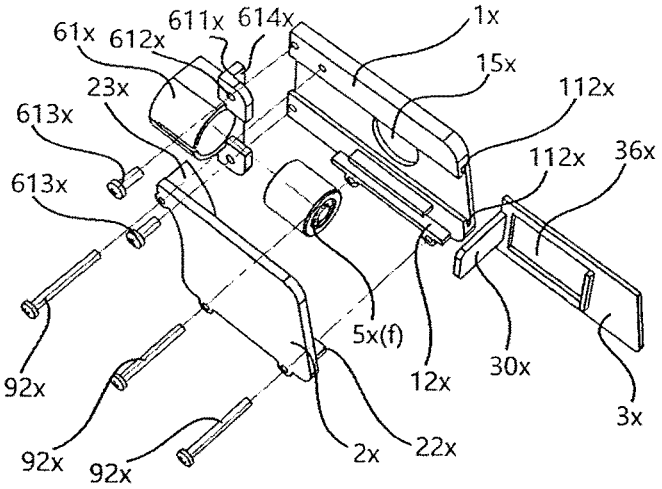
FIG 25.2
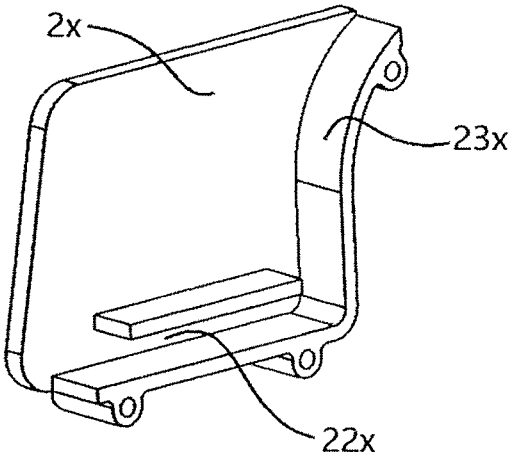
FIG 25.3
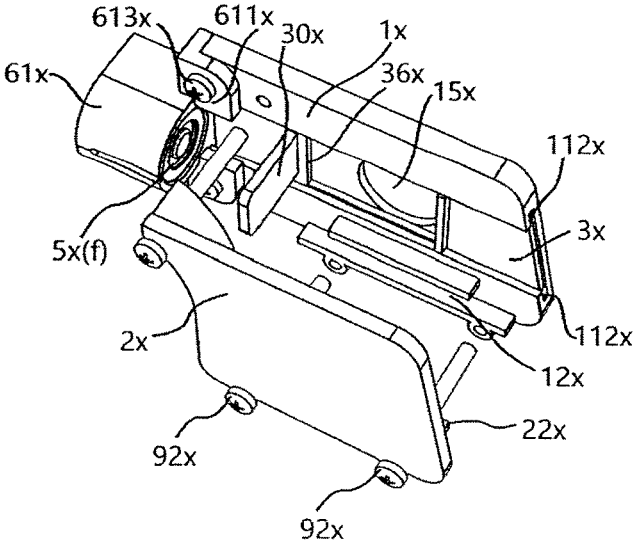
FIG 25.4

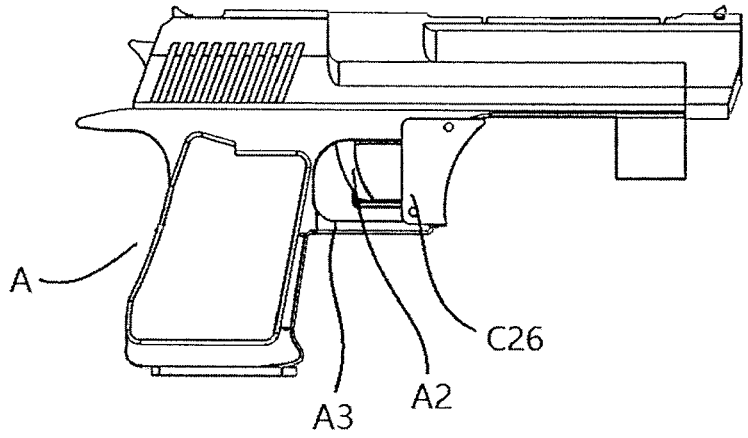
FIG 26.1
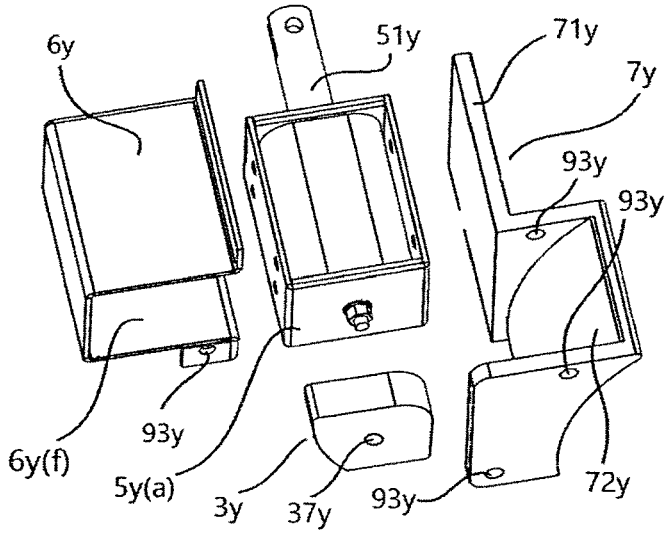
FIG 26.2
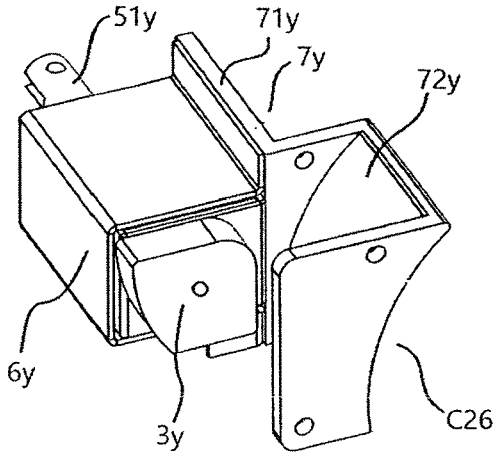
FIG 26.3

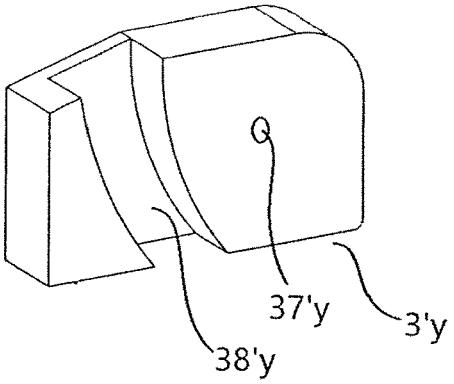
FIG 26.4
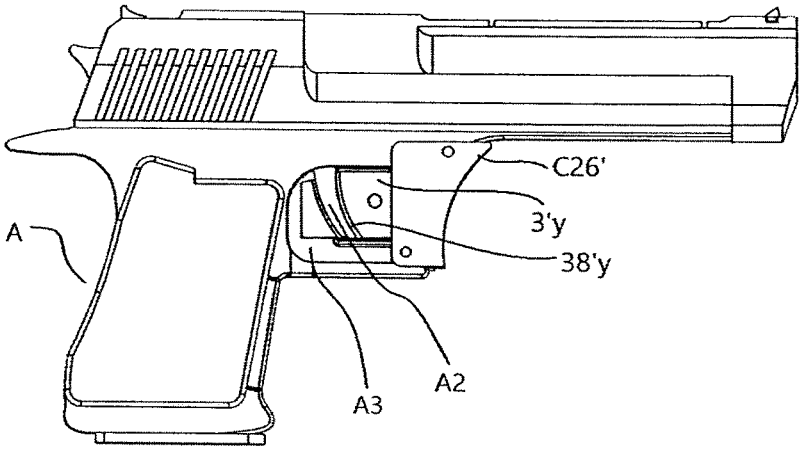
FIG 26.5
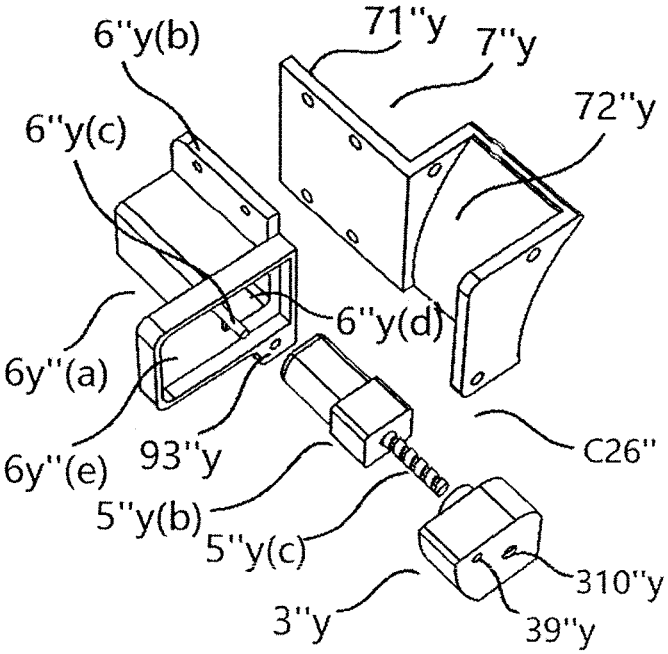
FIG 26.6

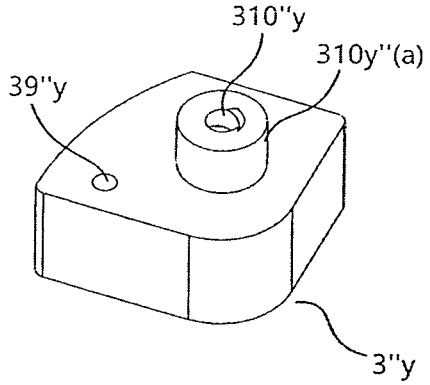
FIG 26.7
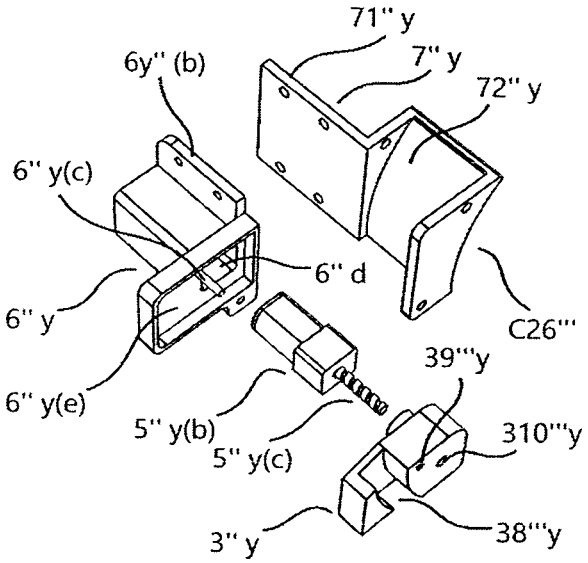
FIG 26.8
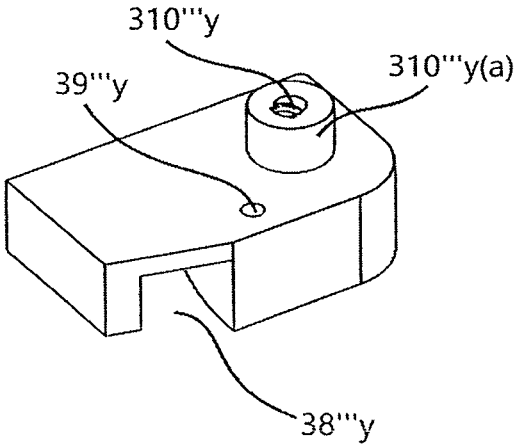
FIG 26.9

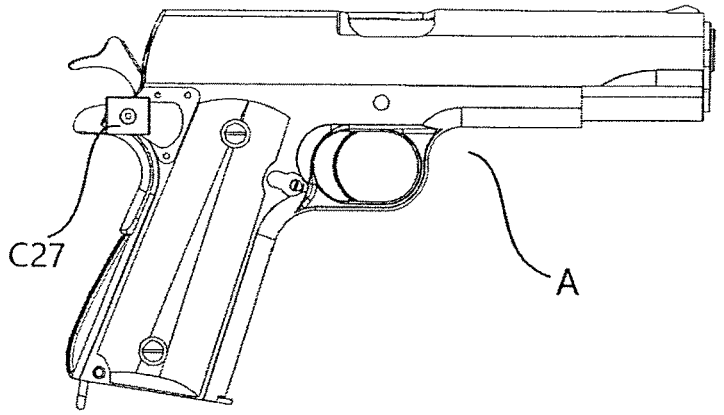
FIG 27.1
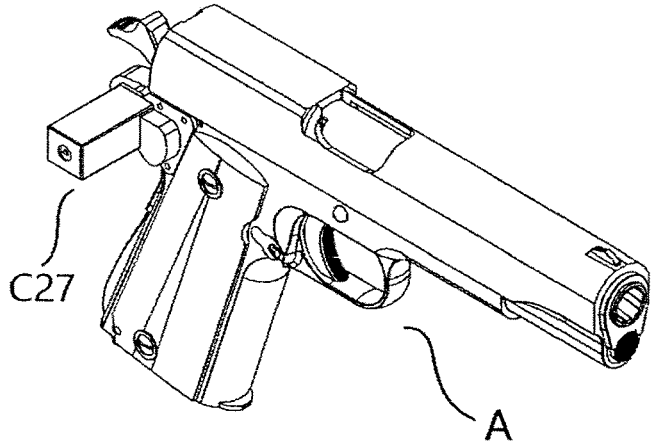
FIG 27.2
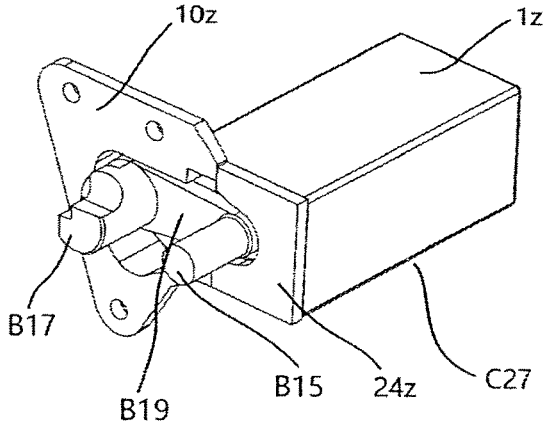
FIG 27.3

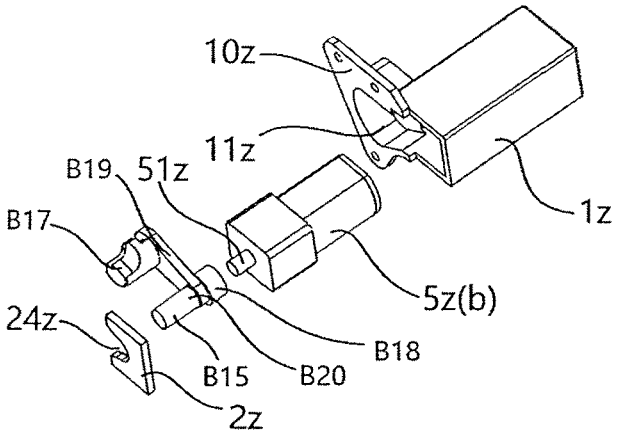
FIG 27.4
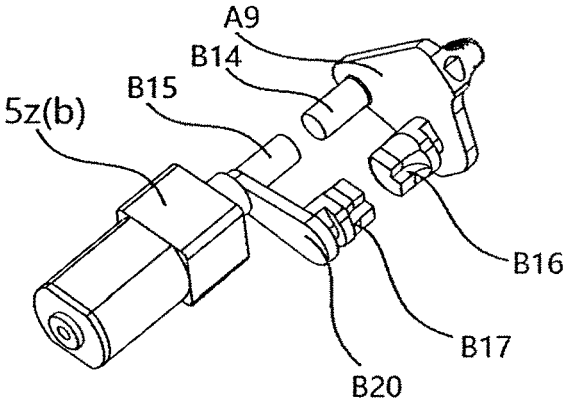
FIG 27.5
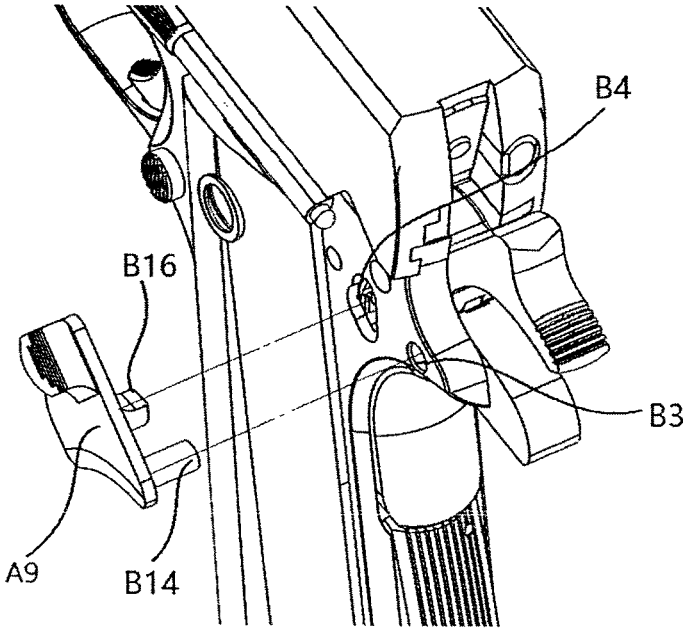
FIG 27.6

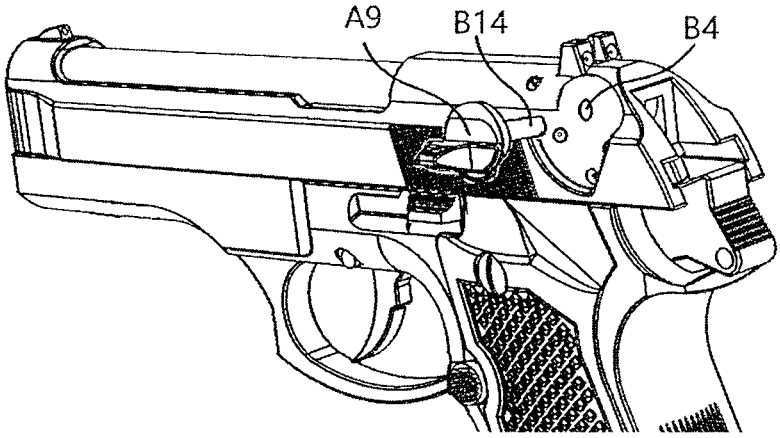
FIG 27.7
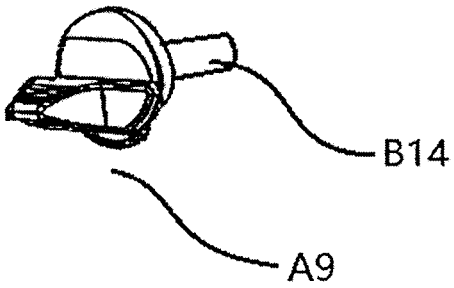
FIG 27.8
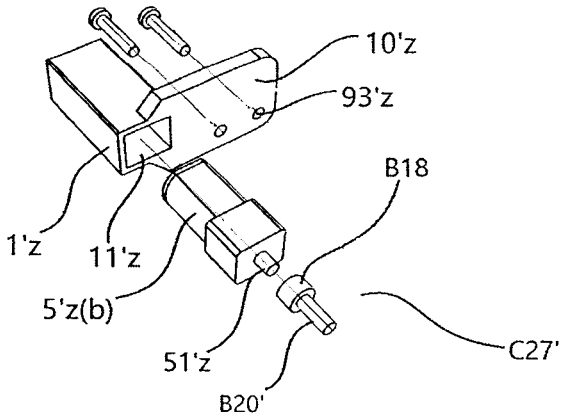
FIG 27.9

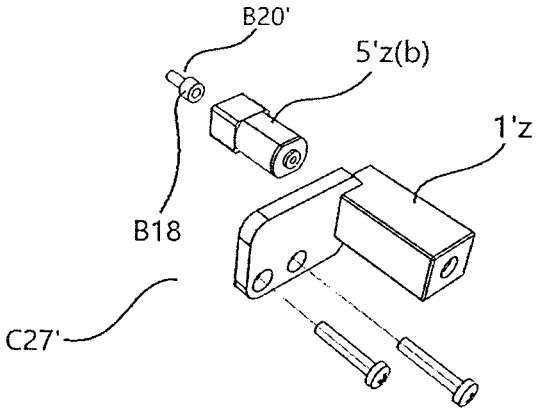
FIG 27.10
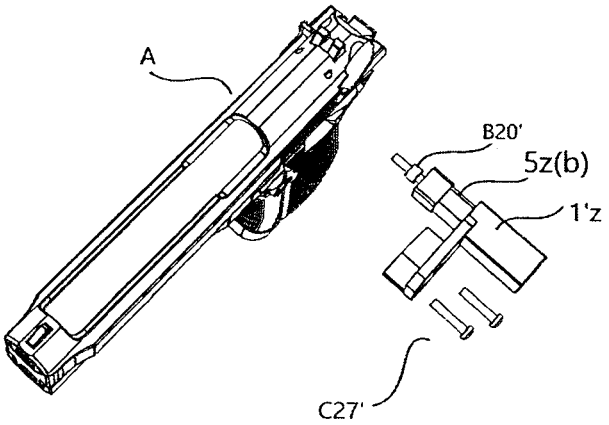
FIG 27.11
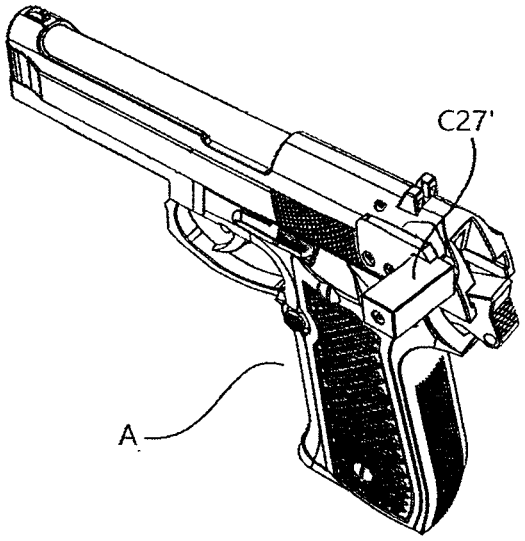
FIG 27.12

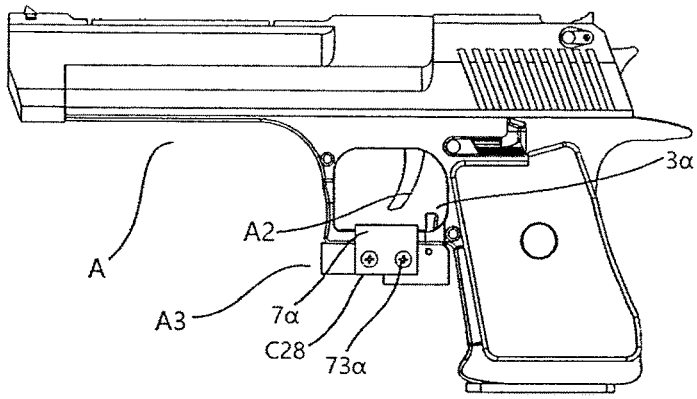
FIG 28.1
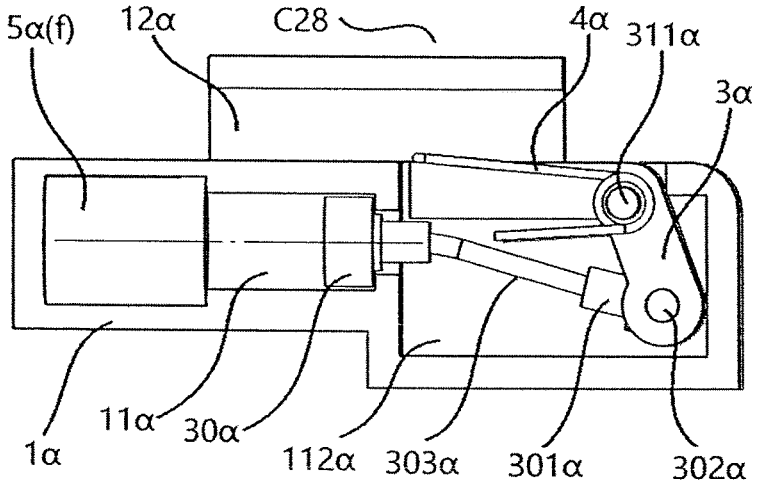
FIG 28.2
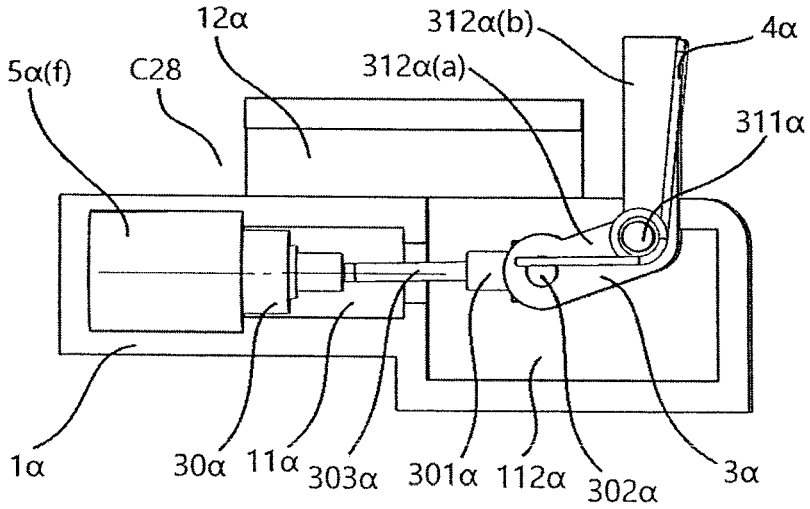
FIG 28.3

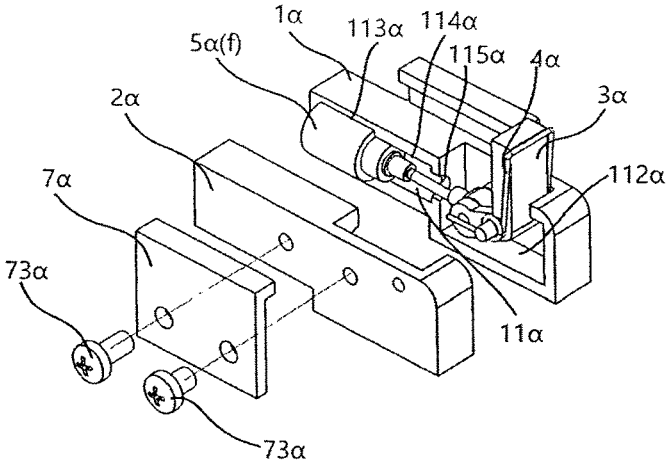
FIG 28.4
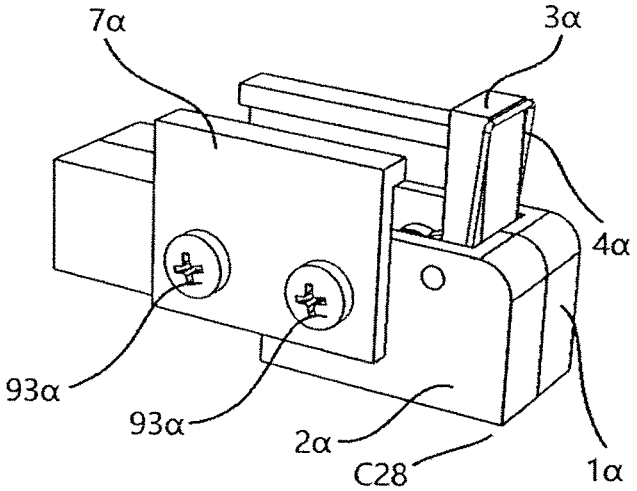
FIG 28.5
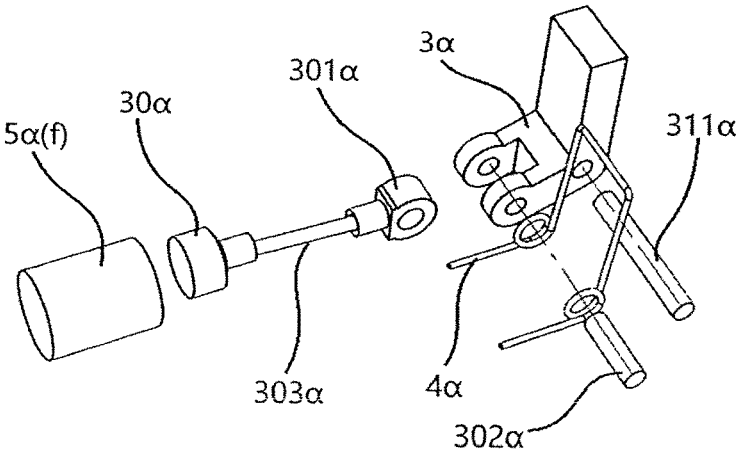
FIG 28.6

SAFETY LOCK MECHANISMS FOR PORTABLE WEAPONS, INCLUDING CROSSBOWS AND FIREARMS, SUCH AS GUNS, RIFLES AND ALIKE

CROSS-REFERENCE TO RELATED APPLICATIONS

N/A

STATEMENT REGARDING FEDERALLY SPONSORED RESEARCH OR DEVELOPMENT

N/A

NAMES OF THE PARTIES TO A JOINT RESEARCH AGREEMENT

N/A REFERENCE TO A "SEQUENCE LISTING"
N/A

BACKGROUND OF THE INVENTION

Field of the Invention

The present invention directs to safety lock mechanisms for portable weapons, including, but not limited to, crossbows and firearms, such as guns, rifles and alike.

Description of Related Art

Portable weapons, such as crossbows and firearms, for example, guns (such as handguns, for example, pistols and/or revolvers), rifles and alike, are often used for recreational and/or sporting purposes, self-defense where law allows, and/or carried by authorized personals, such as police, military, etc. However, safety issues related thereto are always concerns for the public. Many of portable weapons used today shares substantially similar firing sequence from pulling of a trigger to a firing pin striking a bullet or alike to fire a bullet or alike therefrom. Many of these portable weapons are equipped with primary safety lock mechanisms; however, these primary safety lock mechanisms may be released manually by its operator(s) and, thus, there is no other means to ensure operational safety of the portable weapon after the primary safety lock mechanisms is released.

There have been a number of attempts that have been made to ensure operational safety of the portable weapon. For example, U.S. Pat. No. 4,488,370 to Lemelson (Lemelson) discloses a weapon control system and method to prevent it from being accidentally operated or operated by a person who is not the owner of the weapon or someone who is not authorized to use the weapon. Lemelson further discloses a lock mechanism, which is hidden inside the grip of the pistol for locking/unlocking the trigger.

U.S. Pat. No. 6,550,175 to Parker (Parker) discloses a user friendly gunlock, which is attached to a trigger guard of a firearm, which releases the lock to block the trigger based on a number combination (or similar) is entered properly to the gunlock.

U.S. Pat. No. 6,563,940 to Recce (Recce) discloses unauthorized user prevention device and method, which prevents an unauthorized/unrecognizable operator from using a firearm based on a pressure signature profile/grip profile(s) of an authorized operator(s) for the firearm which are stored. Recce requires, however, a special latching and internal trigger lock mechanism, such that a mechanical force/movement would not be propagated from the trigger to the hammer of the firearm to block the firing sequence thereof.

U.S. Pat. No. 9,857,133 to Kloepfer et al. (Kloepfer) and US Patent Application Publication No. 2018/0142977 to Kloepfer et al. (Kloepfer 2) disclose a system and method for authenticating an identity for a biometrically-enabled gun. The biometrically-enabled gun has a biometric sensor for reading the biometric information of an operator (such as finger print) to determine wither the operator is authorized to operate the firearm. Kloepfer/Kloepfer 2 lock the firing sequence by obstructing movement of a trigger bar.

Many of prior attempts, as it can be seen in Lemelson, Parker, Recce, Kloepfer and Kloepfer 2 merely concern about unlocking firearm only by an authorized operator, thus they would not be able to provide any solution for instantaneously blocking the firing sequence when required/desired.

Accordingly, in order to improve operational safety of the portable weapons, locking and unlocking conditions or environment including time, place, direction and operator/person would need to be considered; however, even such considerations were made, prior attempts would not allow/enable to provide means to promptly lock and unlock the firing sequence, automatically or autonomously. Therefore, there has been a long-felt need(s) for a primary, complementary or secondary safety mechanism, either automatic or semi-automatic in nature, promptly to lock or to lock and unlock a firing sequence of a portable weapon.

BRIEF SUMMARY OF THE INVENTION

The present invention directs to safety lock mechanisms for portable weapons, including, but not limited to, crossbows and firearms, such as guns, rifles and alike, that provide enabling means to automatically or semi-automatically lock, or lock and unlock a firing sequence thereof.

According to one aspect of the present invention, it provides a safety lock mechanism for a portable weapon, comprising an actuator, and locking means operable from an unlocked state to a locked state by the actuator for blocking a firing sequence of the portable weapon. The actuator may include an electromagnet, and a permanent magnet, wherein the permanent magnet is affixed to the locking means, and the electromagnet actuates the locking means through the permanent magnet. The locking means may include a bar member for blocking the firing sequence at a trigger, a trigger lever, a hammer, or a firing pin of the portable weapon. The locking means is operable from the locked state to the unlocked state. Alternatively, the actuator comprises a motor; and a gear, wherein the gear cooperates with the locking means, and the motor actuates the locking means through the gear.

According to another aspect of the present invention, it provides an automatic spring-type lock mechanism for a portable weapon, such as a handgun or alike, comprising a lock cover, a lock shell, and a lock tongue actuator, which would be installed at the front end of the firing pin of the portable weapon.

According to yet another aspect of the present invention, it provides an automatic spring-type lock mechanism for a handgun or alike, which is disposed on the slide near the hammer of the handgun.

According to a further aspect of the present invention, it provides an automatic spring-type lock mechanism for a handgun or alike, which is disposed at the grip of a handgun, which blocks the trigger at the rear side of the trigger of the handgun.

According to a further aspect of the present invention, it provides an automatic spring-type lock mechanism for a handgun or alike, which is disposed at the trigger guard to block or release at the rear of the trigger of the handgun.

According to a further aspect of the present invention, it provides an automatic spring-type lock mechanism for a handgun or alike, which is disposed at the position which is about or is adjacent to the front end of the firing pin on the slide of the handgun to block or release the filing pin from rushing to a bullet.

According to a further aspect of the present invention, it provides an automatic spring-type lock mechanism for a handgun or alike, which is mounted on the position corresponding to firing pin circular slot of the gun slide on the handgun to block or release the firing pin from moving.

According to a further aspect of the present invention, it provides an automatic spring-type lock mechanism for a handgun or alike, which is disposed at the end of the slide, which is adjacent with the hammer to block or release the hammer from hitting the firing pin.

According to a further aspect of the present invention, it provides a gear-type trigger lock mechanism for a handgun or alike for blocking or releasing a pulling action for the trigger of the handgun.

According to a further aspect of the present invention, it provides a gear-type trigger lock mechanism for a handgun or alike, which includes a lock shell, a lock cover and a lock tongue actuator, including a motor, a driving gear, an idler gear and/or gear set, and a bar member, where the bar member blocks or releases the trigger of the handgun.

According to a further aspect of the present invention, it provides a gear-type trigger lock mechanism for a handgun or alike, which includes a lock shell, a lock cover and a lock tongue actuator, including a motor, a driving gear(s), and a bar member, where the bar member blocks/releases the trigger of the handgun.

According to a further aspect of the present invention, it provides a gear-type trigger lock mechanism, which includes a lock shell, a lock cover and a lock tongue actuator, including a motor, a driving gear(s), and a bar member, where the bar member blocks or releases the firing pin of the handgun.

According to a further aspect of the present invention, it provides a gear-type trigger lock mechanism for a handgun or alike, includes a lock shell, a lock cover and a lock tongue actuator, including a motor, a driving gear(s), an idler gear and/or gear set, and a bar member, where the bar member blocks or releases the hammer from hitting the firing pin of the handgun.

According to a further aspect of the present invention, it provides a semi-automatic electromagnetic telescoping lock mechanism for a handgun or alike, which includes a lock shell, a lock cover and a lock tongue actuator, including a lock tongue spring, an electromagnet, a lock tongue limit spring, lock tongue limit block and a bar member, where the bar member blocks the trigger of the handgun.

According to a further aspect of the present invention, it provides a semi-automatic lock mechanism for a handgun or alike, which includes a lock shell, lock cover and a lock tongue actuator, including a lock tongue spring, an electromagnet, a lock tongue limit spring, a lock tongue limit block and an arc member, where the arc member blocks the trigger of the handgun.

According to a further aspect of the present invention, it provides a semi-automatic lock mechanism, which includes a lock shell, lock cover and a lock tongue actuator, including a lock tongue spring, an electromagnet, a lock tongue limit spring, lock tongue limit block and a bar member, where the bar member blocks the trigger of the handgun.

According to a further aspect of the present invention, it provides a semi-automatic lock mechanism, which includes a lock shell, a lock cover and a lock tongue actuator, including a lock tongue spring, an electromagnet, a lock tongue limit spring, a lock tongue limit block and an arc member, where the arc member blocks the trigger of the handgun.

According to a further aspect of the present invention, it provides a semi-automatic lock mechanism for a handgun or alike, which includes a lock shell, a lock cover and a lock tongue actuator, including a lock tongue spring, an electromagnet, a lock tongue limit spring, lock tongue limit block and a bar member, where the arc member blocks the trigger of the handgun.

According to a further aspect of the present invention, it provides a semi-automatic lock mechanism for a handgun or alike, comprises a lock shell, a lock cover and a lock tongue actuator, including a lock tongue spring, a push-pull solenoid and an arc member, where the arc member blocks the trigger of the handgun.

According to a yet further aspect of the present invention, it provides a pull-rod style trigger lock mechanism for a handgun or alike, includes a lock shell, a bar member, a pull-rod, and a self-holding solenoid, where the bar member operably extends/retract to block/release the movement of the trigger of the handgun.

According to a yet further aspect of the present invention, it provides a trigger lever lock mechanism for a handgun or alike, which blocks or release the trigger lever of the handgun.

According to a yet further aspect of the present invention, it provides a tapeline-type trigger lock mechanism that may be installed on a trigger guard of a handgun or alike. The lock mechanism has a lock tongue which is attached to a trigger of the handgun and a tapeline which is wind around a tapeline disk, where the movement of the trigger is controlled by controlling the movement of the tapeline disk.

According to a yet further aspect of the present invention, it provides a box-style lock mechanism that may be installed around or about a trigger guard of a handgun or alike. The lock mechanism has a finger window/hole for providing/restricting an access to the trigger. An actuator slidably operates the finger window to allow or restrict the access to the trigger.

According to a yet further aspect of the present invention, it provides a block style lock mechanism installed on a handgun, having a block which lock/release the movement and/or access to the trigger. The block may be actuated by a self-holding solenoid, a motor with a screw rod or a like.

According to a yet further aspect of the present invention, it provides a lock mechanism that may be installed on a handgun or alike that replaced a rotary shaft and actuating lever of the original safety mechanism of the handgun.

According to a yet further aspect of the present invention, it provides a torsional smart gun trigger lock mechanism installed on a trigger guard of a handgun or alike, having a lock tongue which lock/release the movement of the trigger. The tongue may be actuated by an electromagnet or alike.

BRIEF DESCRIPTION OF THE SEVERAL VIEWS OF THE DRAWING

The present invention is described in more detail with reference to the accompanying drawings, in which:

FIG. 1.0 is a block diagram of a safety lock mechanism of the present invention;

FIG. 1.1 is a right-side view of an automatic spring-type gun lock C1 installed at the front end of the firing pin of the firearm according to a first preferred embodiment of the present invention;

FIG. 1.2 is a perspective view of the automatic spring-type gun lock mechanism C1;

FIG. 1.3 is an exploded view of the lock mechanism C1;

FIG. 1.4 is a perspective view of the assembly of the lock mechanism C1;

FIG. 1.5 is a partially exploded perspective view of the lock mechanism C1;

FIG. 1.6 is a perspective view of a lock shell 1 of the lock mechanism C1;

FIG. 1.71 is a partial cross-sectional view of the lock mechanism C1 installed at the front end of the firing pin of the firearm and the lock mechanism C1 is in locked state;

FIG. 1.72 is a partially enlarged view of position I of FIG. 1.71;

FIG. 1.81 is a partial cross-sectional view of the lock mechanism C1 installed at the front end of the firing pin of the firearm and the lock tongue is at the state of retraction;

FIG. 1.82 is the partially enlarged view of position I1 of FIG. 1.81;

FIG. 2.1 is a right-side view of a second embodiment of a lock mechanism C2 of the present invention, being installed at the front end of the hammer of the firearm;

FIG. 2.2 is a perspective view of the assembly of the lock mechanism C2 installed at the front end of the hammer of the firearm and the lock tongue is at the state of retraction;

FIG. 2.3 is an exploded view of the lock mechanism C2;

FIG. 2.4 is a bottom plan view of the lock mechanism C2 in locked state;

FIG. 2.5 is a bottom plan view of the lock mechanism C2 in unlocked state;

FIG. 2.6 is a cross-sectional view of lock shell of the lock mechanism C2;

FIG. 2.71 is a rear perspective view of the assembly of the lock mechanism C2 in locked state;

FIG. 2.72 is a partially enlarged view of position I2*a* in FIG. 2.71;

FIG. 2.81 is a rear perspective view of the lock mechanism C2 in unlocked state;

FIG. 2.82 is a partially enlarged view of position I2*b* of FIG. 2.81;

FIG. 3.1 is a right-side view of a third embodiment of a lock mechanism C3 of the present invention, being installed on the handgun grip and locates at trigger guard;

FIG. 3.2 is a left-side view of the lock mechanism C3 installed on the handgun grip and locates at trigger guard;

FIG. 3.3 is a front view of the lock mechanism C3 installed on the handgun grip;

FIG. 3.4 is an exploded view of the lock mechanism C3;

FIG. 3.5 is an exploded view of the lock mechanism C3 with an U-shaped clamp;

FIG. 3.6 is a perspective view of the assembly of the lock mechanism C3;

FIG. 3.7 is a partially cross-sectional view of FIG. 3.6;

FIG. 3.81 is a right-side view of the lock mechanism C3 installed on a grip of a rifle;

FIG. 3.82 is a partially enlarged view of position I3 of FIG. 3.8;

FIG. 4.1 is a right-side view of a fourth embodiment of a lock mechanism C4 of the present invention, being installed on the handgun grip and locates at trigger guard;

FIG. 4.2 is a front view of the lock mechanism C4 installed on the handgun grip;

FIG. 4.3 is an exploded view of the lock mechanism C4;

FIG. 4.4 is a perspective view of the mechanical lock C4;

FIG. 4.5 is a cross-sectional view of FIG. 4.4;

FIG. 4.61 is a right-side view of the lock mechanism C4 installed on a grip of a rifle;

FIG. 4.62 is a partially enlarged view of position I4 of FIG. 4.61;

FIG. 5.1 is a right-side view of a fifth embodiment of a lock mechanism C5 of the present invention, being installed at the lower end of a trigger guard and the lock mechanism C5 is in locked state;

FIG. 5.2 is a front view of the lock mechanism C5 installed at the lower end of the trigger guard;

FIG. 5.3 is an exploded view of the lock mechanism C5;

FIG. 5.4 is a perspective view of the assembly of the lock mechanism C5;

FIG. 5.5 is a cross-sectional view of the lock mechanism C5;

FIG. 5.61 is a right-side view of the lock mechanism C5 in locked state;

FIG. 5.62 is a partially enlarged view of position I5 of FIG. 5.61;

FIG. 6.1 is a right-side view of a sixth embodiment of a lock mechanism C6 of the present invention, being installed at the front end of the firing pin of firearms;

FIG. 6.2 is a perspective view of the assembly of the lock mechanism C6 installed at the front end of the firing pin of the firearm;

FIG. 6.3 is an exploded view of the lock mechanism C6;

FIG. 6.4 is a cross-sectional view of the lock mechanism C6 in unlocked state;

FIG. 6.5 is a cross-sectional view of the lock mechanism C6 in unlocked state;

FIG. 6.61 is a cross-sectional view of the lock mechanism C6 in locked state;

FIG. 6.62 is a partially enlarged view of position I6*a* of FIG. 6.61;

FIG. 6.71 is a cross-sectional view of the lock mechanism C6 in unlocked state;

FIG. 6.72 is an enlarged drawing of position I6*b* of FIG. 6.71;

FIG. 7.1 is a right-side view of a seventh embodiment of a lock mechanism C7 of the present invention, being installed at the rear of the firing pin of the firearm;

FIG. 7.2 is a perspective view of the assembly of the lock mechanism C7 installed at the rear of the firing pin of the firearm;

FIG. 7.3 is an exploded view of the lock mechanism C7.

FIG. 7.4 is a cross-sectional view of the lock mechanism C7 in locked state;

FIG. 7.5 is a cross-sectional view of the lock mechanism C7 in unlocked state;

FIG. 7.61 is a cross-sectional view of the lock mechanism C7 installed at the rear of firing pin of the firearm and the lock tongue is at the state of protruding;

FIG. 7.62 is a partially enlarged view of position I7*a* of FIG. 7.61;

FIG. 7.71 is a cross-sectional view of the lock mechanism C7 installed at the rear of the firing pin of the firearm and the lock tongue is at the state of retraction;

FIG. 7.72 is a partially enlarged view of position I7*b* of the FIG. 7.71;

FIG. 7.81 is a cross-sectional view of the lock mechanism C7 installed at the rear of the firing pin of the firearm and the lock tongue is at the state of protruding and the semicircular fork of the lock tongue is stuck at the firing pin circular slot;

FIG. 7.82 is a partially enlarged view of position I7*c* of FIG. 7.81;

FIG. 8.1 is a perspective view of an eighth embodiment of a lock mechanism C8 of the present invention, being installed at the front end of the hammer of the firearm;

FIG. 8.2 is a right-side view of the lock mechanism C8 when the lock gun is installed at the front end of the hammer of the firearm;

FIG. 8.3 is an exploded view of the lock mechanism C8;

FIG. 8.4 is a cross-sectional view of the lock shell of the lock mechanism C8;

FIG. 8.5 is a cross-sectional view of the lock mechanism C8 in locked state;

FIG. 8.6 is a cross-sectional view of the lock mechanism C8 in unlocked state;

FIG. 8.71 is a rear perspective view of the lock mechanism C8 in locked state;

FIG. 8.72 is a partially enlarged view of position I8*a* of FIG. 8.71;

FIG. 8.81 is a rear perspective view of the lock mechanism C8 installed at the front end of the hammer of the firearm and the lock mechanism C8 is in unlocked state;

FIG. 8.82 is a partially enlarged view of position I8*b* of FIG. 8.81;

FIG. 9.1 is a right-side view of a ninth embodiment of a lock mechanism C9 of the of the present invention, being installed on a handgun;

FIG. 9.2 shows a front view of the lock mechanism C9 installed on a handgun;

FIG. 9.3 is an exploded view of the lock mechanism C9;

FIG. 9.4 is a perspective view of the lock cover in the lock mechanism C9;

FIG. 9.5 is another perspective view of the lock mechanism C9;

FIG. 9.61 is a right-side view of the lock mechanism C9 installed on a rifle;

FIG. 9.62 is an enlarged diagram of the position marked as I9 in FIG. 9.61;

FIG. 10.1 is a right-side view of a tenth embodiment of a lock mechanism C10 of the present invention;

FIG. 10.2 is a left-side view of the lock mechanism C10;

FIG. 10.3 is a front view of the lock mechanism C10;

FIG. 10.4 is an exploded view of the lock mechanism C10;

FIG. 10.5 is a perspective view of the lock mechanism C10;

FIG. 10.6 is a perspective view of the lock cover in the lock mechanism C10.

FIG. 10.71 is a right-side view of the lock mechanism C10 installed on a rifle;

FIG. 10.72 is an enlarged diagram of the position marked as I10 in FIG. 10.71;

FIG. 11.1 is a right-side view of an eleventh embodiment of a lock mechanism C11 of the present invention;

FIG. 11.2 is a left-side view of the lock mechanism C11;

FIG. 11.3 is a front view of the lock mechanism C11;

FIG. 11.4 is an exploded view of the lock mechanism C11;

FIG. 11.5 is a perspective view of the lock mechanism C11;

FIG. 11.6 is a perspective view of the lock cover of the lock mechanism C11;

FIG. 11.71 is a right-side view of the lock mechanism C11 installed on a rifle;

FIG. 11.72 is an enlarged diagram of the position marked as I11 in FIG. 11.71;

FIG. 12.1 is a right-side view of a twelfth embodiment of a lock mechanism C12 of the present invention;

FIG. 12.2 is a perspective view of the lock mechanism C12;

FIG. 12.3 is an exploded view of the lock mechanism C12;

FIG. 12.4 is a cross-sectional view of the lock mechanism C12 in locked position;

FIG. 12.5 is a cross-sectional view of the lock mechanism C12 in unlocked state;

FIG. 12.61 is a cross-sectional view of the lock mechanism C12 in unlocked position;

FIG. 12.62 is an enlarged diagram of the position marked as I12*a* in FIG. 12.61;

FIG. 12.71 is a cross-sectional view of the lock mechanism C12 in locked state;

FIG. 12.72 is an enlarged diagram of the position marked as I12*b* in FIG. 12.71;

FIG. 12.8 is a perspective view of the rack lock tongue of the lock mechanism C12;

FIG. 12.9 is a perspective view of the firing pin;

FIG. 13.1 is a right-side view of a thirteenth embodiment of a lock mechanism C13 of the present invention;

FIG. 13.2 is a rear perspective view of the lock mechanism C13;

FIG. 13.31 is an exploded view of the lock mechanism C13;

FIG. 13.32 is the second assembly extension diagram of the lock mechanism C13;

FIG. 13.41 is a cross-sectional view of the lock mechanism C13 in locked state;

FIG. 13.42 is a cross-sectional view of the lock mechanism C13 in unlocked state;

FIG. 13.51 is a rear perspective view of the lock mechanism C13 in locked state;

FIG. 13.52 is an enlarged view of the position marked as I13*a* in FIG. 13.51;

FIG. 13.61 is a rear perspective view of the lock mechanism C13 in unlocked state;

FIG. 13.62 is an enlarged view of the position marked as I13*b* in FIG. 13.61;

FIG. 14.1 is a left-side view of a fourteenth embodiment of a lock mechanism C14 of the present invention;

FIG. 14.21 is a cross-sectional view of the lock mechanism C14 in locked state;

FIG. 14.22 is a cross-sectional view of the lock mechanism C14 in unlocked state;

FIG. 14.3 is a perspective view of the lock mechanism C14;

FIG. 14.4 is an exploded view of the lock mechanism C14;

FIG. 14.51 is a right-side view of the lock mechanism C14 installed on a rifle;

FIG. 14.52 is an enlarged view of the position marked as I14 in FIG. 14.51;

FIG. 15.1 is a left-side view of a fifteenth embodiment of a lock mechanism C15 of the present invention;

FIG. 15.21 is a cross-sectional view of the lock mechanism C15 in locked state;

FIG. 15.22 is a cross-sectional view of the lock mechanism C15 in unlocked state;

FIG. 15.3 is a perspective view of the lock mechanism C15;

FIG. 15.4 is an exploded view of the lock mechanism C15;

FIG. 15.51 is a right-side view of the lock mechanism C15 installed on a rifle;

FIG. 15.52 is an enlarged view of the position marked as I15 in FIG. 15.51;

FIG. 16.1 is a left-side view of a sixteenth embodiment of a lock mechanism C16 of the present invention;

FIG. 16.2 is a perspective view of the lock mechanism C16;

FIG. 16.3 is an exploded view of the lock mechanism C16;

FIG. 16.41 is a left-side view of the lock mechanism C16 installed on a rifle;

FIG. 16.42 is an enlarged view of the position marked as I16 in FIG. 16.41;

FIG. 17.1 is a right-side view of a seventeenth embodiment of a mechanical lock C17 of the present invention;

FIG. 17.2 is an exploded view of the lock mechanism C17;

FIG. 17.3 is another exploded view of the lock mechanism C17;

FIG. 17.4 is a perspective view of the lock mechanism C17;

FIG. 17.51 is a right-side view of the lock mechanism C17 installed on a rifle;

FIG. 17.52 is an enlarged drawing of the position marked as I17 in FIG. 17.51;

FIG. 18.1 is a right-side view of an eighteenth embodiment of a mechanical lock C18 of the present invention;

FIG. 18.2 is a left-side view of the lock mechanism C18 installed on handgun;

FIG. 18.3 is an exploded view of the lock mechanism C18;

FIG. 18.4 is a perspective view of the lock mechanism C18;

FIG. 18.51 is a right-side view of the lock mechanism C18 installed on a rifle;

FIG. 18.52 is an enlarged view of the position marked as I18 in FIG. 18.51;

FIG. 19.1 is a right-side view of a nineteenth embodiment of a mechanical lock C19 of the present invention;

FIG. 19.2 is a left-side view of the lock mechanism C19;

FIG. 19.3 is an exploded view of the lock mechanism C19;

FIG. 19.4 is a perspective view of the lock mechanism C19;

GIG. 19.5 is a front view of the lock mechanism C19;

FIG. 19.61 is a perspective view of the lock mechanism C19 installed on a rifle;

FIG. 19.62 is an enlarged drawing of the position marked as I19 in FIG. 19.61;

FIG. 20.1 is a right-side view of a lock mechanism C20 of the present invention;

FIG. 20.2 is an exploded view of the lock mechanism C20;

FIG. 20.3 is a cross-sectional view of the lock mechanism C20 in locked state;

FIG. 20.4 is a cross-sectional view of the lock mechanism C20 in firing state;

FIG. 20.5 is a cross-sectional view of the lock mechanism C20 in unlocked state;

FIG. 20.6 is a perspective view of the lock mechanism C20;

FIG. 21.1 is a perspective view of a twenty-first embodiment of a lock mechanism C21 of the present invention;

FIG. 21.2 is an exploded view of the lock mechanism C21;

FIG. 21.3 is a left-side view of the trigger lever B5 and the limit hole B6 in firearms with the lock mechanism C21;

FIG. 21.4 is a perspective view of the firearm frame A1 of firearms with the lock mechanism C21;

FIG. 21.41 is an enlarged drawing of position I21*a* of FIG. 21.4. in FIG. 21.41;

FIG. 21.5 is a cross-sectional view of the lock mechanism C21;

FIG. 21.6 is a cross-sectional view of the lock mechanism C21 in unlocked state;

FIG. 21.61 is an enlarged drawing of the position marked as I21*b* of FIG. 21.6;

FIG. 21.7 is a cross-sectional view of the lock mechanism C21 in locked state;

FIG. 21.71 is an enlarged drawing of position marked as I21*c* in FIG. 21.7;

FIG. 22.1 is a perspective view of assembly of a twenty-second embodiment of a lock mechanism C22 of the present invention;

FIG. 22.2 is a cross-sectional view of the lock mechanism C22;

FIG. 22.21 is an enlarged drawing of position marked as I22 of FIG. 22.2, when the lock mechanism C22 is in locked state;

FIG. 22.22 is an enlarged drawing of marked as position I22 of FIG. 22.2, when the lock mechanism C22 is in unlocked state;

FIG. 22.3 is an exploded view of the lock mechanism C22;

FIG. 23.1 is a right-side view of a twenty-third embodiment of a lock mechanism C23 of the present invention;

FIG. 23.2 is a perspective view of the lock mechanism C23;

FIG. 23.3 is an exploded view of the lock mechanism C23;

FIG. 23.4 is a cross-sectional view of the lock mechanism C23;

FIG. 23.5 is a top cross-sectional view of the lock mechanism C23 in unlocked state;

FIG. 23.51 is an enlarged view of the mechanic lock C23 in unlocking state, the position marked as I23*a* in FIG. 23.5;

FIG. 23.6 is a top cross-sectional view of the lock mechanism C23 in locked state;

FIG. 23.61 is an enlarged drawing of the lock mechanism C23 in locked state, the position marked as I23*b* in FIG. 23.6;

FIG. 23.7 is a cross-sectional view of the lock mechanism C23;

FIG. 24.1 is a left-side view of the lock mechanism C24 installed on a handgun;

FIG. 24.2 is an exploded view of the lock mechanism C24;

FIG. 24.3 is a perspective view of a lock shell 1*w* of the lock mechanism C24;

FIG. 24.4 is a perspective view of the lock mechanism C24;

FIG. 24.5 is a top plan view of a lock tongue spring 4*w* of the lock mechanism C24;

FIG. 25.1 is a left-side view of a lock mechanism C25 installed on a handgun;

FIG. 25.2 is an exploded view of the lock mechanism C25;

FIG. 25.3 is a perspective view of a side clamp cover of the lock mechanism C25;

FIG. 25.4 is a partly exploded perspective view of the lock mechanism C25;

FIG. 26.1 is a left-side view of a lock mechanism C26 installed on a handgun;

FIG. 26.2 is an exploded view of the lock mechanism C26;

FIG. 26.3 is a perspective view of the lock mechanism C26;

FIG. 26.4 is a perspective view of a lock tongue 3'*y* of the lock mechanism C26;

FIG. 26.5 is a left-side of a variant of a lock mechanism C26';

FIG. 26.6 is an exploded view of another variant of a lock mechanism C26";

FIG. 26.7 is a perspective view of a lock tongue 3"*y* of a lock mechanism C26";

FIG. 26.8 is an exploded view of another variant of a lock mechanism C26''';

FIG. 26.9 is a perspective view of a lock tongue 3'''*y* of a lock mechanism C26''';

FIG. 27.1 is a left-side view of a lock mechanism C27 installed on a handgun;

FIG. 27.2 is a perspective view of the lock mechanism C27 installed on the handgun;

FIG. 27.3 is a perspective view of the lock mechanism C27;

FIG. 27.4 is an exploded view of the lock portion mechanism C27;

FIG. 27.5 is a partial exploded view of the lock mechanism C27;

FIG. 27.6 is a partial exploded view of a safety mechanism of an M1911 Class handgun;

FIG. 27.7 is a partial exploded view of the safety mechanism of a BERETTAM92F Class handgun;

FIG. 27.8 is a perspective view of the safety mechanism of the BERETTAM92F Class handgun;

FIG. 27.9 is a front exploded view of a variant of a lock mechanism C27';

FIG. 27.10 is a rear exploded view of the variant of the lock mechanism C27';

FIG. 27.11 is an exploded view of the variant of the lock mechanism C27';

FIG. 27.12 is a perspective view of the variant of the lock mechanism C27' installed on a handgun;

FIG. 28.1 is a right-side view of a lock mechanism C28 installed on a handgun;

FIG. 28.2 is a cross-sectional view of the lock mechanism C28, where the lock mechanism C28 is in an unlocked state;

FIG. 28.3 is a cross-sectional view of the lock mechanism C28, where the lock mechanism C28 is in a locked state;

FIG. 28.4 is an exploded view of the lock mechanism C28;

FIG. 28.5 is a perspective view of the lock mechanism C28; and

FIG. 28.6 is an exploded view of the lock mechanism C28.

DETAILED DESCRIPTION OF THE INVENTION

Referring to FIG. 1.0, a safety lock mechanism of the present invention would be controlled by a controller M1. The controller M1 may include peripherals, such as sensors, wireless or wired communication module (such that remote control information/command may be communicated to the controller M1), etc., for ensuring the safe environment/condition for use of the portable weapon, and usually, resides on or is installed on the portable weapon. One purpose of the controller M1 is, in order to maintain its operational safety of the portable weapon, upon confirmation/detection of operational conditions of the portable weapon, to control a driver M2 for driving an actuator M3 to actuate the safety lock mechanism for locking/allowing manual unlocking or locking/unlocking the firing sequence of the portable weapon. Thus, the controller M1, when the controller M1 enters in an operational state, would ensure that the firing sequence of the portable weapon is locked initially. The controller M1 would permit unlocking the firing sequence of the portable weapon only when the controller M1 conforms/detects the safe environmental condition(s) to use it or receives a remote control information/command(s), etc. During the operation of the portable weapon (in unlocked state), when the controller M1 confirms/detects any issue contrary to the safe environmental condition(s) or receives a remote control information/command(s), etc. to lock the sequence, then the controller M1 controls the driver M2 to drive an actuator M3 for actuating the safety lock mechanism to lock the firing sequence of the portable weapon. It is essential that the firing sequence of the portable weapon to be locked promptly in order to avoid, for example, shooting in a wrong direction or unsafe area. Accordingly, because the use of manual operation of the locking mechanism by a person/user has been minimized or eliminated, the controller M1 would lock/allow manual unlocking or lock/unlock the firing sequence of the portable weapon instantly, within 150 ms or so (or less) from when the controller M1 conforms/detects or receives a remote information/commands to lock/unlock.

There are various and multiple options or variations for a safety lock mechanism for a portable weapon in accordance with the present invention, and exemplary embodiments of the present invention are shown with referring to accompanied drawings hereinbelow.

First Preferred Embodiment

According to a first preferred embodiment of the present invention, it provides an automatic spring-type lock mechanism C1, which is installed at the middle of the slide A5, which corresponds to the front end B9 of the firing pin A6, as shown in FIGS. 1.1 and 1.2.

Referring to FIGS. 1.3, 1.4 and 1.5, the lock mechanism C1 includes a lock cover 2, a lock shell 1, a lock tongue actuator 3. The lock shell 1 has a lock core cavity 11, which includes a lock tongue slot 112 and an electromagnet installing slot 113. The lock tongue slot 112 and electromagnet installing slot 113 are in communication with each other via an opening being defined therebetween. A magnet slot 282 and a lock tongue extending hole 28 are located on the lock cover 2, and the magnet slot 282 corresponds to a permanent magnet 30. The lock tongue slot 112 and the electromagnet installing slot 113 on the lock shell 1 correspond to the lock tongue extending hole 28 and the magnet slot 282 on the lock cover 2.

The lock tongue actuator 3 actuates a lock tongue actuator rod or a bar member 314, the lock tongue actuator 3 comprises the permanent magnet 30, the lock tongue actuator rod 314, a spring 4, and an electromagnet 5(*f*). The permanent magnet 30 is disposed at one end of the lock tongue actuator rod 314. The electromagnet 5(*f*) is disposed to correspond to the permanent magnet 30. The electromagnet 5(*f*) is disposed at one end of the electromagnet installing slot 113 at the lock shell 1, and the permanent magnet 30 is movable along the electromagnet installing slot 113. The lock tongue actuator rod 314 operably extends out from or retracts in the lock tongue extending hole 28.

The permanent magnet 30 and a spring plate 32 are connected or placed adjacent to each other. The spring plate 32 is disposed at or formed at one end of the lock tongue actuator rod 314 for receiving the spring 4. The spring plate 32 and the lock tongue actuator rod 314, preferably, share the same axis. The permanent magnet 30 locates at the one end of the lock tongue actuator rod 314 and, preferably, forms an L-shape with the lock tongue actuator rod 314 as shown in FIG. 1.3. The plane of the spring plate 32 is, preferably, perpendicular to the axis of the lock tongue actuator rod 314. The spring (or lock tongue spring) 4 is disposed on the spring plate 32, and against the lock shell 1. The lock tongue spring 4, the spring plate 32 and the lock tongue actuator rod 314 operably engages with the lock tongue slot 112. The electromagnet 5(*f*) is fixed at the one end of the electromagnet installing slot 113 at the lock shell 1. The permanent magnet 30 is movably engages with the electromagnet installing slot 113.

The lock shell 1 has a lock shell fixing plate 10 and the lock cover 2 has a flange 26(*a*). The fixing plate 10 has two lock shell fixing holes 10(*a*) and the flange 26(*a*) has two fastening screw holes 261, which correspond to the lock shell fixing holes 10(*a*). The shell fixing plate 10 is fixed with the flange 26(*a*) by a bolt through the corresponding holes 10(*a*) and 261. A dovetail block 27 is extending from the lock cover 2. The lock shell 2 is inserted into the slide via the dovetail block 27. The lock tongue actuator rod 314 has a cut 319 thereon for blocking a firing pin A6.

When the handgun A is locked, the lock tongue actuator rod 314 is in the initial state, where the lock tongue actuator rod 314 extends out through the lock tongue extending hole 28. The lock tongue actuator rod 314 blocks the space between the firing pin A6 and a bullet (as shown in FIG. 1.71, FIG. 1.72, the firing pin A6 is behind the lock tongue actuator rod 314, thus not shown therein). Even if the firing pin A6 has the energy to rush towards the bullet, the strike action will only reach the lock tongue actuator rod 314, but will not reach to the bullet, so the bullet cannot be fired.

When the handgun A is in use, the electromagnet 5(*f*) may be electrified for 10~100 ms, and obtain a current to generate a sufficient magnet pole for attracting the permanent magnet 30. The permanent magnet 30 will, then, overcome the elastic force of the lock tongue spring 4. The lock tongue spring 4 is, thus, compressed by the spring plate 32 due to the force of the permanent magnet 30 and the electromagnet 5(*f*). And the lock tongue actuator rod 314 is retracted and locates in the lock tongue slot 112.

As shown in FIG. 1.82, the lock tongue actuator rod 314 retracts back. The firing pin A6 is not blocked by the lock tongue actuator rod 314 and can hit the bullet without barrier. The gun A can, therefore, be fired.

A current to the electromagnet 5(*f*) may be initiated by a current driver (not shown) which may be controlled by a controller (not shown).

If the controller (not shown) detected an abnormal condition while the handgun A is in use, for example, the controller (not shown) may work on the current driver (not shown) on the handgun A, such that the electromagnet 5(*f*) will instantly get electrified reversely for 10~100 ms to drive the reverse current, thus producing a magnetic pole that is the same as the magnetic pole of the permanent magnet 30 in order to produce a magnetic repulsion force. The electromagnet 5(*f*) may, optionally, be sufficiently electrified reversely to produce a stronger magnetic repulsion force. The lock tongue actuator rod 314, then, is pushed out instantly by the repulsive force exerted with the lock tongue spring 4 and/or the magnetic repulsion, for example, within 150 ms from when the controller detected the condition for locking the firing sequence. The lock tongue actuator rod 314 blocks the space between the firing pin A6 and the bullet (not shown), as shown in FIGS. 1.71 and 1.72, and the firing pin A6 is blocked by the lock tongue actuator rod 314.

Second Preferred Embodiment

Referring to FIGS. 2.1 to 2.82, according to a second preferred embodiment of the present invention, it provides an automatic spring-type lock mechanism C2, which is disposed at a position B7 adjacent to the hammer A5 on the slide A4 of the handgun A.

The automatic spring-type lock mechanism C2 comprises a lock tongue actuator 3*a* that blocks the space B10 between the firing pin A6 and the hammer A5 with a lock tongue actuator rod 314*a* as shown in FIGS. 2.71 and 2.72.

The structure of the lock core and lock shell 1*a* of the lock mechanism C2 are similar to those of the lock mechanism C1 as shown in FIGS. 1.1 to 1.82.

The lock mechanism C2 comprises a lock cover 2*a*, which has two symmetrical side plates: a first lock cover side plate 29*a* and a second lock cover side plate 29*a*(*a*). The distance between the first lock cover side plate 29*a* and the second lock cover side plate 29*a*(*a*) substantially corresponds to or matches with the width of the slide end adjacent to the hammer A5. A lock tongue extending hole 28*a* and a magnet slot 282*a* locate on the first lock cover side plate 29*a*. The lock tongue extending hole 28*a* is adjacent to the magnet slot 282*a*. The front end of the lock tongue actuator rod 314*a* extends out through or retracts into the lock tongue extending hole 28*a*, and the permanent magnet 30*a* movably engages with the magnet slot 282*a*. The lock tongue positioning slot 281*a* on the second lock cover side plate 29*a*(*a*) corresponds to lock tongue extending hole 28*a*.

The lock mechanism C2 includes the lock cover 2*a*, the lock shell 1*a*, and the lock tongue actuator 3*a*. The magnet slot 282*a* and a lock tongue extending hole 28*a* are located on the lock cover 2*a*, and the magnet slot 282*a* corresponds to the permanent magnet 30*a*. The lock tongue slot 112*a* and the electromagnet installing slot 113*a* on the lock shell 1*a* correspond to the lock tongue extending hole 28*a* and the magnet slot 282*a* on the lock cover 2*a*.

The lock tongue actuator 3*a* actuates a lock tongue actuator rod or a bar member 314*a*, the lock tongue actuator 3*a* comprises the permanent magnet 30*a*, the lock tongue actuator rod 314*a*, a spring 4*a*, and an electromagnet 5*a*(*f*). The permanent magnet 30*a* is disposed at one end of the lock tongue actuator rod 314*a* at the lock shell 1*a*. The electromagnet 5*a*(*f*) is disposed to correspond to the permanent magnet 30*a*. The electromagnet 5*a*(*f*) is disposed at one end of the electromagnet installing slot 113*a* at the lock shell 1*a*, and the permanent magnet 30*a* is movably disposed in the electromagnet installing slot 113*a*. The lock tongue actuator rod 314*a* operably extends out of or retracts in the lock tongue extending hole 28*a*.

There are mounting screw holes 93*a* corresponding to lock shell 1*a* on the first lock cover side plate 29*a*. The lock shell 1*a* is screwed on the first lock cover side plate 29*a*. There are corresponding mounting screws 92*a* on the first lock cover side plate 29*a* and the second lock cover side plate 29*a*(*a*) in order to mount/affix these two components at the rear of the handgun A. The lock tongue actuator rod 314*a* has, preferably, a cylindrical structure, however, the structure of the lock tongue actuator rod 314*a* may be in other shapes, as long as it facilitates blocking the hammer A5 from striking the firing pin A6 as described below.

When the handgun A is not in use, the lock tongue actuator rod 314*a* is normally in the state of extending out through the lock tongue extending hole 28*a*, and the lock tongue actuator rod 314*a* blocks the space B10 between the firing pin A6 and the hammer A5 as shown in FIG. 2.4, FIG. 2.71, FIG. 2.72. Accordingly, when the hammer A5 acts to strike the firing pin A6, the lock tongue actuator rod 314*a* prevents the hammer A5 from hitting the firing pin A6.

When the gun is in use, as shown in FIG. 2.5, the electromagnet 5*a*(*f*) is electrified for 10~100 ms, and obtains a current, thus producing a magnet pole attracting the permanent magnet 30*a* in a sufficient force, such that the permanent magnet 30*a* will overcome the elastic force exerted by the lock tongue spring 4*a*. The lock tongue spring 4*a* is compressed by the spring plate 32*a* due to the force of the permanent magnet 30*a* and the electromagnet 5*a*(*f*) as the permanent magnet 30*a* and the electromagnet 5*a*(*f*) are pulled in together (it is unnecessary to electrify the solenoid this stage). The lock tongue actuator rod 314*a* is retracted into the lock tongue slot 112*a*. As shown in FIGS. 2.5, 2.81 and 2.82, the lock tongue actuator rod 314*a* is retracted, such that the hammer A5 is not being blocked by the lock tongue actuator rod 314*a*, and, thus the hammer A5 would be able to hit the firing pin A6. Accordingly, the handgun A can be fired. A current to the electromagnet 5*a*(*f*) may be initiated by a current driver (not shown) which may be controlled by a controller (not shown).

If the controller (not shown) detects an abnormal condition while the handgun A is in use, for example, the controller (not shown) may work on the current driver (not shown) on the handgun A, such that the electromagnet 5*a*(*f*) will instantly get electrified reversely for 10~100 ms, with a reverse current, for producing a magnetic pole repelling the permanent magnet 30*a* to produce a sufficient magnetic repulsion. The lock tongue actuator rod 314*a* is rushed out by the repulsive force with the force exerted by the lock tongue spring 4*a* and/or the magnetic repulsion, for example, within 150 ms from when the controller detected the condition for locking the firing sequence. The lock tongue actuator rod 314*a* moves to lock tongue positioning slot 281*a*, blocks the space B10 between the firing pin A6 and the hammer A5. The hammer A5 is now blocked from striking the firing pin A6 by the lock tongue actuator rod 314*a*.

Third Preferred Embodiment

Referring to FIGS. 3.1 to 3.82, according to a third preferred embodiment of the present invention, it provides an automatic spring-type lock mechanism C3, which is disposed at the grip A7 of a gun A, in which a lock tongue actuator 3*b* blocks the trigger A2 at the rear side of the trigger A2 with a lock tongue actuator rod 314*b*. The structure of the lock mechanism C3 is similar to those of the lock mechanisms C1 and C2.

The automatic spring-type lock mechanism C3 comprises a lock shell 1*b*, which is box-shaped. The lock shell $\mathbf{1}_b$ includes a lock core cavity 11*b* and a lock cover frustum 21*b*(*a*). The lock core cavity 11*b* includes a lock tongue slot 112*b* and an electromagnet installing slot 113*b*. The lock cover 2*b* has a lock tongue extending hole 28*b*, a lock cover slot 21*b*. A lock tongue extending hole 28*b* corresponds to the lock tongue slot 112*b* on the lock cover 2*b*, and a lock cover slot 21*b* corresponds to the lock cover frustum 21*b*(*a*).

The lock tongue actuator rod 314*b* and lock tongue spring 4*b* locates in the lock tongue slot 112*b*, the lock tongue actuator rod 314*b* extends out of the lock tongue extending hole 28*b*, the permanent magnet 30*b* and the electromagnet 5*b*(*f*) is disposed at one end of the electromagnet installing slot 113*b*, at the lock shell 1*b*.

The lock mechanism C3 has a clamp 7*b* fixed on the side wall of the lock shell 1*b*. The clamp 7*b* has a screw fastening hole 75*b* and a special screw 77*b* (as shown in FIG. 3.5, FIG. 3.6, FIG. 3.7). The clamp 7*b* matches the grip A7 and is fastened to the grip A7 (as shown in FIGS. 3.1, 3.2, 3.3, 3.81, and 3.82).

When the handgun A is in use, the electromagnet 5*b*(*f*) is electrified for 10~100 ms, to generate a magnet pole attracting the permanent magnet 30*b* in a sufficient force, such that the permanent magnet 30*b* overcomes the elastic force of the lock tongue spring 4*b*. The lock tongue spring 4*b* is, then, compressed by the spring plate 32*b* due to the force of the permanent magnet 30*b* and the electromagnet 5*b*(*f*) as the permanent magnet 30*b* and electromagnet 5*b*(*f*) are pulled in together. And the lock tongue actuator rod 314*b* is retracted and locates in the lock tongue slot 112*b*. The trigger A2 is not blocked by the lock tongue actuator rod 314*b* and can be pulled to fire the gun A. The current to the electromagnet 5*b*(*f*) may be initiated by a current driver (not shown) which may be controlled by a controller (not shown).

If the controller (not shown) detects an abnormal condition while the handgun A is in use, for example, the controller (not shown) may work on the current driver (not shown) on the handgun A, such that the electromagnet 5*b*(*f*) will instantly get electrified reversely for 10~100 ms, and to drive the reverse current, thus producing a magnetic pole same to the permanent magnet 30*b* to produce a sufficient magnetic repulsion. The lock tongue actuator rod 314*b*, then, is pushed out instantly by the repulsive force exerted by the lock tongue spring 4*b* and/or the magnetic repulsion, for example, within 150 ms from when the controller detected the condition for locking the firing sequence. The lock tongue actuator rod 314*b*, thus, blocks the trigger A2 from being pulled.

The automatic spring-type lock mechanism C3 may be used for a portable long-barrelled firearm A' or alike as shown in FIGS. 3.81 and 3.82. The automatic spring-type lock mechanism C3 is disposed in such a manner to interact with a trigger A'2 thereof.

Fourth Preferred Embodiment

Referring to FIGS. 4.1 to 4.62, according to a forth preferred embodiment of the present invention, it provides an automatic spring-type lock mechanism C4, which is disposed at the grip A7 of the handgun A. The lock mechanism C4 comprises a lock tongue actuator 3*c*, which is operable to block or release a trigger A2 of the handgun A with a lock tongue actuator rod 314*c* at the rear side thereof.

The basic structure of the present embodiment is similar to the one shown for C3, and the lock core and the structure of the lock cover 2*c* are similar to the structure shown for C3, except for the installation.

The lock mechanism C4 includes a lock cover fastening end 26*c*, a lock tongue extending hole 28*c* and a guide frustum 28*c*(*a*). The lock cover fastening end 26*c* has mounting screw holes 93*c* (as shown in FIG. 4.3, FIG. 4.4, FIG. 4.5, FIG. 4.61, FIG. 4.62). The back side of the lock cover 2*c* is a lock cover slot 21*c*. The front end of the lock shell 1*c* has a lock cover frustum 21*c*(*a*) corresponding to the lock cover slot 21*c* of the lock cover 2*c*. The lock cover frustum 21*c*(*a*) is inserted into the lock cover slot 21*c* of the lock cover 2*c*. The lock tongue slot 112*c* in the lock shell 1*c* is connected with the lock tongue extending hole 28*c* on the lock cover 2*c*.

The lock mechanism C4 is fixed on the grip A7 at the rear of the trigger A2 by mounting screw holes 93*c* on the fastening end 26*c* of the lock cover 2*c*.

Operation of the lock mechanism C4 is similar to that of C3. When the handgun A is in use, the electromagnet 5*c*(*f*) is electrified for 10~100 ms, and obtains a current, generates a magnet pole attracting the permanent magnet 30*c*. The permanent magnet 30*c* will overcome the elastic force from the lock tongue spring 4*c*. The lock tongue spring 4*c* is compressed by the spring plate 32*c* due to the force of the permanent magnet 30*c* and electromagnet 5*c*(*f*). And the lock tongue actuator rod 314*c* is retracted and locates in the lock tongue slot 112*c*. The lock tongue actuator rod 314*c*, which blocks the trigger A2, retracts back. The trigger A2 is not blocked by the lock tongue actuator rod 314*c* and can be pulled. The current to the electromagnet 5*c*(*f*) may be initiated by a current driver (not shown) which may be controlled by a controller (not shown).

If the controller (not shown) detects an abnormal condition while the handgun A is in use, for example, the controller (not shown) may work on the current driver (not shown) on the handgun A, such that the electromagnet 5*c*(*f*) will instantly get electrified reversely for 10~100 ms, and to drive the reverse current, thus producing a magnetic pole same to the permanent magnet 30*c* to produce a sufficient magnetic repulsion. The lock tongue actuator rod 314*c*, then, is pushed out instantly by the repulsive force exerted by the lock tongue spring 4*c* and/or the magnetic repulsion, for example, within 150 ms from when the controller detected the condition for locking the firing sequence. The lock tongue actuator rod 314*c*, thus, blocks the trigger A2 from being pulled.

The lock mechanism C4 may be used for a portable long-barrelled firearm A' or alike as shown in FIGS. 4.61 and 4.62. The lock mechanism C4 is disposed in such a manner to interact with a trigger A'2 thereof.

Fifth Preferred Embodiment

Referring to FIGS. 5.1 to 5.62, according to a fifth preferred embodiment of the present invention, it provides an automatic spring-type lock mechanism C5, which is disposed at the trigger guard A3, a lock tongue actuator 3*d* is operable to block or release at the rear of the trigger A2 of a handgun A with a lock tongue actuator rod 314*d*.

The basic structure of the lock mechanism C5 is similar to that of C3, and the lock core and the structure of a lock cover 2*d* are similar to C4. (The lock mechanisms C3, C4 and C5 are based on the same principle, however, differ in that where and how they are installed).

The lock mechanism C5 comprises the lock cover 2*d*, including a lock cover slot 21*d*, a lock tongue extending hole 28*d*, and the second clamp slot 22*d* for clamping at trigger guard A3. Corresponding to the second trigger guard clamp 22*d* is the clamping plate 7*d*, which operates together with the second trigger guard clamp 22*d*. The second trigger guard clamp 22*d* and the clamping plate 7*d* cooperates to clamp on the trigger guard A3. (FIG. 5.1, FIG. 5.2, shown).

The front end of the lock shell 1*d* has a lock cover frustum 21*d*(*a*) corresponding to the lock cover slot 21*d*. The lock cover frustum 21*d*(*a*) is inserted into the lock cover slot 21*d* of the lock cover 2*d*. The lock tongue slot 112*d* in the lock shell 1*d* is connected with the lock tongue extending hole 28*d* of the lock cover 2*d* (as shown in FIG. 5.3, FIG. 5.4, FIG. 5.5).

The lock mechanism C5 is fixed to the trigger guard A3 through the second trigger guard clamp 22*d* and the clamping plate 7*d* (as shown in FIG. 5.1, FIG. 5.61, FIG. 5.62).

Operation of the lock mechanism C5 is similar to that of C4. When the handgun A is in use, the electromagnet 5*d*(*f*) is electrified for 10~100 ms, and obtains a current, generates a magnet pole attracting the permanent magnet 30*d*. The permanent magnet 30*d* will overcome the elastic force from the lock tongue spring 4*d*. The lock tongue spring 4*d* is compressed by the spring plate 32*d* due to the force of the permanent magnet 30*c* and electromagnet 5*d*(*f*). And the lock tongue actuator rod 314*d* is retracted and locates in the lock tongue slot 112*d*. The lock tongue actuator rod 314*d*, which blocks the trigger A2, retracts back. The trigger A2 is not blocked by the lock tongue actuator rod 314*d* and can be pulled. The current to the electromagnet 5*d*(*f*) may be initiated by a current driver (not shown) which may be controlled by a controller (not shown).

If the controller (not shown) detected an abnormal condition while the handgun A is in use, for example, the controller (not shown) may work on the current driver (not shown) on the handgun A, such that the electromagnet 5*d*(*f*) will instantly get electrified reversely for 10~100 ms, and to drive the reverse current, thus producing a magnetic pole same to the permanent magnet 30*d* to produce a sufficient magnetic repulsion. The lock tongue actuator rod 314*d*, then, is pushed out instantly by the repulsive force exerted by the lock tongue spring 4*d* and/or the magnetic repulsion, for example, within 150 ms from when the controller detected the condition for locking the firing sequence. The lock tongue actuator rod 314*d*, thus, blocks the trigger A2 from being pulled.

The lock mechanism C5 may be used for a portable long-barrelled firearm A' or alike as shown in FIGS. 5.61 and 5.62. The automatic spring-type lock mechanism C5 is disposed in such a manner to interact with a trigger A'2 thereof.

Sixth Preferred Embodiment

Referring to FIGS. 6.1 to 6.72, according to a sixth preferred embodiment of the present invention, it provides an automatic spring-type lock mechanism C6, which is disposed at the position B9, which is about or is adjacent to the front end of the firing pin A6 on the slide A4 of the handgun A.

The lock mechanism C6 includes a lock cover 2*e*, a lock shell 1*e*, a lock tongue actuator 3*e*. A lock core cavity 11*e* is in the lock shell 1*e*. A lock core cavity 11*e* includes a spring slot 118*e*, a lock tongue slot 112*e* and an electromagnet installing slot 113*e*. The lock tongue slot 112*e* locates between the spring slot 118*e* and the electromagnet installing slot 113*e*. The spring slot 118*e* is connected with the electromagnet installing slot 113*e* through the lock tongue slot 112*e*. The lock tongue actuator 3*e* includes a lock tongue actuator rod 314*e*, a spring plate 32*e*, a permanent magnet 30*e*. The lock tongue actuator rod 314*e* may be square, and the spring plate 32*e* and the permanent magnet 30*e* connect both sides of the lock tongue actuator rod 314*e*, respectively, forming a crossing with the lock tongue actuator rod 314*e*. The electromagnet 5*e*(*f*) is disposed at one end of the electromagnet installing slot 113*e* at the lock cover 2*e*. The lock tongue spring 4*e* is disposed between the spring plate 32*e* and the lock cover 2*e* in the spring slot 118*e*. The lock tongue actuator rod 314*e* is located in the lock tongue slot 112*e*. The lower part of the lock shell 1*e* has a lock tongue hole 119*e*, and the lower end of the lock tongue actuator rod

314*e* is located within the lock tongue hole 119*e* or extends out from the lock tongue hole 119*e* (FIG. 6.4, FIG. 6.5). The permanent magnet 30*e* is able to slide within the electromagnet installing slot 113*e*. The lock tongue spring 4 and the spring plate 32*e* are set in the spring slot 118*e*. The lock cover 2*e* is fixed on the upper part of the lock shell 1*e*.

The lock shell 1*e* is provided with two mounting plates 13*e*. The distance between the two mounting plates 13*e* and the gun body width at the installation point is matched. The mounting screw holes 93*e* is locate on the mounting plates 13*e*, and the mounting plates 13*e* is mounted at the position B9, which is adjacent with the front end of the firing pin A6 on the slide A4 of the handgun A.

When the handgun A is not in use, the lock tongue actuator rod 314*e* extends out of the lock tongue hole 119*e*, and the lock tongue actuator rod 314*e* is straight down and blocks the space B12 between the firing pin A6 and the bullet (see FIG. 6.4, FIG. 6.6, FIG. 6.71, FIG. 6.72). Therefore, even if the firing pin A6 has the energy to rush to the bullet, it will only hit the lock tongue actuator rod 314*e*, but not the bullet. So, the handgun A cannot be fired.

When the electromagnet 5*e*(*f*) is electrified for 10~100 ms, and obtains a, thus producing a magnet pole attracting the permanent magnet 30*e*. The permanent magnet 30*e* will overcome the elastic force exerted by the lock tongue spring 4*e*. The lock tongue spring 4*e* is compressed by the spring plate 32*e* due to the force of the permanent magnet 30*e* and electromagnet 5*e*(*f*), and the lock tongue actuator rod 314*e* is retracted back and locates in the lock tongue hole 119*e*. As shown in FIGS. 6.5, 6.71 and 6.72, the lock tongue actuator rod 314*e*, which blocks the firing pin A6, retracts back. The firing pin A6 is not blocked by the lock tongue actuator rod 314*e*, and it can hit the bullet without barrier. According, the gun can be fired. The current to the electromagnet 5*e*(*f*) may be initiated by a current driver (not shown) which may be controlled by a controller (not shown).

If the controller (not shown) detects an abnormal condition while the handgun A is in use, for example, the controller (now shown) may work on the current driver (not shown) on the handgun A, such that the electromagnet 5*e*(*f*) will instantly get electrified reversely for 10~100 ms, and instantaneously get the reverse current, produces a magnetic pole repelling the permanent magnet 30*e*, and then it produces a sufficient magnetic repulsion. The lock tongue actuator rod 314*e* is pushed out instantly by the repulsive force exerted by the lock tongue spring 4*e* and/or the magnetic repulsion as shown in FIG. 6.4, FIG. 6.61 and FIG. 6.62. The firing pin A6 is blocked by the lock tongue actuator 3*e*, so the bullet cannot be hit, and the gun cannot be fired.

Seventh Preferred Embodiment

Referring to FIGS. 7.1 to 7.81, according to a seventh preferred embodiment of the present invention, it provides an automatic spring-type lock mechanism C7, which is mounted on the position B8 corresponding to firing pin circular slot B11 of the gun slide A4 on the handgun A.

The lock mechanism C7 includes a lock cover 2*f*, a lock shell 1*f*, and a lock tongue actuator 3*f*, including a lock tongue actuator rod 314*f*, a spring plate 32*f*, a permanent magnet 30*f*, a lock tongue spring 4*f*, and an electromagnet 5*f*(*f*).

The lock mechanism C7 is similar to that of C6. The lock tongue actuator rod 314*f* has a semicircular fork 318*f*. When the handgun A is not in use, the lock tongue actuator rod 314*f* extends out from the lock tongue hole 119*f*. The semicircular fork 318*f* of the lock tongue actuator rod 314*f* blocks the firing pin A6 at the firing pin circular slot B11 (as shown in FIG. 7.4, FIG. 7.61, FIG. 7.62, FIG. 7.81, FIG. 7.82). Even if the hammer A5 hits the firing pin A6, and even if the firing pin A6 would rush towards the bullet, the hammer A5 would only strike the semicircular fork 318*f* (thus the firing pin A6 is blocked from the hammer A5 by the semicircular fork 318*f*), and, thus, the bullet cannot be hit and the handgun A cannot be fired. The function of keeping the gun safe when the gun is not in use is realized.

When the handgun A is normally in use, as shown in FIGS. 7.5 and 7.71, the electromagnet 5*f*(*f*) is electrified for 10~100 ms, and obtains a current, thus producing a magnet pole attracting the permanent magnet 30*f*. The permanent magnet 30*f* will overcome the elastic force exerted by the lock tongue spring 4*f*. The lock tongue spring 4*f* is compressed by the spring plate 32*f* due to the force of the permanent magnet 30*f* and electromagnet 5*f*(*f*), and the lock tongue actuator rod 314*f* is retracted back and locates in the lock tongue hole 119*f*. As shown in FIGS. 7.5 and 7.72, the lock tongue actuator rod 314*f* retreats back from the firing pin circular slot B11 of the firing pin A6. Without the blocking of the lock tongue actuator rod 314*f*, the firing pin A6 can hit the bullet barrier free. The handgun A can be fired. The current to the electromagnet 5*f*(*f*) may be initiated by a current driver (not shown) which may be controlled by a controller (not shown).

If the controller (not shown) detects an abnormal condition while the handgun A is in use, for example, the controller (not shown) may work on the current driver (not shown) on the handgun A, such that the electromagnet 5*f*(*f*) will instantly get electrified reversely for 10~100 ms, and instantaneously get the reverse current, thus producing a magnetic repelling the permanent magnet 30*f*, and then it produces a sufficient magnetic repulsion. The lock tongue actuator rod 314*f* is pushed out instantly by the repulsive force exerted by the lock tongue spring 4*f* and/or the magnetic repulsion within 150 ms (as shown in FIG. 7.4, FIG. 7.61, 7.62) from when the controller detected the condition for locking the firing sequence. The firing pin circular slot B11 is blocked by the semicircular fork 318*f* on the lock tongue actuator rod 314*f* and the firing pin A6 cannot reach to the bullet.

Eighth Preferred Embodiment

Referring to FIGS. 8.1 to 8.82, according to an eighth preferred embodiment of the present invention, it provides an automatic spring-type lock mechanism C8, which is disposed at the end of the slide A4, which is adjacent with the hammer B7. The lock tongue actuator 3*g* corresponds the position B10 between the firing pin A6 and the hammer A5.

The structure of the lock mechanism C8 is similar to that of C6, except for its installation position.

The lock mechanism C8 is disposed on the end of the slide A4, which is adjacent with the hammer A5. The basic structure of the lock mechanism C8 is the same as that of C1, which includes a lock cover 2*g*, a lock shell 1*g*, and a lock tongue actuator 3*g*, including a lock tongue actuator rod 314*g*, a spring plate 32*g*, a permanent magnet 30*g*, a lock tongue spring 4*g* and an electromagnet 5*g*(*f*).

In this embodiment, two mounting plates 13*g* on the lock shell 1*g* are lengthened, comparing them with those of C7. The width between the two mounting plates 13*g* and the position where the gun mounted are matched. The lock tongue hole 119*g* is set at the bottom of the lock tongue slot 112*g* (as shown in FIG. 8.3, FIG. 8.4, FIG. 8.5, and FIG. 8.6, respectively). The electromagnet 5g(f) is mounted on the upper end of the electromagnet installing slot 113g (see FIG. 8.5).

When the gun is not in use, the lock tongue actuator rod 314g extends out of the lock tongue hole 119g, and the lock tongue actuator rod 314g blocks the space B10 between the firing pin A6 and hammer A5 (as shown in FIG. 8.1, FIG. 8.5, FIG. 8.71/8.72). The size or diameter of the lock tongue actuator rod 314g is sufficiently large to cover the firing pin A6 to keep the hammer A5 from striking the firing pin A6. So even when the hammer A5 strikes, the hammer A5 will only hit the lock tongue actuator rod 314g and will not hit the firing pin A6. The function of keeping the gun safe when the handgun A is not in use is realized.

When the handgun A is normally in use and there is no emergency situation exists, as shown in FIG. 8.6, the electromagnet 5g(f) is electrified for 10~100 ms, and obtains a current, thus producing a magnet pole attracting the permanent magnet 30g. The permanent magnet 30g will overcome the elastic force exerted by the lock tongue spring 4g. The lock tongue spring 4g is compressed in a spring slot 118g by the spring plate 32g due to the force of the permanent magnet 30g and electromagnet 5g(f) (it is unnecessary to electrify the solenoid continuously for an extended period of time), and the lock tongue actuator rod 314g is retracted and locates in the lock tongue hole 119g. As shown in FIGS. 8.5-8.82, the lock tongue actuator rod 314g, which blocks the hammer A5, retracts back. The hammer A5 is not blocked by the lock tongue actuator rod 314g and can strike the filing pin A6, thus, the gun A can be fired. The current to the electromagnet 5g(f) may be initiated by a current driver (not shown) which may be controlled by a controller (not shown).

If the controller (not shown) detects an abnormal condition while the handgun A is in use, for example, the controller (not shown) may work on the current driver (not shown) on the handgun A, such that the electromagnet 5g(f) will instantly get electrified reversely for 10~100 ms, and instantaneously get the reverse current, thus producing a magnetic pole repelling the permanent magnet 30g, and then it produces a sufficient magnetic repulsion. The lock tongue actuator rod 314g is pushed out instantly by the repulsive force exerted by the lock tongue spring 4g and/or the magnetic repulsion within 150 ms from when the controller detected the condition for locking the firing sequence. The lock tongue actuator rod 314g extends and blocks the space B10 between the firing pin A6 and the hammer A5 as shown in FIGS. 8.71 and 8.72. The hammer A5 is blocked by the lock tongue, thus the gun cannot be fired.

Ninth Preferred Embodiment

Referring to FIGS. 9.1 to 9.62, according to a ninth preferred embodiment of the present invention, it provides a gear-type trigger lock mechanism C9 for a firearm or alike.

The lock mechanism C9 includes a lock shell 1h, a lock cover 2h and a lock tongue actuator 3h, including a motor 5h(b), a driving gear 5h(d), an idler gear and/or gear set 5h(e) and a bar member 314h. The lock cover 2h has a motor placement slot 25h inside. The motor placement slot 25h receives the motor 5h(b), and the drive shaft of motor 5h(b) is connected with the driving gear 5h(d). The lock shell 1h and/or the lock cover 2h have a lock cylinder cavity 11h, which includes a gear mounting cavity 116h and a lock tongue slot 112h. The driving gear 5h(d) locates inside the gear mounting cavity 116h. The bar member 314h is mounted in lock tongue slot 112h, and the driving gear 5h(d) is engaged with the rack 316h.

When the center distance between the driving gear 5h(d) and the rack 316h is too short (i.e. the drive gear and the rack cannot be engaged), the idler gear and/or gear set 5h(e) can be added to increase the center distance. The driving gear 5h(d) is engaged with the idler gear and/or gear set 5h(e) and the idler gear and/or gear set 5h(e) is engaged with the rack 316h of the bar member 314h. The lock shell 1h or the lock cover 2h has an idler shaft 117h, and the idler gear and/or gear set 5h(e) is rotated with respect to the axis of the idler shaft 117h. The number of idler gear and/or gear set can be adjusted/changed according to center distance(s), rotation direction(s), and/or shifting(s).

A first part of the bar member 314h has a stroke slot 315h, a first half part of the bar member 314h corresponding to the driving gear 5h(d) is the rack 316h, and a second half of the bar member 314h is a mounting surface 317h. The mounting surface 317h is matched with and mounted inside the lock tongue slot 112h, and the bar member 314h moves towards the direction of the lock tongue slot 112h.

The stroke limiter 20h (a cylinder limits the position the bar member 314h) corresponding to the stroke slot 315h of the bar member 314h is set within the lock shell 1h or the lock cover 2h. The limiter locates within the stroke slot 315h.

The lock cover 2h has a mounting base 7h(b), and the mounting base 7h(b) is disposed on the outer side of the motor placement slot 25h. The mounting base 7h(b) has mounting holes, and the gear-type lock mechanism C9 mechanism is mounted on the gun grip A7 via the mounting base 7h(b). A lock hole is provided on the trigger guard A3. The bar member 314h can extend through the lock hole in the trigger guard A3 when it protrudes. The bar member 314h passes through the lock hole and locates at the rear of the trigger A2. The bar member 314h blocks the backward stroke of the trigger A2 so that the trigger A2 cannot be pulled and the gun cannot be fired. This achieves the function of locking firearms when they are not in use.

When the gun is used normally, the motor 5h(b) is positively electrified for 10 to 100 ms, and the motor 5h(b) begins to rotate for driving the driving gear 5h(d) and the idler gear and/or gear set 5e to retract the bar member 314h into the lock tongue slot 112h. The bar member 314h retracts from the rear side of the trigger A2, then the motor 5h(b) does not need to be electrified. The backward stroke of the trigger A2 is not blocked and the gun is unlocked.

When an abnormal condition(s) is detected, the motor 5h(b) is electrified reversely for 10~100 ms, and the motor 5b starts to rotate the driving gear 5h(d) and the idler gear and/or gear set 5h(e) to extend the bar member 314h out from the lock tongue slot 112h. The bar member 314h moves to the rear side of the trigger A2, then the motor 5h(b) does not need to be electrified. The backward stroke of the trigger A2 is blocked and the gun is locked.

The gear-type trigger lock C9 may be used for a portable long-barrelled firearm A' or alike as shown in FIGS. 9.61 and 9.62. The gear-type trigger lock C9 is disposed in such a manner to interact with a trigger A'2 thereof.

Tenth Preferred Embodiment

Referring to FIGS. 10.1 to 10.72, according to a tenth embodiment of the present invention, it provides a gear-type trigger lock mechanism C10, which includes a lock shell 1i, a lock cover 2i and a lock tongue actuator 3i, including a motor 5i(b), a driving gear 5i(d), an idler gear and/or gear set 5*i*(*e*), and a bar member 314*i*. The lock cover 2*i* has a motor placement slot 25*i* inside. The motor placement slot 25*i* receives the motor 5*i*(*b*), and the drive shaft of motor 5*i*(*b*) is connected with a driving gear 5*i*(*d*). The lock shell 1*i* and/or the lock cover 2*i* have a lock cylinder cavity 11*i*, which includes a gear mounting cavity 116*i* and a lock tongue slot 112*i*. The driving gear 5*i*(*d*) locates inside the gear mounting cavity 116*i*. The bar member 314*i* is mounted in lock tongue slot 112*i*, and the driving gear 5*i*(*d*) is engaged with the rack 316*i* of the bar member 314*i*.

When the center distance between the driving gear 5*i*(*d*) and the rack 316*i* is too short (i.e. the drive gear and the rack cannot be engaged), the idler-wheel 5*i*(*e*) can be added to increase the center distance. The driving gear 5*i*(*d*) is engaged with the idler gear and/or gear set 5*i*(*e*) and the idler gear and/or gear set 5*i*(*e*) is engaged with the rack 316*i* of the bar member 314*i*. The lock shell 1*i* or the lock cover 2*i* has an idler shaft 117*i*, and the idler gear and/or gear set 5*i*(*e*) is rotated with respect to the axis of the idler shaft 117*i*. The number of idler gear and/or gear set can be adjusted/changed according to center distance(s), rotation direction(s), and/or shifting(s).

A first part of the bar member 314*h* has a stroke slot 315*i*, a first half part of the bar member 314*i* corresponding to the driving gear 5*i*(*d*) is the rack 316*i*, and a second half of the bar member 314*i* is a mounting surface 317*i*. The mounting surface 317*i* is matched with and mounted inside the lock tongue slot 112*i*, and the bar member 314*i* moves towards the direction of the lock tongue slot 112*i*.

The stroke limiter 20*i* (a cylinder limits the position of the bar member 314*i*) corresponding to the stroke slot 315*i* of the bar member 314*i* is set within the lock shell 1*i* or the lock cover 2*i*. The limiter locates within the stroke slot 315*i*.

The lock mechanism C10 is mounted on the grip A7 of the handgun A. The structure of the lock shell 1*i*, the driving gear 5*i*(*d*), the idler gear and/or gear set 5*i*(*e*), the shape and the installation of the bar member 314*i* are all the same as those of the lock mechanism C9, except for the installation position of the lock mechanism C10. While the shapes and structures of the lock shell 2*i* is different from those previously shown in the lock mechanism C9.

The other side of the motor placement slot 25*i* stretches out of the mounting base 7*i*(*b*) and is attached to the clamp 7*i*. The shape of U-shaped clamp 7*i* matches the handgun A. The clamp 7*i* is fixed with the mounting base 7*i*(*b*) via the clamp connection plate 74*i*. The U-shaped clamp 7*i* is fastened to the grip A7 of the handgun A by fastening means, such as screws. The bar member 314*i* locates on the side of the trigger A2. The bar member 314*i* extends to the rear side of the trigger A2. Then the bar member 314*i* blocks the backward stroke of the trigger A2, so that the trigger A2 cannot be pulled and the gun cannot be fired. The function of locking the trigger when the gun is not in use can be realized.

When the gun is normally used, the motor 5*i*(*b*) is positively electrified for 10 to 100 milliseconds, and the motor 5*i*(*b*) begins to rotate and drives the driving gear 5*i*(*d*) the idler gear and/or gear set 5*i*(*e*), and to retract the bar member 314*i* in the lock tongue slot 112*i*. The bar member 314*i*, which locates in the lock shell 1*i*, retracts from the rear side of the trigger A2, then the motor 5*i*(*b*) does not need to be electrified. The backward stroke of the trigger A2 is not blocked (released) and the trigger A2 is free to be pulled to fire the gun.

The lock mechanism C10 may be used for a portable long-barrelled firearm A' or alike as shown in FIGS. 10.71 and 10.72. The lock mechanism C10 is disposed in such a manner to interact with a trigger A'2 thereof.

Eleventh Preferred Embodiment

Referring to FIGS. 11.1 to 11.72, according to an eleventh preferred embodiment of the present invention, it provides a gear-type trigger lock mechanism C11, which includes a lock shell 1*j*, a lock cover 2*j* and a lock tongue actuator 3*j*, including a motor 5*j*(*b*), a driving gear 5*j*(*d*), an idler gear and/or gear set 5*j*(*e*), and a bar member 314*j*. The lock cover 2*j* has a motor placement slot 25*j* inside. The motor placement slot 25*j* receives the motor 5*j*(*b*), and the drive shaft of motor 5*j*(*b*) is connected with a driving gear 5*j*(*d*). The lock shell 1*j* and/or the lock cover 2*j* has a lock cylinder cavity 11*j*, which includes a gear mounting cavity 116*j* and a lock tongue slot 112*j*. The driving gear 5*j*(*d*) locates inside the gear mounting cavity 116*j*. The bar member 314*j* is slidably mounted on a lock tongue slot 112*j*, and the driving gear 5*j* (*d*) is engaged with the rack 316*j* of the bar member 314*j*.

When the center distance between the driving gear 5*j*(*d*) and the rack 316*j* is too short (i.e. the drive gear and the rack cannot be engaged), the idler-wheel 5*j*(*e*) can be added to increase the center distance. The driving gear 5*j* (*d*) is engaged with the idler gear and/or gear set 5*j*(*e*) and the idler gear and/or gear set 5*j*(*e*) is engaged with the rack 316*j* of the bar member 314*j*. The lock shell 1*h* or the lock cover 2*j* has an idler shaft 117*j*, and the idler gear and/or gear set 5*j*(*e*) is rotated with respect to the axis of the idler shaft 117*j*. The number of idler gear and/or gear set can be adjusted/changed according to center distance(s), rotation direction(s), and/or shifting(s).

A first part of the bar member 314*j* has a stroke slot 315*j*, a first half part of the bar member 314*j* corresponding to the driving gear 5*j*(*d*) is the rack 316*j*, and a second half of the bar member 314*j* is a mounting surface 317*j*. The mounting surface 317*j* is matched with and mounted inside the lock tongue slot 112*j*, and the bar member 314*h* moves towards the direction of the lock tongue slot 112*j*.

The stroke limiter 20*j* (a cylinder limits the position of the bar member 314*j*) corresponding to the stroke slot 315*j* of the bar member 314*j* is set within the lock shell 1*j* or the lock cover 2*j*. The limiter locates within the stroke slot 315*j*.

The structure of the lock mechanism C11 is basically the same as that of the lock mechanism C9, except for the installation. The lock mechanism C11 structure of the embodiment is mounted on the grip A7 of the handgun A. The structure of the lock shell 1*j*, the shape and installation of the bar member 314*j*, the driving gear 5*j*(*d*) and bar member 314*j* are the same as those of the lock mechanism C9, except for the shape and the structure of the lock cover 2*j*.

The motor placement slot 25*j* connects the mounting base 7*j*(*b*), and the gear-type lock mechanism C11 structure is mounted on the grip A7 of the handgun A via the mounting base 7*j*(*b*). The bar member 314*j* locates on one side of the trigger A2, and the bar member 314*j* locates at the rear end of the trigger A2 when it protrudes. The bar member 314*j* blocks the backward stroke of the trigger A2, so that the trigger A2 cannot be pulled and the gun cannot be fired. The function of locking the firearms when the firearms are not in use is realized.

When the gun is normally used, the motor 5*j*(*b*) is positively electrified for 10 to 100 ms, and the motor 5*j*(*b*) begins to rotate to drive the driving gear 5*j*(*d*) and the idler gear and/or gear set 5*j* (*e*), then to drive the rack 316*j*. The bar member 314*j*, which locates in the lock shell 1*j*, retracts from the rear end of the trigger A2, then the motor 5j(b) does not need to be electrified. The backward stroke of the trigger A2 is not blocked (released) and the trigger A2 is free to be pulled to fire the gun.

The lock mechanism C11 may be used for a portable long-barrelled firearm A' or alike as shown in FIGS. 11.71 and 11.72. The lock mechanism C11 is disposed in such a manner to interact with a trigger A'2 thereof.

Twelfth Preferred Embodiment

Referring to FIGS. 12.1 to FIG. 12.9, according to a twelfth preferred embodiment of the present invention, it provides a gear-type trigger lock mechanism C12, which includes a lock shell 1k, a lock cover 2k and a lock tongue actuator 3k. The lock tongue actuator 3k includes a motor 5k(b), a driving gear 5k(d), an idler gear and/or gear set 5k(e), and a bar member 314k. The lock cover 2k has a motor placement slot 25k inside. The motor placement slot 25k receives the motor 5k(b), and the drive shaft of the motor 5k(b) is connected with a driving gear 5k(d). The lock shell 1k and/or the lock cover 2k has a lock cylinder cavity 11k, which includes a gear mounting cavity 116k and a lock tongue slot 112k. The driving gear 5k(d) locates inside the gear mounting cavity 116k. The bar member 314k is mounted in lock tongue slot 112k, and the driving gear 5k(d) is engaged with the rack 316k of the bar member 314k.

When the center distance between the driving gear 5k(d) and the rack 316k is too short (i.e. the drive gear and the rack cannot be engaged), the idler-wheel 5k(e) can be added to increase the center distance. The driving gear 5k(d) is engaged with the idler gear and/or gear set 5k(e) and the idler gear and/or gear set 5k(e) is engaged with the rack 316k of the bar member 314k. The lock shell 1k or the lock cover 2k has an idler shaft 117k, and the idler gear and/or gear set 5k(e) is rotated with respect to the axis of the idler shaft 117k. The number of idler gear and/or gear set can be adjusted/changed according to center distance(s), rotation direction(s), and/or shifting(s).

A first part of the lock tongue actuator 3k has a stroke slot 315k for slidably receiving the bar member 314k. A first half part of the bar member 314k which is corresponding to the driving gear 5k(d)/the idler-wheel 5k(e) is the rack 316k, and a second half of the bar member 314k has a mounting surface 317k. The mounting surface 317k is matched with and mounted inside the lock tongue slot 112k, and the lock tongue actuator 3k moves towards the direction of the lock tongue slot 112k.

The stroke limiter 20k (a cylinder limits the position the lock tongue actuator 3k) corresponding to the stroke slot 315k of the lock tongue actuator 3k is set within the lock shell 1k or the lock cover 2k. The limiter locates within the stroke slot 315k.

The structure of the lock mechanism C12 is basically the same as that of the lock mechanism C9, except for the installation. The lock mechanism C12 of the present embodiment is installed at the rear of the slide A4 on the handgun A. The structure of the lock shell 1k, the shape and installation of the driving gear 5k(d) and bar member 314k are the same as those of the lock mechanism C9, but the shape and structure of the bar member 314k are different.

The lock mechanism C12 controls the firing pin A6, and a firing pin circular slot B11 is set at the rear of the firing pin A6.

As shown in FIG. 12.3, the present embodiment includes a lock shell 1k and a lock cover 2k which are fixed together. The lock cover 2k has a motor placement slot 25k. A cover side gear mounting cavity 116k is set at the front end of the motor placement slot 25k. The cover side gear mounting cavity 116k has a stroke limiter 20k and an idler shaft 117k. The stroke limiter 20k locates inside the stroke slot 315k, and the idler shaft 117k is connected with the idler gear and/or gear set 5k(e). A motor 5k(b) is installed inside the motor placement slot 25k, and the drive shaft of the motor 5k(b) connects a driving gear 5k(d). The driving gear 5k(d) connects the bar member 314k via the idler gear and/or gear set 5k(e).

A mounting base 7k(b) is on one side of the lock cover 2k, and it locates at the lower side of the motor placement slot 25k near the side gear mounting cavity 116k. The gear-type lock mechanism C12 is mounted via the mounting base 7k(b) at the rear of the gun slide A4.

As shown in FIG. 12.8, the bar member 314k has a stroke slot 315k. There is a semicircular fork 318k at the lower part of the bar member 314k. On one side of the bar member 314k, there exists a rack 316k. The idler gear and/or gear set 5k(e) meshes with the rack 316k.

The gear-type lock mechanism C12 is mounted at the rear of the slide A4 on the handgun A. When the bar member 314k protrudes, the semicircular fork 318k matches the firing pin circular slot B11 at the rear of the firing pin A6. The semicircular fork 318k is stuck at the firing pin circular slot B11. The bar member 314k fastens the firing pin A6 and the gun cannot be fired, as shown in FIG. 12.5 and FIG. 12.7.

When the gun is not in use, as shown in FIG. 12.5 or 12.7, the bar member 314k of the gear-type lock mechanism C12 structure is at the state of protruding, or namely, the semicircular fork 318k of the bar member 314k is stuck at the firing pin circular slot B11. Even if the hammer A5 hits the firing pin A6 and the firing pin A6 has the energy to hit the bullet, it will still be stuck and offset by the semicircular fork 318k, and cannot strike the bullet, thus the gun cannot be fired. This realizes the function of locking the firearms when it is not in use.

Referring to FIGS. 12.4, 12.6, and 12.9, when the gun A is normally used, the motor 5k(b) is positively electrified for 10~100 ms, and a forward current signal drives the motor 5k(b) to rotate forward, driving the driving gear 5k(d). Then the driving gear 5k(d) rotates the idler gear and/or gear set 5k(e). In this way, the idler gear and/or gear set 5k(e) rotates and moves the rack 316k, so the bar member 314k retracts back with the rack 316k. Then the motor 5k(b) does not need to be electrified. The semicircular fork 318k of the bar member 314k rapidly retreats back from the firing pin circular slot B11. The firing pin A6 is not blocked by the bar member 314k and can hit bullets.

The control motor 5k(b) rotates reversely when the lock needs to be closed.

Thirteenth Preferred Embodiment

Referring to FIGS. 13.1 to 13.62, according to a thirteenth preferred embodiment of the present invention, it provides a gear-type trigger lock mechanism C13 includes a lock shell 1l, a lock cover 2l and a lock tongue actuator 3l, including a motor 5l(b), a driving gear 5l(d), an idler gear and/or gear set 5l(e), and a bar member 314l. The lock cover 2l has a motor placement slot 25l inside. The motor placement slot 25l receives the motor 5l(b), and the drive shaft of motor 5l(b) is connected with a driving gear 5l(d). The lock shell 1l and/or the lock cover 2l has a lock cylinder cavity 11l, which includes a gear mounting cavity 116l and a lock tongue slot 112l. The driving gear 5l(d) locates inside the gear mounting cavity 116l. The lock tongue actuator 3l is mounted in lock tongue slot 112*l*, and the driving gear 5*l*(*d*) is engaged with the rack 316*l* of the lock tongue actuator 3*l*.

When the center distance between the driving gear 5*l*(*d*) and the rack 316*l* is too short (i.e. the drive gear and the rack cannot be engaged), the idler-wheel 5*l*(*e*) can be added to increase the center distance. The driving gear 5*l*(*d*) is engaged with the idler gear and/or gear set 5*l*(*e*) and the idler gear and/or gear set 5*l*(*e*) is engaged with the rack 316*l* of the lock tongue actuator 3*l*. The lock shell 1*l* or the lock cover 2*l* has an idler shaft 117*l*, and the idler gear and/or gear set 5*l*(*e*) is rotated with respect to the axis of the idler shaft 117*l*. The number of idler gear and/or gear set can be adjusted/changed according to center distance(s), rotation direction (s), and/or shifting(s).

A first part of the lock tongue actuator 3*l* has a stroke slot 315*l* for slidably receiving the bar member 314*l*. A first half part of the bar member 314*l* which is corresponding to the driving gear 5*l*(*d*)/the idler-wheel 5*l*(*e*) is the rack 316*l*, and a second half of the bar member 314*l* has a mounting surface 317*l*. The mounting surface 317*l* is matched with and mounted inside the lock tongue slot 112*l*, and the lock tongue actuator 3*l* moves towards the direction of the lock tongue slot 112*l*.

The stroke limiter 20*l* (a cylinder limits the position the lock tongue actuator 3*l*) corresponding to the stroke slot 315*l* of the lock tongue actuator 3*l* is set within the lock shell 1*l* or the lock cover 2*l*. The limiter locates within the stroke slot 315*l*.

The structure of the lock mechanism C13 is basically the same as that of the lock mechanism C9, except for the installation. The lock mechanism C13 is installed at the rear of the slide A4 of the handgun A. The basic structure of the lock shell 1*l*, the shape and installation of the driving gear 5*l*(*d*), the idler gear and/or gear set 5*l*(*e*), the bar member 314*l* are the same as those of the lock mechanism C9. The shape and structure of the lock tongue actuator 3*l*, the lock shell 1 and the lock cover 2*l* are partially different from the lock mechanism C9, C10, C11 or C12.

The lock mechanism C13 is mounted at the rear of slide A4 of the handgun A. The lock mechanism C13 structure includes a lock shell 1*l* and a lock cover 2*l*, which are fastened together. The lock cover 2*l* has a motor placement slot 25*l*, and the lock shell 1*l* or the lock cover 2*l* has a gear mounting cavity 116*l*. The motor placement slot 25*l* has a motor 5*l*(*b*) inside. The drive shaft of the motor 5*l*(*b*) is connected with a driving gear 5*l*(*d*), and the driving gear 5*l*(*d*) connects the bar member 314*l* via the idler gear and/or gear set 5*l*(*e*). The bar member 314*l* has a stroke slot 315*l*. The gear mounting cavity 116*l* has a stroke limiter 20*l*. The stroke limiter 20*l* locates in the stroke slot 315*l*. The gear mounting cavity 116*l* has an idler shaft 117*l*, and the idler shaft 117*l* connects the idler gear and/or gear set 5*l*(*e*). The bar member 314*l* has a rack 316*l* on one side. The idler gear and/or gear set 5*l*(*e*) meshes with the rack 316*l*. The lower end of the lock shell 1*l* has a fixing clamp plate 131. The lock mechanism C13 is mounted on the rear of slide A4 of the handgun A via a fixing clamp plate 131. The bar member 314*l* blocks between the firing pin A6 and the hammer A5. When the bar member 314*l* extends, it prevents the hammer A5 from striking the firing pin A6, so the gun cannot be fired.

Fourteenth Preferred Embodiment

Referring to FIGS. 14.1 to 14.52, according to a fourteenth preferred embodiment of the present invention, it provides a semi-automatic electromagnetic telescoping lock mechanism C14, which includes a lock shell 1*m*, a lock cover 2*m* and a lock tongue actuator 3*m*, including a lock tongue spring 4*m*, an electromagnet 5*m*(*f*), a lock tongue limit spring 5*m*(*g*), lock tongue limit block 5*m*(*h*) and a bar member 314*m*. The lock mechanism C14 is mounted on handgun A via the lock shell 1*m*. The lock shell 1*m* and/or lock cover 2*m* defines a lock tongue groove 112*m* and an electromagnet groove 113*m*. The lock tongue groove 112*m* has an opening/lock tongue extending hole 28*m* at one end thereof, that faces to the rear of trigger A2. The bar member 314*m* is slidably engaged with the lock tongue groove 112*m* and is biased by the lock tongue spring 4*m*, which is located at the closed end (opposite to the lock tongue extending hole 28*m*) of the lock tongue groove 112*m*. The first clamp slot 321*m* and the second clamp slot 321*m*(*a*) are located on the bar member 314*m*. The lock shell 1*m* has lock handle sliding groove 320*m*(*a*); and the position of the lock shell 1*m* is corresponding with the lock tongue actuator 3*m*. The lock tongue reset handle 320*m* is in communication with the bar member 314*m* to retract the bar member 314*m*.

The lock tongue limit block 5*m*(*h*) is embedded in the first clamp slot 321*m* or the second clamp slot 321*m*(*a*). The electromagnet (or push-pull solenoid) 5*m*(*f*), the lock tongue limit spring 5*m*(*g*), and the lock tongue limit block 5*m*(*h*) are disposed inside the electromagnetic grove 113*m*. The lock tongue limit block 5*m*(*h*) is designed to correspond with a first clamp slot 321*m* and a second clamp slot 321*m*(*a*) on the bar member 314*m*. The electromagnet 5*m*(*f*) may be driven by a driver (not shown), which may be controlled by a controller (now shown).

The guard slot 12*m* is on the side opening of lock shell 1*m*. The guard slot 12*m* is designed to match with the trigger guard A3. A clamp plate 7*m* is installed on the side of the lock cover 2*m*. The second guard slot 22*m* is built on top of the clamp plate 7*m* and corresponds to the guard slot 12*m*, the clamp plate 7*m* is screwed on the lock cover 2*m*. The second guard slot 22*m* and the guard slot 12*m* form a clipped-shape, which correspond with the trigger guard A3 in order to allow the lock mechanism 14 to clamp on the trigger guard A3 tightly. The bar member 314*m* may be in cylindrical shape; however, the structure of the bar member 314*m* may be in other shapes, as long as it facilitates blocking the trigger A2 from being pulled. When the bar member 314*m* is driven to extend out, the bar member 314*m* blocks the trigger A2 from behind. The lock mechanism C14 is installed below the trigger guard A3 of the handgun A. A safety sensing control system (not shown) may be installed on the handgun A to control the lock mechanism C14. A hole is drilled at the bottom of the trigger guard A3 of the handgun A to allow the bar member 314*m* to go through the drilled hole.

The lock mechanism C14 may be used for a portable long-barrelled firearm A' or alike as shown in FIGS. 14.51 and 14.52. The semi-automatic lock mechanism C14 is disposed in such a manner to interact with a trigger A'2 thereof.

Fifteenth Preferred Embodiment

Referring to FIGS. 15.1 to 15.52, according to a fifteenth embodiment of the present invention, it provides a semi-automatic lock mechanism C15, which includes a lock shell 1*n*, lock cover 2*n* and a lock tongue actuator 3*n*, including a lock tongue spring 4*n*, an electromagnet 5*n*(*f*), a lock tongue limit spring 5*n*(*g*), a lock tongue limit block 5*n*(*h*) and an arc member 314*n*. The lock mechanism C15 is mounted on the handgun A via lock shell 1*n*. The lock shell 1*n* and/or lock cover 2*n* defines a lock tongue groove 112*n* and an electromagnet groove 113*n*. The lock tongue groove 112*n* has an opening/lock tongue extending hole 28*n* at one end thereof, that faces to the rear of trigger A2. The arc member 314*n* is slidably engaged with the lock tongue groove 112*n* and is biased by the lock tongue spring 4*n*, which is located at the closed end (opposite to the lock tongue extending hole 28*n*) of the lock tongue groove 112*n*. The first clamp slot 321*n* and the second clamp slot 321*n*(*a*) are located on the arc member 314*n*. The lock shell 1*n* has a lock handle sliding groove 320*n*(*a*); and the position of the lock shell 1*n* is corresponding with the arc member 314*n*. A lock tongue reset handle 320*n* is in communication with the arc member 314*n* to retract the arc member 314*n*.

The lock tongue limit block 5*n*(*h*) is embedded in the first clamp slot 321*n* or the second clamp slot 321*n*(*a*). The electromagnet (or push-pull solenoid) 5*n*(*f*), the lock tongue limit spring 5*n*(*g*), and the lock tongue limit block 5*n*(*h*) are disposed inside the electromagnetic grove 113*n*. The lock tongue limit block 5*n*(*h*) is designed to correspond with the first clamp slot 321*n* and the second clamp slot 321*n*(*a*) located on the arc member 314*n*. The electromagnet 5*n*(*f*) may be driven by a driver (not shown), which may be controlled by a controller (now shown).

The lock tongue groove 112*n* is designed to be shaped in correspondence with the arc shape of the arc member 314*n*. The lock shell 1*n* and/or lock cover 2*n* define the lock tongue groove 112*n* and the electromagnet groove 113*n*. The guard slot 12*n* is defined by an opening surface of the lock shell 1*n* and lock cover 2*n*. The second guard slot 22*n* is defined by the clamp plate 7*n* and it is designed to match with the guard slot 12*n*. The clamp plate 7*n* is clipped on top of the lock shell 1*n* and lock cover 2*n*. The guard slot 12*n* and the second guard slot 22*n* correspond to the outer shape of the trigger guard A3 for clamping thereto, thus the lock mechanism C15 may be clamped to the trigger guard A3. When lock tongue actuator 3*n* locks, due to its unique shape, it extends behind the trigger from the side in order to prohibit pulling trigger A2.

The lock mechanism C15 may be used for a portable long-barrelled firearm A' or alike as shown in FIGS. 15.51 and 15.52. The lock mechanism C15 is disposed in such a manner to interact with a trigger A'2 thereof.

Sixteenth Preferred Embodiment

Referring to FIGS. 16.1 to 16.4, according to a sixteenth preferred embodiment of the present invention, it provides a semi-automatic lock mechanism C16, which includes a lock shell 1*o*, lock cover 2*o* and a lock tongue actuator 3*o*, including a lock tongue spring 4*o*, an electromagnet 5*o*(*f*), a lock tongue limit spring 5*o*(*g*), lock tongue limit block 5*o*(*h*) and a bar member 314*o*. The lock mechanism C16 is mounted on a handgun A via the U-shaped clamp plate 7*o*. The lock shell 1*o* and/or lock cover 2*o* defines a lock tongue groove 112*o* and an electromagnet groove 113*o*. The lock tongue groove 112*o* has an opening/lock tongue extending hole 28*o* at one end thereof, that faces to the rear of the trigger A2. The bar member 314*o* is slidably engaged with the lock tongue groove 112*o* and is biased by the lock tongue spring 4*o*, which is located at the closed end (opposite to the lock tongue extending hole 28*o*) of the lock tongue groove 112*o*. The first clamp slot 321*o* and the second clamp slot 321*o*(*a*) are located on the bar member 314*o*. The lock shell has lock handle sliding groove 320*o*(*a*); and the position of the lock shell to is corresponding with the lock tongue actuator 3*o*. The lock tongue reset handle 320*o* connects to the bar member 314*o*.

The lock tongue limit block 5*o*(*h*) is embedded in the first clamp slot 321*o* or the second clamp slot 321*o*(*a*). The electromagnet (or push-pull solenoid) 5*o*(*f*), lock tongue limit spring 5*o*(*g*), and lock tongue limit block 5*o*(*h*) are disposed inside the electromagnetic grove 113*o*. The lock tongue limit block 5*o*(*h*) is designed to correspond with a first clamp slot 321*o* and a second clamp slot 321*o*(*a*) on the bar member 314*o*. The electromagnet 5*o*(*f*) may be driven by a driver (not shown), which may be controlled by a controller (not shown).

The structure of the lock mechanism C16 is similar to that of the lock mechanism C13, except the installing method and position. The clamp plate 7*o* is designed in a U-shaped and the area inside 76*o*, which is used to hold gun grip A7. The clamp connection plate 74*o* is built on the inner side of the U-shaped clamp plate 7*o*, the lock shell 1*o* and lock cover 2*o* is installed on the clamp connection plate 74*o*; and the lock mechanism C16 can be installed on the gun grip A7 through the U-shaped clamp plate 7*o*. The lock mechanism C16 is adjustable by adjusting a screw(s) 77*o*. Screws 77*o* are used to connect the U-shaped clamp plate 7*o* with lock shell 1*o* and lock cover 2*o* to improve its stability and safety.

The lock mechanism C16 may be used for a portable long-barrelled firearm A' or alike as shown in FIGS. 16.41 and 16.42. The semi-automatic lock mechanism C16 is disposed in such a manner to interact with a trigger A'2 thereof.

Seventeenth Preferred Embodiment

Referring to FIGS. 17.1 to 17.52, according to a seventeenth preferred embodiment of the present invention, it provides a semi-automatic lock mechanism C17, which includes a lock shell 1*p*, a lock cover 2*p* and a lock tongue actuator 3*p*, including a lock tongue spring 4*p*, a push-pull solenoid 5*p* (which is equivalent to use of a combination of electromagnet, lock tongue limit spring and lock tongue limit block as used in C14, C15, C16, C18, etc.) and an arc member 314*p*. The lock mechanism C17 is mounted on the handgun A via U-shaped clamp plate 7*p*. The lock shell 1*p* and/or lock cover 2*p* defines a lock tongue groove 112*p* and an electromagnet groove (not shown). The lock tongue groove 112*p* has an opening/lock tongue extending hole 28*p* at one end thereof, that faces to the rear of trigger A2. The arc member 314*p* is slidably engaged with the lock tongue groove 112*p* and is biased by the lock tongue spring 4*p*, which is located at the closed end (opposite of the lock tongue extending hole 28*p*) of the lock tongue groove 112*p*. The first clamp slot 321*p* and the second clamp slot 321*p*(*a*) are located on the arc member 314*p*. The lock cover 2*p* has a lock handle sliding groove 320*p*(*a*); and the position of the lock shell 1*p* is corresponding with the arc member 314*p*. The lock tongue reset handle 320*p* is in communication with the arc member 314*p* to retract the arc member 314*p*.

The iron core 51*p* operably engages with the first clamp slot 321*p* or the second clamp slot 321*p*(*a*). The push-pull solenoid 5*p* is disposed inside the electromagnetic grove (not shown). The iron core 51*p* is designed to correspond/operate (engage or release) with the first clamp slot 321*p* and the second clamp slot 321*p*(*a*) located on the arc member 314*p*. The push-pull solenoid 5*p* may be driven by a driver (not shown), which may be controlled by a controller (not shown).

The lock mechanism C17 is designed to be installed on the firearm grip A7, along with the U-shaped clamp plate 7*p*, including lock shell 1*p* and lock cover 2*p*. The arc-shaped lock tongue groove 112*p* is welded on the lock shell 1*p*. The shape of the arc-shaped member 314*p* is matched with that of the lock tongue groove 112*p*. The shape of the second sliding groove 17*p*, which is locating on the lock tongue groove 112*p*, is designed to match with the lock handle sliding groove 320*p*(*a*), where lock tongue reset handle 320*p* is in communication with the arc member 314*p*. The shape of iron core 51*p* is matched with the second clamp slot 321*p*(*a*) and the first clamp slot 321*p*. The lock shell 1*p* and lock cover 2*p* are installed on the side of the U-shaped clamp plate 7*p*. The lock mechanism C17 is mounted on the firearm grip A7 via the U-shaped clamp plate. When the lock tongue actuator 3*p* extends the arc member 314*p* to lock the handgun A, the arc member 314*p* extends behind the trigger A2 from the side of the handgun A. The lock tongue actuator 3*p* is disposed inside the lock cover 2*p*; the push-pull solenoid 5*p* has similar capabilities as the composing elements of the electromagnetic telescoping lock mechanism: a combination of electromagnet, lock tongue limit spring and lock tongue limit block as discussed in other mechanical locks C14, C15, C16 and C18. This lock mechanism C17 is screwed on the firearm grip A7 via the U-shaped clamp plate 7*p*. The position thereof is adjustable.

The principle of the operation in the semi-automatic lock mechanism C17 is similar to the semi-automatic lock mechanism C15; whereas, the lock mechanism is fixed on the grip A7 and the lock tongue actuator 3*p* extends behind the trigger A2 from the side to prohibit pulling the trigger A2 in its locking position.

The lock mechanism C17 may be used for a portable long-barrelled firearm A' or alike as shown in FIGS. 17.51 and 17.52. The lock mechanism C17 is disposed in such a manner to interact with a trigger A'2 thereof.

Eighteenth Preferred Embodiment

Referring to FIGS. 18.1 to 18.52, according to a seventeenth preferred embodiment of the present invention, it provides a semi-automatic lock mechanism C18, which includes a lock shell 1*q*, a lock cover 2*q* and a lock tongue actuator 3*q*, including a lock tongue spring 4*q*, an electromagnet 5*q*(*f*), a lock tongue limit spring 5*q*(*g*), lock tongue limit block 5*q*(*h*) and a bar member 314*q*. The lock mechanism C18 is mounted on handgun A via lock shell 1*q* and/or lock cover 2*q*. The lock shell 1*q* and/or lock cover 2*q* define a lock tongue groove 112*q* and an electromagnet groove 113*q*. The lock tongue groove 112*q* has an opening/lock tongue extending hole 28*q* at one end thereof, that faces to the rear of trigger A2. The bar member 314*q* is slidably engaged the lock tongue groove 112*q* and is biased by the lock tongue spring 4*q*, which is located at the closed end (opposite to the lock tongue extending hole 28*q*) of the lock tongue groove 112*q*. The first clamp slot 321*q* and the second clamp slot 321*q*(*a*) are located on the bar member 314*q*. The lock shell has lock handle sliding groove 320*q*(*a*) and the position of the lock shell is corresponding with lock tongue actuator 3*q*. The lock tongue reset handle 320*q* is in communication with the bar member 314*q* to retract the bar member 314*q*.

The lock tongue limit block 5*q*(*h*) is embedded in the first clamp slot 321*q* or the second clamp slot 321*q*(*a*). The electromagnet (or push-pull solenoid) 5*q*(*f*), lock tongue limit spring 5*q*(*g*), and lock tongue limit block 5*q*(*h*) are disposed inside the electromagnetic grove 113*m*. The lock tongue limit block 5*q*(*h*) is designed to correspond with the first clamp slot 321*q* and the second clamp slot 321*q*(*a*) located on the lock tongue actuator 3*q*. The electromagnet 5*q*(*f*) may be driven by a driver (not shown), which may be controlled by a controller (not shown).

The structure of the lock mechanism (C18) is similar to those of C14 and C16, besides the installing method and position. The lock shell 1*q* is interlocked with the lock cover 2*q*. The clamp plate 7*q*(*b*) is installed on the mounting surface of lock shell 1*q* and the lock cover 2*q*. The lock mechanism C18 is installed on the grip A7 of the handgun A via clamp plate 7*q*(*b*). The bar member 314*q* extends behind the trigger A2 from the side to prohibit pulling the trigger in its locking position.

The lock mechanism C18 may be used for a portable long-barrelled firearm A' or alike as shown in FIGS. 18.51 and 18.52. The lock mechanism C18 is disposed in such a manner to interact with a trigger A'2 thereof.

Nineteenth Preferred Embodiment

Referring to FIGS. 19.1 to 19.6, according to a nineteenth preferred embodiment of the present invention, it provides a semi-automatic lock mechanism C19, which has a structure similar to that of the lock mechanism C17. The lock mechanism C19 comprises a lock shell 1*r*, and a lock tongue actuator 3*r*, including a lock tongue spring 4*r*, a push-pull solenoid 5*r* and an arc member 314*r*. A lock tongue groove 112*r* is designed to be matched with lock tongue actuator 3*r* to be arc-shaped, partially welded on lock shell 1*r*. The second sliding slot numbered as 17*r* is designed on the lock tongue groove 112*r*. An electromagnetic telescoping mechanism is composed by the push-pull solenoids 5*r*, which is installed on the electromagnet groove 113*r* located inside lock shell 1*r*. The lock shell 1*r* is block-shaped and screwed on grip A7 via thickened guard B13. By utilizing the space created by the thickened guard B13, a portion of the lock mechanism C19 or additional features/functions (such as a printed circuit board therefor or other) may be placed therein. The arc member 314*r* extends from one side of the gun to the backside of trigger A2 at full extension position. The arc member 314*r* extends behind the trigger A2 from the side to prohibit pulling the trigger A2 in its locking position. The locked position and unlocked position of the arc member 314*r* are carried out in the same manner as shown in the lock mechanism C17. The push-pull solenoid 5*r* may be driven by a driver (not shown), which may be controlled by a controller (not shown).

Operation of the Lock Mechanisms C14, C15, C16, C17, C18 and C19

The operation processes of the mechanical locks C14 through C19 are carried out in a similar manner as described as follow:

When the handgun A is not in use, the lock tongue spring 4*m*/4*n*/4*o*/4*p*/4*q*/4*r* biases the bar member 314*m*/314*n*/314*o*/314*p*/314*q*/314*r*. The lock tongue limit block 5*m*(*h*)/5*n*(*h*)/5*o*(*h*)/(not shown in C17)/5*q*(*h*)/(not shown in C19), or the iron core (not shown in C14)/(not shown in C15)/(not shown in C16)/51*p*/(not shown in C18)/51*r* is pointing to the second clamp slot 321*m*(*a*)/321*n*(*a*)/321*o*(*a*)/321*p*(*a*)/321*q*(*a*)/321*r*(*a*). The lock tongue limit block 5*m*(*h*)/5*n*(*h*)/5*o*(*h*)/(not shown in C17)/5*q*(*h*)/(not shown in C19) or the iron core (not shown in C14)/(not shown in C15)/(not shown in C16)/51*p*/(not shown in C18)/51*r* is being extended onto the second clamp slot 321*m*(*a*)/321*n*(*a*)/321*o*(*a*)/321*p*(*a*)/321*q*(*a*)/321*r*(*a*). The bar member 314*m*/314*n*/314*o*/314*p*/314*q*/314*r* is extended to block a firing sequence of the handgun A. For example, for the bar member 314*m*, the bar member 314*m* reaches to the rear side of the trigger A2 from the bottom portion of the trigger guard A3 to prevent the movement of the trigger from being pulled. For the bar member 314*n*/314*o*/314*p*/314*q*/314*r*, the bar member 314*n*/314*o*/314*p*/314*q*/314*r* reaches to the rear side of the trigger A2 laterally or from the side to prevent the movement of the trigger A2 from being pulled. The purpose is substantially the same for the bar member 314*m*/314*n*/314*o*/314*p*/314*q*/314*r*, which is to reach to the rear side of the trigger A2 such that the bar member 314*m*/314*n*/314*o*/314*p*/314*q*/314*r* prevents the trigger A2 from being pulled (thus blocks the firing sequence of the handgun A).

The electromagnet 5*m*(*f*)/5*n*(*f*)/5*o*(*f*)/(not shown in C17)/5*q*(*f*)/(not shown in C19) may be electrified, in which the magnetic force caused by the electromagnet 5*m*(*f*)/5*n*(*f*)/5*o*(*f*)/(not shown in C17)/5*q*(*f*)/(not shown in C19) allows the lock tongue limit block 5*m*(*h*)/5*n*(*h*)/5*o*(*h*)/(not shown in C17)/5*q*(*h*)/(not shown in C19) to resist the elastic force caused by the limit spring 5*m*(*g*)/5*n*(*g*)/5*o*(*g*)/(not shown in C17)/5*q*(*g*)/(not shown in C19), resulting the limit block 5*m*(*h*)/5*n*(*h*)/5*o*(*h*)/(not shown in C17)/5*q*(*h*)/(not shown in C19) to eject from the second clamp slot 321*m*(*a*)/321*n*(*a*)/321*o*(*a*)/321*p*(*a*)/321*q*(*a*)/321*r*(*a*); or as the push-pull solenoid (not shown in C14)/(not shown in C15)/(not shown in C16)/5*p*/(not shown in C18)/5*r* is controlled in such a way that the iron core (not shown in C14)/(not shown in C15)/(not shown in C16)/51*p*/(not shown in C18)/51*r* is retracted from the first clamp slot 321*m*/321*n*/321*o*/321*p*/321*q*/321*r*. Under such condition, the bar member 314*m*/314*n*/314*o*/314*p*/314*q*/314*r* can be moved freely. The lock tongue reset handle 320*m*/320*n*/320*o*/320*p*/320*q*/320*r* can then be pulled manually against the elastic force caused by spring 4*m*/4*n*/4*o*/4*p*/4*q*/4*r*. The bar member 314*m*/314*n*/314*o*/314*p*/314*q*/314*r* is then pulled back into the lock tongue groove 112*m*/112*n*/112*o*/112*p*/112*q*/112*r*. As the magnetic force caused by the electromagnet 5*m*(*f*)/5*n*(*f*)/5*o*(*f*)/(not shown in C17)/5*q*(*f*)/(not shown in C19) has been released, the lock tongue limit block 5*m*(*h*)/5*n*(*h*)/5*o*(*h*)/(not shown in C17)/5*q*(*h*)/(not shown in C19) is being bounced into the first clamp slot 321*m*/321*n*/321*o*/321*p*/321*q*/321*r* by the elastic force caused by the limit spring 5*m*(*g*)/5*n*(*g*)/5*o*(*g*)/(not shown in C17)/5*q*(*g*)/(not shown in C19); or as the push-pull solenoid (not shown in C14)/(not shown in C15)/(not shown in C16)/5*p*/(not shown in C18)/5*r* is controlled in such a way that the iron core (not shown in C14)/(not shown in C15)/(not shown in C16)/51*p*/(not shown in C18)/51*r* engages with the first clamp slot 321*m*/321*n*/321*o*/321*p*/321*q*/321*r*. As the lock tongue is now being fixed within the lock tongue groove 112*m*/112*n*/112*o*/112*p*/112*q*/112*r*, the trigger can now be pulled to fire the handgun A.

The electromagnet 5*m*(*f*)/5*n*(*f*)/5*o*(*f*)/(not shown in C17)/5*q*(*f*)/(not shown in C19) may be electrified in order to counter the force exerted by the limit spring 5*m*(*g*)/5*n*(*g*)/5*o*(*g*)/(not shown in C17)/5*q*(*g*)/(not shown in C19) just enough to pull the lock tongue limit block 5*m*(*h*)/5*n*(*h*)/5*o*(*h*)/(not shown in C17)/5*q*(*h*)/(not shown in C19) out from the first clamp slot 321*m*/321*n*/321*o*/321*p*/321*q*/321*r* located on the bar member 314*m*/314*n*/314*o*/314*p*/314*q*/314*r*; or as the push-pull solenoid (not shown in C14)/(not shown in C15)/(not shown in C16)/5*p*/(not shown in C18)/5*r* is controlled to retract the iron core (not shown in C14)/(not shown in C15)/(not shown in C16)/51*p*/(not shown in C18)/51*r* to dis-engage with the first clamp slot 321*m*/321*n*/321*o*/321*p*/321*q*/321*r*. The elastic force of spring 4*m*/4*n*/4*o*/4*p*/4*q*/4*r* causes the bar member 314*m*/314*n*/314*o*/314*p*/314*q*/314*r* to be extended through from the bottom of the trigger guard A3 of the handgun A to behind the trigger A2. In this position, the trigger A2 is prohibited to be pulled backwards. Meanwhile, the electromagnet 5*m*(*f*)/5*n*(*f*)/5*o*(*f*)/(not shown in C19)/5*q*(*f*)/(not shown in C19) or the push-pull solenoid (not shown in C14)/(not shown in C15)/(not shown in C16)/5*p*/(not shown in C18)/5*r* is discharged, the lock tongue limit block 5*m*(*h*)/5*n*(*h*)/5*o*(*h*)/(not shown in C17)/5*q*(*h*)/(not shown in C19) or the iron core (not shown in C14)/(not shown in C15)/(not shown in C16)/51*p*/(not shown in C18)/51*r* is, then, rushed into the second clamp slot 321*m*(*a*)/321*n*(*a*)/321*o*(*a*)/321*p*(*a*)/321*q*(*a*)/321*r*(*a*); the lock tongue actuator 3*m*/3*n*/3*o*/3*p*/3*q*/3*r* is now locked, the trigger A2 cannot be pulled, and the handgun A cannot be fired.

If standby mode is desired, the electromagnet 5*m*(*f*)/5*n*(*f*)/5*o*(*f*)/(not shown in C17)/5*q*(*f*)/(not shown in C19) or the push-pull solenoid (not shown in C14)/(not shown in C15)/(not shown in C16)/5*p*/(not shown in C18)/5*r* will be electrified shortly, the limit block 5*m*(*h*)/5*n*(*h*)/5*o*(*h*)/(not shown in C17)/5*q*(*h*)/(not shown in C19) or the iron core (not shown in C14)/(not shown in C15)/(not shown in C16)/51*p*/(not shown in C18)/51*r* ejects from the second clamp slot 321*m*(*a*)/321*n*(*a*)/321*o*(*a*)/321*p*(*a*)/321*q*(*a*)/321*r*(*a*); meanwhile, the lock tongue reset handle 320*m*/320*n*/320*o*/320*p*/320*g*/320*r* should be pulled manually to be reset.

The mechanical part of the lock actuator can be composed by push-pull solenoid or servo motor accordingly. The operation principle shall be the same. When a servo motor is used, a control system may directly control the servo motor driver.

Twentieth Preferred Embodiment

Referring to FIGS. 20.1 to 20.6, according to a twentieth preferred embodiment of the present invention, it provides a pull-rod style trigger lock mechanism C20.

The lock mechanism C20 includes a lock shell 1*s*, a lock cover 2*s*, a bar member 314*s*, a pull-rod 32*s*, a pull-rod screw 32*s*(*a*), a pull-rod screw hole 32*s*(*b*), a lock tongue spring 4*s* and a self-holding solenoid 5*s*(*a*). The lock shell 1*s* has a lock core cavity 11*s*. A lock core cavity plate 111*s* separates the lock core cavity 11*s* into two cavities: a first pull-rod cavity 11*s*(*a*) and a second pull-rod cavity 11*s*(*b*). The bar member 314*s* comprises a conical frustum 34*s*, which is disposed one end that connects to the pull-rod 32*s*, and the bar member 314*s* is slidably engaged with the first pull-rod cavity 11*s*(*a*), slidable along a moving path of the trigger A2. The bar member 314*s* comprises a trigger clamp 31*s* for receiving the trigger A2 of the handgun A. The pull-rod 32*s* is slidably engaged with the second pull-rod cavity 11*s*(*b*). The pull-rod 32*s* comprises a position limiter 33*s* for limiting the range of the movement of the pull-rod 32*s* within the second pull-rod cavity 11*s*(*b*). In a preferred embodiment of the present invention, the position limiter 33*s* has a diameter larger than the cavity 111*s*(*a*) of the lock core cavity plate 111*s*, while the diameter of the pull-rod 32*s* is sufficiently correspond to or smaller than the diameter of the cavity 111*s*(*a*) such that the pull-rod 32*s* freely slides through the cavity 111*s*(*a*). The opposite end of the pull-rod 32*s* is attached to the conical frustum 34*s* of the bar member 314*s*. The diameter of the conical frustum 34*s* is larger than that of the cavity 111*s*(*a*) of the lock core cavity plate 111*s*, such that the range of the movement of the bar member 314*s* is limited by the lock core cavity plate 111*s*. The position limiter 33*s* may be welded with to the pull-rod 32*s*. The lock tongue spring 4 embraces the pull-rod 32*s* and biases the position limiter 33*s* away from the lock core cavity plate 111*s*. The self-holding solenoid 5*s*(*a*) is set perpendicular to the sliding direction of the bar member 314*s*. The iron core 51*s* on the self-holding solenoid 5*s*(*a*) extends through the lock core hole 18*s* on the lock shell 1*s* and reaches onto the bar member 314*s*, the conical frustum 34*s* or the pull-rod 32*s*. The self-holding solenoid 5*s*(*a*) is disposed in the solenoid shell 6*s*. The trigger clamp 31*s* engages with the trigger A2 firmly. The lock shell 1*s* comprises two parts: the upper lock shell 1*s* and lower lock cover 2*s*, which are interlocked with each other. The upper and lower lock shells 1*s* and 2*s*, respectively, have corresponding/mating shapes and structures.

Two mounting clamp plates 13*s* are provided on the lock shell 1*s* to form a clamp plate slot 14*s*. The lock mechanism C20 is clamped at the front part of the trigger guard A3 with the clamp plate slot 14*s* as shown in FIG. 20.1. In terms of firearms with Picatinny rails, the clamp plate slot 14*s* can be replaced by proper Picatinny rails.

As shown in FIG. 20.3, the self-holding solenoid 5*s*(*a*) is mounted in a manner that allows the iron core 51*s* to extend or retract through the lock core hole 18*s*. There is a cone spring on the iron core 51*s* (under initial status, the cone spring is at its natural state and the iron core extends outwards). To lock, the iron core 51*s* extends onto the bar member 314*s*, such that the conical frustum 34*s* is placed between the iron core 51*s* and the lock core cavity plate 111*s*. In a preferred embodiment of the present invention, the conical frustum 34*s* fits in a gap defined between the iron core 51*s* (when extended onto the bar member 314*s*) and the lock core cavity plate 111*s*.

When the handgun A is not in use, the iron core 51*s* of the self-holding solenoid 5*s*(*a*) extends onto the bar member 314*s*, such that the conical frustum 34*s* of the bar member 314*s* is placed between the iron core 51*s* and the lock core cavity plate 111*s*, such that the bar member 314*s* cannot be moved. Accordingly, since the trigger clamp 31*s* is fastened with the trigger A2, the trigger A2 is blocked and cannot be pulled, therefore the handgun A is unable to fire.

When the handgun A is in use, the self-holding solenoid 5*s*(*a*) of the lock mechanism C20 retracts the iron core 51*s*, releasing the conical frustum 34*s* on the bar member 314*s*, so that the bar member 314*s* can be pulled outwards. The trigger A2 only needs to overcome the elastic force of the lock tongue spring 4*s* on the pull-rod 32*s* to be pulled backward, as shown in FIG. 20.4. After the handgun A is fired, the bar member 314*s* can automatically move back to its original position under the force exerted by the lock tongue spring 4*s* and the pull-rod 32*s*.

When an abnormal condition(s) is detected, the self-holding solenoid 5*s*(*a*) may be electrified to allow the iron core 51*s* to be extended outward onto the bar member 314*s*, the conical frustum 34*s* or the pull-rod 32*s* (depending on when the self-holding solenoid 5*s*(*a*) is driven in relation to a firing sequence of the handgun A). If the iron core 51*s* lands on the conical frustum 34*s* as shown in FIG. 20.4, the pull-rod 32*s* will eventually move back to its original position under the joint force exerted by the lock tongue spring 4*s* and the cone at one side of conical frustum 34*s*, allowing the conical frustum 34*s* to be settled between the iron core 51*s* and lock core cavity plate 111*s*. If the iron core 51*s* extends onto the bar member 314*s*, the conical frustum 34*s* is between the iron core 51*s* and the lock core cavity plate 111*s*, thus the handgun A is locked. If the iron core 51*s* lands on the pull-rod 32*s*, as shown in FIG. 20.5, the pull-rod 32*s* will eventually move back to its original position under the joint force exerted by the lock tongue spring 4*s* and the cone at one side of conical frustum 34*s*. The iron core 51*s* would be pushed back to the retraction position by the force of the conical surface 35*s*, allowing the conical frustum 34*s* to be settled between the iron core 51*s* and lock core cavity plate 111*s*.

Twenty-First Preferred Embodiment

Referring to FIGS. 21.1 to 21.71, according to a twenty-first embodiment of the present invention, it provides a trigger lever lock mechanism C21.

The lock mechanism C21 includes a lock shell 1*t*. The lock core is installed inside the lock core cavity 11*t*, which includes the lock tongue slot 112*t* and the electromagnet installing cavity 113*t*.

The lock mechanism C21 comprises a self-holding solenoid 5*t*(*a*) and a lock tongue actuator 3*t*. The self-holding solenoid 5*t*(*a*) locates in the electromagnet installing slot 113*t*. A lock hole B1 is on the grip A7 of the handgun A. The trigger lever B5 has a limit hole B6 which is at the corresponding position of lock hole B1. The lock shell 1*t* of the lock mechanism C21 is mounted on the grip A7, replacing the grip panel A8. After installation, the lock tongue actuator 3*t* corresponds to the lock hole B1 and the limit hole B6.

A partition plate 94*t* locates in the lock shell 1*t* of the lock mechanism C21, and it separates the lock shell 1*t* into an electromagnet installing slot 113*t* and a lock tongue slot 112*t*.

As shown in FIG. 21.5, the lock mechanism C21 comprises a self-holding solenoid 5*t*(*a*) and a lock tongue actuator 3*t*. The self-holding solenoid 5*t*(*a*) locates in the electromagnet installing slot 113*t*. The electromagnet installing slot 113*t* receives a lock cover 2*t* for housing the self-holding solenoid 5*t*(*a*). The self-holding solenoid 5*t*(*a*) has a round end iron core 52*t*, which can extend into the lock tongue slot 112*t* through a hole on the partition plate 94*t*. The direction of the sliding movement of the lock tongue actuator 3*t* is perpendicular to that of the iron core 52*t* in the lock tongue slot 112*t*. One end of the lock tongue actuator 3*t* has an arc surface 313*t* attaching with the round end of the iron core 52*t*, and the other end of the lock tongue actuator 3*t* has a lock tongue actuating lever 314*t*, which is biased by a lock tongue spring 4*t*.

As shown in FIG. 21.1/21.2/21.3/21.4/21.5, the grip A7 of the gun frame A1 has a frame spring slot B2, and a lock hole B1 locates inside the frame spring slot B2. The lock hole B1 corresponds to the limit hole B6 on the trigger lever B5. The lock shell 1*t* of the lock mechanism C21 instead of the grip panel A8 is mounted on the grip A7. The lock cover 2*t* is attached between the grip A7 of handgun A and the self-holding solenoid 5*t*(*a*), and one end of the lock tongue spring 4*t* locates in the frame spring slot B2 pressing against the gun frame A1. The lock tongue actuating lever 314*t* of the lock tongue actuator 3*t* enters through the lock hole B1 and to the limit hole B6. The lock tongue actuating lever 314*t* corresponds to the lock hole B1 and the limit hole B6.

When the gun is not in use, as shown in FIGS. 21.7 and 21.71, the lock tongue actuator 3*t* extends out, as the iron core 52*t* extends and pressing the lock tongue arc surface 313*t*. The lock tongue actuator 3*t* overcomes the elastic force of the tongue lock spring 4*t*, and the tongue lock actuating lever 314*t* is pushed into the limit hole B6 on the trigger lever B5. The lock tongue actuating lever 314*t* extends into the limit hole B6 and, and thus, the trigger lever B5 is locked. Accordingly, the trigger A2 cannot be pulled, so the handgun A cannot fire, thus achieving the object of keeping the firearm locked when it is not in use.

The state of the lock mechanism C21 when the gun is unlocked is shown in FIG. 21.6/21.61.

When a normal condition(s) is detected, the self-holding solenoid 5*t*(*a*) may be electrified for 10 to 100 ms (the solenoid 5*t*(*a*) itself may have self-holding function, the solenoid 5*t*(*a*) may be able to hold its position). Obtaining instantaneous currents, the round iron core 52*t* instantaneously exits from the lock tongue slot 112*t*. Then the tongue lock spring 4*t* is released, such that the lock tongue actuating lever 314*t* exits from the limit hole B6 by the elastic force. The trigger A2 is no longer blocked and free to be pulled, and the handgun A can fire.

When an abnormal condition(s) is detected, the self-holding solenoid 5*t*(*a*) may be electrified for 10~100 ms, and the lock tongue actuating lever 314*t* is pushed back into the limit hole B6 of the trigger lever B5, and the trigger A2 is locked. The limit hole B6 may be a groove, a slot, a through hole, or any type of structures that may cooperate with the lock tongue actuating lever 314*t* to lock/block the trigger lever B5 from moving.

Twenty-Second Preferred Embodiment

Referring to FIGS. 22.1 to 22.3, according to a twenty-second preferred embodiment of the present invention, it provides a trigger lever lock mechanism C22.

A lock shell 1*u* has an electromagnet installed in the slot 113*u*. A self-holding solenoid 5*u*(*a*) locates in the electromagnet installing slot 113*u*. The lock cover 2*u* locates at the opening of the electromagnet installing slot 113*u*, and the iron core 51*u* extends through the hole in the lock cover 2*u*. The iron core 51*u* comprises a lock tongue actuator 3*u* at one end.

The gun frame A1 has a lock hole B1. The trigger lever B5 corresponds to a limit hole B6 at the lock hole B1. The iron core 51*u* corresponds to the frame spring slot B2, and the lock tongue actuator 3*u* corresponds to the lock hole B1 and the limit hole B6.

When the handgun A is not in use, the locking state of the lock mechanism C22 is shown in FIG. 22.21. The iron core 51*u* is at the normal stretching position. The iron core 51*u* extends through the lock cover 2*u* and the lock hole B1 on the gun frame A1 and stretches into the limit hole B6 on the trigger lever B5. At this time the trigger A2 is locked and cannot be pulled, so that the handgun A cannot be pulled. The purpose of keeping the gun safe when it is not in use is achieved.

During the handgun A is in normal use, when an abnormal condition(s) is detected, as shown in FIG. 22.22, the self-holding solenoid 5*u*(*a*) may be reversely electrified for 10~100 ms (the solenoid 5*u*(*a*) itself has the self-holding function). Obtaining the reverse currents, the iron ore 51*u* retracts and maintains the retraction. At this time the iron core 51*u* has retracted out of the limit hole B6, so the trigger is no longer obstructed and can be pulled freely, and firearms can fire.

When an abnormal condition(s) is detected, the self-holding solenoid 5*u*(*a*) is positively electrified for 10~100 ms, the iron core 51*u* is pushed back into the limit hole B6, and the trigger A2 is locked.

Twenty-Third Preferred Embodiment

Referring to FIGS. 23.1 to 23.7, according to a twenty-third preferred embodiment of the present invention, it provides a trigger lever lock mechanism C23.

The structure of the lock mechanism C23 is substantially the same with that of the lock mechanism C20; however, one substantially different feature(s) therefrom may include a bilateral lever lock as described hereinafter in detail. The lock shell 1*v* includes a first lock shell 1*v*(*a*) and a second lock shell 1*v*(*b*), which are symmetrically connected. The second lock shell 1*v*(*b*) has an electromagnet installing slot 113*v* receives the self-holding solenoid 5*v*(*a*). The iron core 51*v* of the self-holding solenoid 5*v*(*a*) comprises a bend 53*v*.

The first lock shell 1*v*(*a*) and the second lock shell 1*v*(*b*) are mounted on both sides of the grip A7 in order to replace the grip panel A8. The first lock shell 1*v*(*a*) and the second lock shell 1*v*(*b*) have the first lever slot 110*v*(*a*) and the second lever slot 110*v*(*b*). The U-shaped lever 9*v* is slidably engaged with the first lever slot 110*v*(*a*) and the second lever slot 110*v*(*b*). The first lever slot 110*v*(*a*) and the second lever slot 110*v*(*b*) communicate with a first lock tongue slot 112*v*(*a*) and a second lock tongue slot 112*v*(*b*), respectively. The first lock tongue 3*v*(*a*) and the second lock tongue 3*v*(*b*) are operably engaged with the first lock tongue slot 112*v*(*a*) and the second lock tongue slot 112*v*(*b*), respectively. The first lock tongue 3*v*(*a*) and the second lock tongue 3*v*(*b*) comprises a first tongue lock actuating lever 314*v*(*a*) and a second tongue lock actuating lever 314*v*(*b*), respectively. The first lock tongue 3*v*(*a*) and the second lock tongue 3*v*(*b*) are biased with a first tongue lock spring 4*v*(*a*) and a second lock tongue spring 4*v*(*b*), respectively. The bend 53*v* of the iron core 51*v* is operably engaged with an embedded slot 91*v* of the U-shaped lever 9*v* and actuates the U-shaped lever 9*v*. As the U-shaped lever 9*v* is actuated by the iron core 51*v*, two ball ends 95*v*(*a*), 95*v*(*b*) of U-shaped lever 9*v* press on/release the pressures from the arc surface 313*v*(*a*) and the arc surface 313*v*(*b*) of the first lock tongue 3*v*(*a*) and the second lock tongue 3*v*(*b*), respectively. When the pressures are applied onto the arc surface 313*v*(*a*) and the arc surface 313*v*(*b*) of the first lock tongue 3*v*(*a*) and the second lock tongue 3*v*(*b*), respectively, as a result, the applied pressures cause the first tongue lock actuating lever 314*v*(*a*) and the second tongue lock actuating lever 314*v*(*b*) move toward each other to block a firing sequence of the handgun A. When the pressures are released from the first tongue lock actuating lever 314*v*(*a*) and the second tongue lock actuating lever 314*v*(*b*), biasing force of the first tongue lock spring 4*v*(*a*) and the second lock tongue spring 4*v*(*b*) causes the first tongue lock actuating lever 314*v*(*a*) and the second tongue lock actuating lever 314*v*(*b*) to move away from each other to allow a firing sequence of the handgun A to be carried out.

The lock shell 1*v* has a seal cover 1*v*(*c*), and the seal cover 1*v*(*c*) has a cavity 110*v*. The self-holding solenoid 5*v*(*a*) slides within the cavity 110*v* via the U-shaped lever 9*v* driven by bend 53*v* of the iron core 51*v*. In a preferred embodiment of the present invention, the bend 53*v* of iron core 51*v* is L-shaped.

The frame spring slot B2 are on both sides of the grip A7 on the gun frame A1, and a lock hole B1 is opened in the frame spring slot B2. The trigger lever B5 is corresponding to the lock hole B1 with a limit hole B6. The first and second lock tongue actuating levers 314*v*(*a*), 314*v*(*b*) on the first and second lock tongue 3*v*(*a*), 3*v*(*b*) match and corresponds to the limit hole B6. The gun trigger is lock, so the gun cannot be fired.

When the handgun A is not in use, the handgun A may remain locked as its initial state (as shown in FIG. 23.61). The first and second lock tongue 3*v*(*a*), 3*v*(*b*) are protruding toward each other. The first tongue lock lever 314*v*(*a*) and the second tongue locking lever 314*v*(*b*) both extends through the frame spring slot B2 and through the lock hole B1. The first tongue lock lever 314v(a) and the second tongue locking lever 314v(b) extend to the limit hole B6 on the trigger lever B5. The trigger A2 is locked and cannot be pulled, and the handgun A cannot be fired. The function of locking the handgun A when it is not in use is achieved.

While the handgun A is in use, as shown in FIG. 23.51, and when any abnormal condition(s) is not detected, self-holding solenoid 5v(a) may be reversely electrified for 10~100 ms (the solenoid 5v(a) itself has the self-holding function). Obtaining a current, the self-holding solenoid 5v(a) instantly drives the U-shaped lever 9v to move away from the first lever slot 110v(a) and the second lever slot 110v(b). The first lock tongue 3v(a) and the second lock tongue 3v(b) are not compressed by the U-shaped lever 9v, and the first lock tongue 3v(a) and the second lock tongue 3v(b) retract under the force exerted by the tongue lock springs 4v(a), 4v(b). The first tongue lock actuating lever 314v(a) and the second tongue lock actuating lever 314v(b) exit from the limit hole B6 on both sides. The trigger A2 can be pulled without barrier and the handgun A can fire freely.

If the handgun A is in use, and when an abnormal condition(s) is detected, the self-holding solenoid 5v(a) may be positively electrified for 10~100 milliseconds, then the iron core 51v is actuated to drive the U-shaped lever 9v into the first and second lever slots 110v(a), 110v(b), and the first lock tongue 3v(a) and the second lock tongue 3v(b) are pressed to have the first tongue lock actuating lever 314v(a) and the second tongue lock actuating lever 314v(b) moving into the limit hole B6. The trigger A2 is, thus, locked.

Two grip panels A8 both are installed the left side and the right side of the grip A7 of the handgun A via two pieces of lock shell 21v(a) and 21v(b). The first tongue lock actuating lever 314v(a) and the second tongue lock actuating lever 314v(b) act on the left and right side of the trigger lever B5, respectively. This lock mechanism C23 is applicable to a variety of firearms, including handguns and rifles.

Twenty-Fourth Preferred Embodiment

Referring to FIGS. 24.1 to 24.5, according to a twenty-fourth preferred embodiment of the present invention, it provides a tapeline-type trigger lock mechanism C24. The tapeline-type lock mechanism C24 is installed on a handgun A for controlling movement of the trigger A2.

The tapeline-type lock mechanism C24 includes a lock shell 1w, a lock tongue spring 4w, a lock tongue (a string member) 3w, a tapeline disk 8w, a lock cover 2w and a self-holding solenoid 5w(a) in a solenoid shell 6w.

The lock shell 1w defines front, rear, right, left, top and bottom, and has two mounting clamp plates 13w on the right and left sides of the lock shell 1w. The two clamp plates 13w define a clamp plate slot 14w on top of the lock shell 1w. There are mounting holes on the clamp plate slot 14w. The lock shell 1w is fixed on the handgun A through the mounting holes.

A lock core cavity 11w is located on the bottom of the lock shell 1w. A string hole 16w is located on the front of the lock shell 1w connecting through to the lock core cavity 11w. The tapeline disk 8w is operably mounted in the lock tongue cavity 11w. One end of the lock tongue 3w is attached to and twined around a wire slot 83w defined on the tapeline disk 8w. The other end of the string (i.e. the lock tongue 3w) extends through the string hole 16w and connects to the trigger clamp 31w, which engages with the trigger A2.

The lock mechanism C24 further comprises a lock cover 2w, and has a lock cover slot 21w, which corresponds to and interface with the lock core cavity 11w of the lock shell 1w. The lock cover hole 211w is located on the lock cover slot 21w. The lock cover 2w engages with the lock core cavity 11w of the lock shell 1w to encase the tapeline disk 8w.

A round convex plate 19w is situated at the center of the lock core cavity 11w. A lock tongue spring axle 191w is a shaft member, which is located at the axis of the round convex plate 19w. The lock tongue spring axle 191w defines a slot 192w locates along the lengthwise of the lock tongue spring axle 191w.

The lock tongue spring 4w is mounted within the spring mounting cavity 84w in the tapeline disk 8w. The outer ring hook 42w of the lock tongue spring 4w is fixed within the disk slot 82w. The fixed end of the spring 41w is inserted in the slot 192w. The lock tongue spring 4w is mounted within the spring mounting cavity 84w of the tapeline disk 8w. The tapeline disk 8w has a tapeline disk hole 81w, which corresponds to the lock cover hole 211w.

The self-holding solenoid 5w(a) is an actuator, that comprises and actuates an iron core 51w, the iron core 51w corresponds to the tapeline disk hole 81w. The iron core 51w is arranged to pass through the lock cover hole 211w and to the tapeline disk hole 81w. The solenoid shell 6w covers the self-holding solenoid 5w(a), and connects to the lock cover 2w.

The initial state of the iron core 51w extends outward and reaches to the tapeline disk hole 81w, such that the iron core 51w impedes and blocks the movement of the tapeline disk 8w and, thus, the trigger A2 cannot be pulled.

A Picatinny rail or similar rail interface system can be used to replace the clamp plate slot 14w in order to hold the related components onto the handgun A.

High strength soft strings, as well as the soft steel strings with low elastic and memory steel strings may be selected to use as lock tongue 3w.

The tapeline disk 8w can rotate around the axis of the round convex plate 19w on the lock shell 1w and then is repositioned by the force of lock tongue spring 4w, which is substantially similar to the mechanism of a tape measure.

This tech solution needs a tapping at the front end of trigger guard A3 through which the lock tongue 3w passes and connects the trigger A2 and gets fastened. The lock mechanism C24 may be clamped on other types of firearms or portable weapons, such as cross bows. Preference should be given to the self-holding solenoid 5w(a) when selecting the solenoids.

When the handgun A is not in use, or an unsafe/abnormal condition or emergency situation is detected by a controller (not shown), the lock mechanism C24 may be controlled to cause the self-holding solenoid 5w(a) popping out the iron core 51w, which passes through the lock cover hole 211w, within, for example, 150 ms from when the controller detected the condition for locking the firing sequence, and engages with the tapeline disk hole 81w, further causing the tapeline disk 8w to be blocked to prevent it from rotating, such that the lock tongue 3w cannot be pulled. Accordingly, the trigger A2 is locked up and the handgun A cannot be fired.

When the handgun A is in use or permitted for use, the iron core 51w in the self-holding solenoid 5w(a) of the mechanical lock C24 retracts and releases the tapeline disk hole 81w, allowing the tapeline disk 8w to rotate freely.

The lock tongue spring 4w and the lock tongue 3w make free reciprocating motion and the trigger A2 can be moved freely such that the handgun A can be fired. Once the handgun A fires, the lock tongue spring 4w returns to its original position and drives the tapeline disk 8w return to its original position. The iron core 51w, the lock cover hole 211*w* and the tapeline disk hole 81*w* share the same axis, so the handgun A is at unlocked state and can be fired.

Twenty-Fifth Preferred Embodiment

Referring to FIGS. 25.1 to 25.4, according to a twenty-fifth preferred embodiment of the present invention, it provides a box-style lock mechanism C25, which may be installed on a handgun A, around and about a trigger guard A3 of the handgun A.

The lock mechanism C25 includes a lock shell 1*x*, a lock cover 2*x*, a lock tongue 3*x*, a mounting shell 61*x*, an electromagnet 5*x*(*f*) and a permanent magnet 30*x*. There is at least one lock tongue slot 112*x* locating at the lower end of the inner side of the lock shell 1*x*, the lock tongue 3*x* is slidably engaged with the lock tongue slot 112*x*, the permanent magnet 30*x* connects to the lock tongue 3*x*, such that the permanent magnet 30*x* cooperates with the electromagnet 5*x*(*f*) mounted in the mounting shell 61*x*. The lock tongue 3*x* defines a finger window 36*x*, and the finger window 36*x* corresponds to a finger hole 15*x* defined on the lock shell 1*x*.

The electromagnet 5*x*(*f*) is housed in the mounting shell 61*x* and is fastened at one end of the lock shell 1*x*. The electromagnet 5*x*(*f*) is an actuator, and is arranged to cooperate with the permanent magnet 30*x*. The lock cover 2*x* and lock shell 1*x* are arranged to encase the trigger guard A3 from its sides, and the box-style lock mechanism C25 is fastened on the trigger guard A3 by using fastening means, such as mounting screws 92*x*.

The guard clamp slot 12*x* locates at a bottom part of the lock shell 1*x*. The lock cover 2*x* is symmetrical to/corresponds to the lock shell 1*x*. The lock cover 2*x* further comprises a second guard clamp slot 22 that corresponds to the guard clamp slot 12*x*, thus, when the lock shell 1*x* and the lock cover 2*x* mates to encase the trigger guard A2 from its sides, the guard clamp slot 12*x* also corresponds and mates with the second guard clamp slot 22*x*.

In the lock mechanism C25, the mounting shell 61*x* comprises fixing ears 611*x*, defining fixing holes 612*x*. Fastening means, such as shell fixing screws 613*x* may be used to mount the mounting shell 61*x* on the lock shell 1*x*. There is a sealing plate 23*x* set at the front-end of the inner side wall of the lock cover 2*x*.

In the preferred embodiment of the present invention, there are two lock tongue slots 112*x*, symmetrically set at the top and bottom ends of the inner side of the lock shell 1*x*. The lock tongue 3*x* engages with and slides along the lock tongue slots 112*x*.

During the operation, there are two positions of the finger window 36*x*, which are corresponded with finger hole 15*x*. When the lock mechanism C25 is unlocked, the finger hole 15*w* will be placed in finger window 36*w*. Whereas, the finger hole 15*w* locates outside of the finger window 36*w* under locking position.

There is a block 614*x* on the fixing ears 611*x*. The block 614*x* is used for positioning and guiding of the mounting shell 61*x* in reference to the lock shell 1*x*. The block 614*x* is in touch with the front-end surface of the lock shell 1*x*.

When the handgun A is not in use, the lock mechanism C25 is controlled to have the pole of the electromagnet 5*x*(*f*) to be the opposite to the pole of the permanent magnet 30*x*, causing to have the electromagnet 5*x*(*f*) and the permanent magnet 30*x* are attracted each other. The lock tongue 3*x* is then, because of the attraction force, drawn toward the electromagnet 5*x*(*f*). The finger hole 15*x* is, then, blocked by the lock tongue 3*x*, preventing a finger from entering through finger hole 15*x* and the finger window 36*x*. Accordingly, the trigger A2 inside the trigger guard A2 is now blocked.

When the handgun A is allowed for operation/use, the electromagnet 5*x*(*f*) is controlled have a magnetic polar to be the same as that of the permanent magnet 30*x*, thus electromagnet 5*x*(*f*) pushed the permanent magnet 30*x* away. In this condition, electromagnet 5*x*(*f*) pushes the lock tongue 3*x* away swiftly, for example, within 100 milliseconds, allowing the finger hole 15*x* be opened thus allowing a finger to touch the trigger A2 inside the trigger guard A3, and the handgun A can be fired.

Under an abnormal condition or emergency situation, for example, the electromagnet 5*x*(*f*) may be controlled to drive the permanent magnet 30 to be toward each other, such that lock tongue 3*x* to block the finger hole 15 with the lock tongue 3*x*. Accordingly, the trigger A2 cannot be touched and the handgun A cannot be fired.

Once the shooting range officer determines that the shooter's behavior is dangerous (such as, pointing the gun to other people or to the shooter), the officer can send locking signal remotely to the safety control system and control the mechanical lock C to lock the gun.

This invention can be a replacement of the original trigger guard. It can also be combined as a gun component in production.

Twenty-Sixth Preferred Embodiment

Referring to FIGS. 26.1 to 26.7, according to a twenty-sixth preferred embodiment of the present invention, it provides a block style lock mechanism C26, C26', C26", C26'", installed on a handgun A having a trigger guard A3 and trigger A2.

Now referring to FIGS. 26.1 to 26.3, the lock mechanism C26 includes: a solenoid shell 6*y*, a self-holding solenoid 5*y*(*a*), a lock tongue 3*y* and a clamp 7*y*. The solenoid shell 6*y* defines a solenoid cavity 6*y*(*f*) and mounting screw holes 93*y*. The clamp 7*y* includes slot 72*y*, shell mounting side plate 71*y* and two mounting screw holes 93*y*; where the slot 72*y* is designed to match the front part of the trigger guard A3. The solenoid shell 6*y* is screwed on the shell mounting side plate 71*y*, which forms the solenoid cavity 6*y*(*f*). The self-holding solenoid 5*y*(*a*) is installed in the solenoid cavity 6*y*(*f*). The self-holding solenoid 5*y*(*a*) is an actuator, that comprises an iron core 51*y* that is connected to the lock tongue 3*y*. The outer shape of lock tongue 3*y* corresponds to the space between the trigger A2 and the trigger guard A3, and the thickness of the lock tongue 3*y* further matches with the thickness of trigger guard A3.

The lock mechanism C26 is fastened to a part of the trigger guard A3 via fastening means, i.e. the screw holes on the solenoid shell 6*y* and the clamp 7*y*. The clamp 7*y* can be fixed on the handgun A instead of drilling on the handgun A. As shown in FIGS. 26.1 to 26.3, the iron core 51*y* and lock tongue 3*y* align with the front end of the trigger A2.

The lock tongue 3*y* may have a different shape where the shape of the cross-section matches the front end of the trigger guard A3, or can be replaced with a lock tongue 3'*y*. Now, referring to FIG. 26.4, the lock tongue 3'*y* may comprise a trigger slot 38', which corresponds to the shape of the trigger A2, when the lock mechanism C26' is in lock position as shown in FIG. 26.5, the trigger A2 sits in the trigger slot 38' while the remaining of the lock tongue 3'*y* fills the space between the trigger A2 and the trigger guard A3.

The lock tongue 3y, 3'y include a lock tongue mounting hole 37y, 37'y for receiving the iron core 51y. This lock tongue 3y, 3'y performs reciprocating motion driven by the iron core 51y. When the lock tongue 3'y extends to the trigger A2, for example, the trigger A2 fits into the trigger slot 38'y, and, thus, the lock tongue 3'y blocks the trigger A2 to prevent the use of the handgun A.

When the handgun A is not in use, the self-holding solenoid 5y(a) of mechanical lock C26 or C26' may be powered off. The self-holding solenoid 5y(a) remains in the locked state, where the lock tongue 3y, 3'y remains within the trigger guard A3. The lock tongue 3y locates in front of the trigger A2, or the trigger A2 locates inside the trigger slot 38' if the lock tongue 3'y is used, which blocks a finger from pulling the trigger A2.

When the handgun A is permitted to use, the lock mechanism C26 is controlled to cause the iron core 51y and the lock tongue 3y, 3'y to be pulled away from the trigger A2 and the space between the trigger A2 and trigger guard A3. Accordingly, the trigger A2 is accessible to a finger and the trigger A2 can be pulled for firing the handgun A.

When the handgun A is not permitted for use, the lock mechanism C26 may be controlled to drive the self-holding solenoid 5y(a) to cause the iron core 51y to extend and to push the lock tongue 3y, 3'y toward the trigger A2 and the trigger guard A3 thus the shooter's finger cannot be entered into the space between the trigger A2 and the trigger guard A3 to pull the trigger A2.

The actuator, such as the self-holding solenoid 5y(a) shown in FIG. 26.2 may be substituted with other types of actuators. For example, referring to FIG. 26.6, the lock mechanism C26" comprises a motor 5"y(b), which may be used to replace the self-holding solenoid 5y(a). A lock tongue 3"y is driven by a screw rod 5"y(c), which is actuated by the motor 5"y(b). Because of the screw rod 5"y(c), the lock tongue 3"y cannot easily be pulled manually.

The lock mechanism C26" includes the lock tongue 3"y, clamp 7"y, motor 5"y(b), and motor shell 6"y(a). There is a motor mounting cavity 6"y(d) inside the motor shell 6"y(a). The motor shell 6"y(a) comprises a shell fixing plate 6"y(b). The motor shell 6"y(a) comprises a lock tongue slot 6"y(e) and mounting screw holes 93"y, which are located at the opening surface of a motor mounting cavity 6"y(d), in which the motor 5"y(b) is housed, and the motor 5"y(b) actuates the screw rod 5"y(c). A lock tongue guide rod 6"y(c) extends from the motor shell 6"y(a) being parallel to the screw rod 5"y(c). The lock tongue guide rod 6"y(c) engages with a lock tongue guide hole 39"y so that the lock tongue 3"y moves along the lock tongue guide rod 6"y(c). The outline shape of the lock tongue 3"y matches the outline of the front-end of the trigger A2, the thickness of lock tongue 3"y corresponds to the thickness of the trigger guard A3.

The lock tongue 3"y may have a different shape and be replaced with, for example, a lock tongue 3'''y as shown in FIGS. 26.8 and 26.9. The lock tongue 3'''y comprises a lock tongue spiral hole 310'''y and lock tongue guide hole 39'''y, and has a trigger slot 38'''y. The screw rod 5"y(c) engages with the lock tongue spiral hole 310'''y and the lock tongue guide rod 6"y(c) engages with the lock tongue spiral hole 310'''y.

Referring to FIGS. 26.6 and 26.8, the clamp 7"y includes a slot 72"y, a shell mounting side plates 71"y, and two mounting screw holes 93"y; where the slot 72"y is arranged to match the outline of front end of the trigger guard A3. The motor shell 6"y(a) comprises a shell fixing plate 6"y(b) via the shell mounting side plates 71"y. The lock mechanism C26" is screwed on the front end of the trigger guard A3 firmly by fastening means through the mounting screw holes 93"y.

A positive or negative motion of screw rod 5"y(c) is transferred into reciprocating motion of the lock tongue 3"y (or 3'''y) along the screw rod 5"y(c). Thus the lock tongue 3"y (or 3'''y) achieves the same motion ones shown in FIGS. 26.1 to 26.5. The lock tongue 3"y (or 3'''y) enters and leaves the trigger guard A3 blocking a finger from pulling the trigger A2. The lock tongue 3"y (or 3'''y) extends out toward the trigger A2 and the trigger guard A3, then blocks the finger from pulling the trigger A2. Or the trigger A2 is rested inside the trigger slot 38'''y of the lock tongue 3'''y.

A lock tongue convex plate 310'''y(a) may be provided on the lock tongue 3'''y for increasing or adjusting the moving range/scope of the lock tongue 3'''y along the screw rod 5"y(c) without changing the length of the screw rod 5"y(c).

Twenty-Seventh Preferred Embodiment

Referring to FIGS. 27.1 to 27.12, according to a twenty-seventh preferred embodiment of the present invention, it provides a lock mechanism C27, C27', installed on a handgun A. The handgun A may be M1911.

The lock mechanism C27 includes a lock shell 1z and a lock cover 2z. The lock shall 1z defines a lock core cavity 11z for housing a motor 5z(b). The lock shell 1z are arranged to cooperate with the lock cover 2z. The motor 5z(b) comprises a shaft 51z that extends therefrom for actuating a safety lever B20. The safety lever B20 is replaced with an original safety A9 of the safety of the handgun A. The lock shell 1z comprises a fixing plate 10z with screws holes thereon for fastening it on the handgun A.

The safety lever B20 includes a rotary shaft B15 and a safety actuating lever B17. The rotary shaft B15 is connected with the safety actuating cover B17 through a lever B19.

The rear end of the rotary shaft B15 has a motor connection hole B18 sharing the same axial with the rotary shaft B15. The safety lever B20 is connected to the drive shaft 51z of motor 5z(b) through the motor connection hole B18.

The lock cover 2z has a gap 24z thereon, and the rotary shaft B15 extends out of the lock cover 2z through the gap 24z of lock cover 2z.

As shown in FIGS. 27.5 and 27.6, the lock mechanism C27 is installed to replace the original safety A9 of the handgun A. The rotary shaft B15 on the safety lever B20 is installed in the original shaft hole B3 of the handgun A. The original safety actuating lever B16 and the safety actuating lever B17 of the present embodiment are symmetrically mounted in the safety hole B4.

In the case that the handgun A is an M1911, this type of the firearms has its safety only on one side of its body, and the original safety A9 is not a shaft that is inserted into the gun, as shown in FIG. 27.6. The original safety A9 includes the original rotary shaft B14 and the original safety actuating lever B16, so the safety lever B20 can be added to the coaxial and symmetric end of the original safety A9, where the safety lever B20 is similar to the original safety A9 in functionality. The safety lever 20 also has the rotary shaft B15 and the safety actuating lever B17, which does not interfere with the features for the original safety A9. The rotary shaft B15 and the safety actuating lever B17 are symmetrically mounted on both sides of the handgun A, forming two sets of safeties as shown in FIG. 27.5. The drive shaft 5z(c) of the motor 5z(b) is fastened together with the safety connection hole B18. The drive shaft 5z(*c*) can rotate clockwise or counter-clockwise. This rotation allows to lock or unlock the handgun A.

Initially, the handgun A is in the locked state, where the motor 5z(*b*) does not rotate the drive shaft 51z, and the lock mechanism C27 stays in the locked position.

When the handgun A is permitted for use, the motor 5z(*b*) is powered on, actuating the drive shaft 51z to cause the safety actuating lever B17 to move to unlock position.

If the handgun A is needed to be locked, the motor 5z(*b*) is electrified and rotates reversely, actuating the drive shaft 51z to cause the safety actuating lever B17 to move to locked position.

Referring to FIGS. 27.7 to 27.12, a lock mechanism C27' may be applicable to and replaces the original safety lock of handgun A, which is similar to a M92F (BERETTA) or similar. The lock mechanism C27' is arranged to be installed on the slide A4 via lock shell 1'z or a Picatinny rail or other rail interface systems may be used.

The lock mechanism C27' includes a lock shell 1'z, defining a lock core cavity 11'z for housing a motor 5'z(*b*). The lock shell 1 'z is arranged to be installed on the slide A4 of the handgun A. A drive shaft 51'z of the motor 5*b* is connected with a safety lever B20', and the safety lever B20', which is to replace the original safety A9 on the handgun A.

As shown in FIGS. 27.9, 27.10 and 27.11, the safety lever B20' comprises a motor connection hole B18 for receiving the motor drive shaft 5'z(*c*).

As shown in FIG. 27.9, the lock shell 1'z has a fixed plate 10'z and the mounting screw hole 93'z is on the fixing plate 10'z. The lock mechanism C27' is arranged to be installed on the handgun A by fastening means through mounting screw holes 93'z.

Referring to FIGS. 27.7 and 27.8, the original safety A9 of BERETTAM92F, for example, has only one original rotary shaft B14, which serves as a shaft and an actuating lever. The original shaft is inserted into the gun thus no independent symmetrical safety devices can be added, unlike the safety mechanism for an M1911. But BERETTAM92F or this type of firearms, if necessary, the original safety can be removed, a replicated safety lever B20' can be added/replaced like shown above.

When the handgun A is permitted for use, the motor 5'z(*b*) is powered on, actuates the driving shaft 51'z to cause the safety lever B20 to unlocked position. After the safety lever B20' reaches the limit position, the motor 5'z(*b*) stops rotating. The motor 5'z(*b*) may be able to self-lock by itself, so the safety will not get loose easily. Once the safety is opened, and the handgun A can be used. Optionally, the motor 5'z(*b*) may be a rotating electromagnet, or similar device(s).

Twenty-Eighth Preferred Embodiment

Referring to FIGS. 28.1 to 28.6, according to a twenty-eighth preferred embodiment of the present invention, it provides a torsional smart gun trigger lock mechanism C28.

As shown in FIG. 28.2, FIG. 28.3, and FIG. 28.4, the lock mechanism C28 includes a lock shell 1α, a lock cover 2α, and a V-type lock tongue 3α. The lock shell lock 1α defines a core cavity 11α and a lock tongue slot 112α. The V-type tongue lock slot 112α has an opening, and houses the V-type lock tongue 3α. The lock tongue 3α comprises a lock tongue control end 312α(*a*) and the lock tongue executing end 312α(*b*). An angle between the lock tongue control end 312α(*a*) and the lock tongue executing end 312α(*b*) is about between 100° and 120°. The lock tongue 3α is hinged on the side wall of the lock tongue slot 112α via the lock tongue rotary shaft 311α. The torsional spring 4α embraces the lock tongue rotary shaft 311α. One end of the torsional spring 4α is fixed on the side wall of the lock tongue slot 112α; the other end of the torsional spring 4α is attached with the upper end of the lock tongue executing end 312α(*b*). The lock tongue executing end 312α(*b*) of the V-type lock tongue 3α locates at the opening of the upper end of the lock tongue slot 112α. The lock tongue control end 312α(*a*) is connected with the hinge 301α via the hinge shaft 302α. The hinge 301α is connected with the string 303α. The lock core cavity 11α is in communication with the lock tongue slot 112α through the pulling string hole 115α. The string 303α extends through the pulling string hole 115α and connects the permanent magnet 30α. The electromagnet 5α(*f*) is housed in the solenoid installing slot 113α and the permanent magnet 30α locates in the matched permanent magnet sliding slot 114α. The permanent magnet 30α is arranged to slide along the permanent magnet sliding slot 114α. The stroke of the permanent magnet sliding slot 114α matches the lock tongue executing end 312*b*, which can rotate 90 degree; The lock shell 1α is symmetrical to the inner cavity of the lock cover 2α and connects to the lock cover 2α.

As shown in FIG. 28.4 and FIG. 28.5, the lock shell 1α defines a guard clamp slot 12α. A clamp 7α is configured to be fastened on the side of the lock cover 2α by fastening means. The clamp 7α has two threaded connection holes which correspond with the guard clamp slot 12α. The clamp 7α is fixed on the outer wall of the lock cover 2α via the fixing screws 73α. The clamp 7α on the lock cover 2α corresponds to with the guard clamp slot 12α. And the lock mechanism C28 is stuck at the lower part of the trigger guard A3 by fastening means via the guard clamp slot 12α and clamp 7α.

In operation, the electromagnet 5α(*f*) actuates on the permanent magnet 30α to repel each other, thus pushes the permanent magnet 30α to further push the string 303α into an inclined state and further causes to have the string 303α to be settled in the lock tongue slot 112α (as shown in FIG. 28.2). The lock tongue executing end 312α(*b*) and the torsional spring 4α are moved to be at the top of the V-shaped lock tongue slot 112α, thus the trigger a2 is in an unlocked state.

On the other hand, the electromagnet 5α(*f*) actuates the permanent magnet 30α to attract each other, the string 303α is pulled into the permanent magnet sliding slot 114α. The lock tongue executing end 312α(*b*) and the torsional spring 4α located outside the lock tongue executing end 312α(*b*) extends vertically and upwards from the V-type lock tongue slot 112α to block the trigger A2. (as shown in FIG. 28.3).

Preferably, the electromagnet 5α(*f*) may be instantly electrified for about 10~100 ms to generate sufficient magnetic force between the electromagnet 5α(*f*) and the permanent magnet 30α.

The lock mechanism C28 can be installed at the trigger guard A3 of the handgun A, or it may replace the bottom portion of the trigger guard A3.

According to the present preferred embodiment of the present invention, the solenoid 5α, the permanent magnet 30α, the hinge 301α, the hinge shaft 30α2 and the string 303α may be replaced with a shape memory alloy wire. The shape memory alloy wire may be fastened with the lock tongue end 312α(*a*) and the bottom of the lock shell 1α. When the shape memory ally wire is electrified, it retracts back and pulls the lock tongue to rotate.

Variants and Modifications

Various modifications can be made without departing from the sprit of the present invention. For example, the electromagnet 5(*f*), 5*a*(*f*), 5*b*(*f*), 5*c*(*f*), 5*d*(*f*), 5*e*(*f*), 5*f*(*f*), 5*g*(*f*), 5*h*(*f*), 5*i*(*f*), 5*j*(*f*), 5*k*(*f*), 51(*f*), 5*m*(*f*), 5*n*(*f*), 5*o*(*f*), (not shown in C1*y*7), 5*q*(*f*), (not shown in C19), 5*s*(*f*), 5*t*(*f*), 5*u*(*f*), 5*v*(*f*) may be push-pull solenoid or servo motor. For example, it can be realized by using an existing product on the market, for example, a DC miniature bi-directional self-holding solenoid (such as model: HID PJT-01). The solenoid core of this product is retractable by giving positive and negative currents. It can be at self-holding state at two positions until the next reverse current is received, then the iron core changes its position. The existing product of the solenoid, combined with the lock tongue, would serve as the actuator of the automatic spring-type gun lock.

A current to the electromagnet 5(*f*), 5*a*(*f*), 5*b*(*f*), 5*c*(*f*), 5*d*(*f*), 5*e*(*f*), 5*f*(*f*), 5*g*(*f*), 5*h*(*f*), 5*i*(*f*), 5*j*(*f*), 5*k*(*f*), 51(*f*), 5*m*(*f*), 5*n*(*f*), 5*o*(*f*), (not shown in C17), 5*q*(*f*), (not shown in C19), 5*s*(*f*), 5*t*(*f*), 5*u*(*f*), 5*v*(*f*) may be initiated/driven by a current driver (not shown) which may be controlled by a controller (not shown).

The electromagnet the electromagnet 5(*f*), 5*a*(*f*), 5*b*(*f*), 5*c*(*f*), 5*d*(*f*), 5*e*(*f*), 5*f*(*f*), 5*g*(*f*) may disposed at the other end of the electromagnetic installing slot 113, 113*a*, 113*b*, 113*c*, 113*d*, 113*e*, 113*f*, 113*g* at the lock cover 2, 2*a*, 2*b*, 2*c*, 2*d*, 2*e*, 2*f*, 2*g* to obtain substantially the same effect as shown for embodiment C1, C2, C3 C4, C5, C6, C7, C8.

The invention claimed is:

1. A safety lock mechanism for a portable weapon, comprising:

a. an actuator;

b. a driver;

c. locking means operable from an unlocked state to a locked state, being actuated by said actuator driven by said driver for blocking a firing sequence of said portable weapon; and d. a controller for controlling said driver;

wherein said controller causes said locking means to block said firing sequence within 150 ms upon detecting a condition for locking said firing sequence.

2. The safety lock mechanism as recited in claim 1, wherein said actuator permits said locking means to be operable from said locked state to said unlocked state.

3. The safety lock mechanism as recited in claim 2, wherein said actuator actuates said lock means from said locked state to said unlocked state.

4. The safety lock mechanism as recited in claim 3, wherein said controller controls said locking means causing the portable weapon to be initially in said locked state.

5. The safety lock mechanism as recited in claim 1, wherein said actuator comprises:

a. an electromagnet; and b. a permanent magnet, wherein said permanent magnet is affixed to said locking means, and said driver drives said electromagnet to actuate said locking means through said permanent magnet.

6. The safety lock mechanism as recited in claim 5, wherein said locking means comprises a bar member or an arc member for blocking said firing sequence at a trigger, a trigger lever, a hammer, or a firing pin of said portable weapon.

7. The safety lock mechanism as recited in claim 1, wherein said actuator comprising:

a. a motor; and b. a gear, wherein said gear cooperates with said locking means, and said motor actuates said locking means through said gear.

8. The safety lock mechanism as recited in claim 1, wherein said actuator comprises a push-pull solenoid.

9. The safety lock mechanism as recited in claim 1, wherein said actuator comprises a self-holding solenoid.

10. The safety lock mechanism as recited in claim 1, wherein said actuator comprises a motor or rotating electromagnet.

11. The safety lock mechanism as recited in claim 10, wherein said motor comprises a servo motor.

12. The safety lock mechanism as recited in claim 9, wherein said locking means comprises:

a. a bar member, wherein a first distal end of said bar member is attached to a trigger of said portable weapon, said bar member is slidable along a moving path of the trigger, and a second distal end of said bar member comprises means for restricting a range of a sliding movement of said bar member;

b. said bar member further comprising a conical frustum that engages with an iron core of said self-holding solenoid to block said sliding movement of said bar member.

13. The safety lock mechanism as recited in claim 12, wherein said means for restricting said range of said sliding movement of said bar member comprises:

a. a position limiter on said bar member; and b. a cavity plate that engages with said piston limiter for restricting said range of said sliding movement of said bar member.

14. The safety lock mechanism as recited in claim 9, wherein said locking means comprises:

a. a retractable tapeline;

b. a string member movable between a first position and a second position along a moving path of a trigger of said portable weapon, wherein a first distal end of said bar member is attached to said trigger, and a second distal end of said string member is attached to said retractable tapeline and said string member is biased to said first position;

wherein said retractable tapeline defines a slot for receiving an iron core of said self-holding solenoid to lock said string member at said first position.

15. The safety lock mechanism as recited in claim 5, wherein said locking means comprises:

a. a shell fastened over a trigger guard, said shell defining a finger hole; and b. a panel slidably engages with the shell defining a finger window, movable between a first position and a second position, and said permanent magnet is attached to said panel;

wherein said electromagnet cooperates with said permanent magnet, and when said panel slides in said second position, said finger hole and said finger window align to allow an access to a trigger of said portable weapon.

16. The safety lock mechanism as recited in claim 10, wherein said locking means comprises a rotary shaft that actuates a safety of said portable weapon, and said motor actuates said safety through said rotary shaft between said locked state and said unlocked state.

* * * * *